US006551185B1

(12) United States Patent
Miyake et al.

(10) Patent No.: US 6,551,185 B1
(45) Date of Patent: Apr. 22, 2003

(54) AIR INTAKE AND BLOWING DEVICE

(75) Inventors: Kunihiko Miyake, Sakai (JP); Yoshimasa Kikuchi, Sakai (JP); Toru Iwata, Sakai (JP); Masashi Kamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/647,499

(22) PCT Filed: Mar. 25, 1999

(86) PCT No.: PCT/JP99/01505

§ 371 (c)(1),
(2), (4) Date: Nov. 7, 2000

(87) PCT Pub. No.: WO99/50603

PCT Pub. Date: Oct. 7, 1999

(30) Foreign Application Priority Data

Mar. 30, 1998 (JP) ..... 10-083806
Aug. 18, 1998 (JP) ..... 10-231876
Aug. 21, 1998 (JP) ..... 10-235636

(51) Int. Cl.[7] ..... F24F 7/007
(52) U.S. Cl. ..... 454/234; 454/233
(58) Field of Search ..... 454/243, 234, 454/236, 241

(56) References Cited

U.S. PATENT DOCUMENTS 2,552,837 A * 5/1951 Blazer ..... 126/67
5,577,958 A * 11/1996 Kumekawa et al. ..... 454/233

FOREIGN PATENT DOCUMENTS

| | | |
|---|---|---|
| JP | A62120151 | 7/1987 |
| JP | 01038540 A | 8/1989 |
| JP | 02010036 | 1/1990 |
| JP | 04000140 | 1/1992 |
| JP | 4000140 | 1/1992 |
| JP | A669642 | 9/1994 |
| JP | A875208 | 3/1996 |
| JP | 08061735 | 3/1996 |
| JP | A8178405 | 7/1996 |
| JP | A8254325 | 10/1996 |
| JP | A8303849 | 11/1996 |
| JP | 09025889 | 1/1997 |
| JP | A942734 | 2/1997 |
| JP | A9178258 | 7/1997 |

* cited by examiner

*Primary Examiner*—Derek Boles
(74) *Attorney, Agent, or Firm*—Birch, Stewart, Kolasch & Birch, LLP

(57) ABSTRACT

An air intake and blowing device, comprising a blowing fan (11) such as a turbo fan capable of blowing air in all directions which is installed inside a main casing (2) provided with an air intake port (5) and an air blowing port (9) enclosing the air intake port (5), the air blowing port (9) being provided with a vortex flow creating member which creates a spiral blowing vortex air flow to form a spirally swirl-blowing air flow, and air surrounded by the blowing air flow being formed in a stable tornado flow and sucked strongly into the air intake port (5).

32 Claims, 46 Drawing Sheets

(a) RELATION BETWEEN Vz AND Vθ
(ONE DUST OCCURRING POINT, VENTILATION AREA :□1.1m)

(b) RELATION BETWEEN Vr AND Vθ
(ONE DUST OCCURRING POINT, Vθ/Vz=0.5, VENTILATION AREA :□1.1m)

(c) RELATION BETWEEN Vz AND Vr
(ONE DUST OCCURRING POINT, Vθ/Vz=0.5, VENTILATION AREA :□1.1m)

(d) RELATION BETWEEN Vz AND Vθ WHEN SMOKE LEAK RATE ≦ 10%
(ONE DUST OCCURRING POINT, VENTILATION AREA :□1.1m)

(e) RELATION BETWEEN Vz AND Vθ WHEN ABSORPTION SWIRL IS STABLY FORMED
(ONE DUST OCCURRING POINT, VENTILATION AREA :□1.1m)

AIR INTAKE AND BLOWING DEVICE

This application is the national phase under 35 U.S.C. §371 of PCT International Application No. PCT/JP99/01505 which has an International filing date of Mar. 25, 1999, which designated the United States of America.

TECHNICAL FIELD

The present invention relates to an air intake and blowing device capable of forming a spiral swirl flow of air to be sucked in and blown.

BACKGROUND ART

In general, as a method for discharging air from a specified local place, an air intake and blowing device for generating a spiral intake air swirl flow is used in relation to the air to be blown.

As an example, Japanese Patent Laid-Open Publication No. SHO 64-38540 discloses a device for blowing an air flow from four posts to generate a spirally rising swirl flow within a space partitioned by air curtains and causing an air intake effect in a direction perpendicular to the swirl flow in a center portion of the space.

However, the above-mentioned device has the problem that the four posts are required to be installed and is restricted in terms of installation space.

In view of the above, as an air intake and blowing device eliminating the posts as described above, there are proposed devices disclosed in, for example, Japanese Patent Laid-Open Publication No. HEI 4-140, Japanese Patent Laid-Open Publication No. HEI 9-25889 and Japanese Patent Laid-Open Publication No. HEI 8-75208.

First, according to the Japanese Patent Laid-Open Publication No. HEI 4-140, in an exhaust system in which an exhaust hood is provided in an upper portion of a space from which exhaust is to be discharged, an exhaust port connected to an exhaust fan is formed in a center portion of the exhaust hood, a spirally rising vortex air flow is generated below the surface of the exhaust hood by the blowing air and a negative pressure from the exhaust port obtained by blowing air in a tangential direction of a circumference concentric with the center of the exhaust port and discharge of air inside the space from which exhaust is to be discharged is performed by the vortex air flow, an air supply chamber is fixed to an outer peripheral portion located in a lower portion of the exhaust hood and is to be discharged is performed by the vortex air flow so as not to disturb the vortex air flow by alternately arranging at regular intervals air blowing ports for blowing air in a tangential direction of a circumference concentric with the center of the exhaust port and fixed air blowing ports for blowing air toward the surface of the downside floor surface on the lower surface of the exhaust chamber and blowing air from the air blowing ports toward the floor surface.

Next, the device of Japanese Patent Laid-Open Publication No. HEI 9-25889 has a construction employing a centrifugal air blower constructed so that air is sucked from an air intake port by the rotation of an impeller and the air is discharged from inside the impeller to the outer periphery, wherein a pipe section that extends downward in the rotating axis direction from an end surface located on the intake side of the impeller and a propeller that rotates together with the impeller and generates a swirl air flow cylindrically enclosing the periphery of the intake air flow sucked into the intake port is provided on the outer peripheral surface of this pipe section.

Furthermore, the device of Japanese Patent Laid-Open Publication No. HEI 8-75208 has a construction including an exhaust passage having a circular air intake port, an air supply passage in which an air blowing port is arranged in an annular shape so as to form a concentric circle outside the air intake port, a plurality of air flow guide vanes that are elongated in a direction of the annular passage inside the annular passage of the air supply passage and are arranged so as to divide the annular direction of the annular passage and a swirl air flow guide hood that is widen toward the end and protruded so as to form a circle concentric with the air intake port of the exhaust passage on the outer periphery of the air blowing port of the air supply passage, wherein the exhaust passage and the air supply passage are positioned on the same side of the planes of the air intake port and the air blowing port, the air flow guide vanes are constructed so as to be wholly turned aslant in an identical direction relative to the direction of center axis of the intake air flow caused by the intake of air of the air intake port of the exhaust passage, and a swirl air flow turned aslant in the reverse direction relative to the air intake direction of the air intake port by the guide vanes is blown outwardly of the periphery of the air intake port from the annular air blowing port located around the air intake port.

The aforementioned prior art examples have the problems as follows.

That is, in the case of Japanese Patent Laid-Open Publication No. HEI 4-140, it is required to provide the air supply chamber having an outer diameter corresponding to the circumference of the exhaust hood having a great opening diameter continued to the exhaust duct and arrange a number of air blowing ports for blowing air in the tangential direction relative to the center of the exhaust port and air blowing ports for blowing air toward the downside floor surface in the air supply chamber. Therefore, a large-scale complicated device construction including the exhaust duct is needed, for which loud noises are generated and the device can only be used as a spot exhaust device for large-scale installations such as factories.

Therefore, this device is not suitable for devices such as air conditioners and air purifiers that are required to be compact and comfortable.

Next, the device of Japanese Patent Laid-Open Publication No. HEI 9-25889, which can cope with the requirement of comfortableness though not quite satisfactorily, can be applied to only a duct system ventilating device. Furthermore, it is required to provide a supply air fan extended downward from the air intake port of the exhaust fan, and therefore, compacting of the device is hard to achieve.

Next, the device of Japanese Patent Laid-Open Publication No. HEI 8-75208, which needs a large vortex flow guide hood around the outlet port, has a complicated structure. There is a further problem that the device can only be applied to the duct type ventilating device.

The generation of the tornado flow that flows toward the air intake port and exerts a great influence on the air intake and blowing operation requires the essential condition that the vortex flow blown from the air blowing port surrounding the tornado flow is stably generated.

As shown in FIG. 42, the vortex flow that is a factor for generating the tornado flow is blown from an annular air blowing port 152 formed in an outer peripheral portion of a panel member 151 positioned on the lower surface of the air intake and blowing device. In this case, an air blowing passage 153 continued to the air blowing port 152 has an inclined cross-section shape inclined radially outwardly toward an air blowing side surface 151*a* of the panel member 151, and a plurality of vortex flow creating stators (fixed vanes) 155 for imparting a swirl component to the blowing air are mounted at regular intervals in the circumferential direction inside the air blowing passage 153. Then, by the swirl component imparting effect of the vortex flow creating stators 155, the blowing air becomes a vortex flow that is spirally blown out of the air blowing port 152.

In this case, in order to make the air blown from the air blowing port 152 become a stable vortex flow, the air flow direction is desired to be extended in a direction of extension of the air blowing passage 153, as indicated by a stream line $A_{01}$ in the figure. However, if the air intake and blowing device is a ceiling embedded type, then, due to the existence of an outside ceiling 154 forming a plane roughly identical to that of the panel member 151 on which the air blowing port 152 is opened, Coanda effect is exerted on the blowing air by a portion located outside the air blowing port 152 of the panel member 151 and the ceiling 154 continued to the portion. Therefore, the air flow blown from the air blowing port 152 receives the effect that it adheres to the ceiling 154 and is diffused radially outwardly along this as indicated by the stream line $A_1'$ in the figure. As a result, stable generation of a vortex flow is hindered to consequently lead to difficulties in stably generating the tornado flow. This has led to the problem that sufficient air intake and blowing performance utilizing the sucking force of the tornado flow cannot be obtained, and installation in a place that causes the generation of the Coanda effect as described above is restricted to reduce the versatility.

Furthermore, according to the aforementioned conventional exhaust device utilizing the strong sucking force of the tornado flow, the performance largely depends on, for example, where the device is installed in the space (for example, a room) from which exhaust is to be discharged. Accordingly, there has been the problem that the device installation position is inevitably restricted to hinder the versatility of the device in order to obtain high performance.

In developing means for resolving the aforementioned problems, the present inventor et al. first examined (A) a relation between the performance and the installation position of an air intake and blowing device utilizing a tornado flow, (B) a relation between the performance and the stability of the tornado flow and (C) a relation between the stability of the tornado flow and a static pressure, through experiments. The contents and the results of examination will be described below.

(A) Relation between the performance and the installation position of the air intake and blowing device FIG. 54A shows five patterns supposed as installation patterns, i.e., an installation position 1 through an installation position 5 of an air intake and blowing device Y in a room X having a rectangular plane shape.

The installation position 1 is a pattern according to which the air intake and blowing device Y is installed at the center of the room X.

The installation position 2 is a pattern according to which the air intake and blowing device Y is installed in a position located between the center of the room X and its one wall surface.

The installation position 3 is a pattern according to which the air intake and blowing device Y is installed in contact with the center of one wall surface of the room X.

The installation position 4 is a pattern according to which the air intake and blowing device Y is installed in a position located between the center of the room X and a corner formed by adjacent two wall surfaces.

The installation position 5 is a pattern in which the air intake and blowing device Y is installed in contact with the corner portion formed by adjacent two wall surfaces.

FIG. 54B indicates the performance of the air intake and blowing device by ● marks. In this case, as a method for evaluating the performance of the air intake and blowing device Y, there was adopted a method for collecting and removing for a specified time a specified amount of dust floating in the air of the room X by a built-in dust removing device of the air intake and blowing device Y and indirectly evaluating the air discharge performance (i.e., suction performance of air in the room by a tornado flow) of the air intake and blowing device Y by the remaining dust amount in the air outside the region surrounded by air curtains provided by blowing vortex air flow after a lapse of the specified time. It is to be noted that the evaluation indicated by ○ marks in FIG. 54B is the evaluation with respect to a comparative object of the conventional suction type air intake and blowing device that utilizes no tornado flow.

FIGS. 54A and 54B first show that performance higher than that of the conventional suction type air intake and blowing device that utilizes no tornado flow is obtained by the air intake and blowing device Y that utilizes a tornado flow whichever position of the installation position 1 through the installation position 5 the air intake and blowing device Y is installed, indicating the advantage of the air intake and blowing device Y utilizing the tornado flow.

In another aspect directly connected with the present invention, it can be found that the performance of the air intake and blowing device Y differs depending on the installation position even if air intake and blowing device Y utilizes the tornado flow and that a reduction in performance is significant particularly in the installation position 2.

(B) Relation between the performance of the air intake and blowing device Y and the stability of the tornado flow Examining the state of the tornado flow in the case of, for example, the installation position 1 of satisfactory performance and the state of the tornado flow in the case of the installation position 2 of significantly degraded performance, it was understood that the tornado flow was very stable in the former case and the tornado flow was very unstable in the latter case. Based on this understanding, it can be found that the stable generation of the tornado flow is effective in order to improve and maintain the performance of the air intake and blowing device Y.

(C) Relation between the stability of the tornado flow and a static pressure

Next, a static pressure in the vicinity of the air blowing port in the case of the installation position 1 where high performance could be obtained by the generation of the stable tornado flow and a static pressure in the vicinity of the air blowing port in the case of the installation position 2 where the tornado flow was unstable and the performance was very low were examined by comparison through simulation analysis. As a result, a high static pressure region was generated by the vortex flow blown from the air blowing port in the vicinity of the air blowing port in the case of the installation position 1, and the tornado flow generation region that was the negative pressure region inside the vortex flow was surrounded by this high static pressure region. In contrast to this, in the case of the installation position 2, almost no high static pressure region was formed in the vicinity of the air blowing port. According to this understanding, it is effective to generate a high static pressure region outside the negative pressure region so that the negative pressure region close to the center axis of the vortex flow is surrounded by the vortex flow blown from the air blowing port in order to obtain a stable tornado flow.

(D) Examination of measures for improving in the case of the installation position 2

From the understanding of the aforementioned items (A) through (C), the present inventor et al. examined a variety of measures for improving the performance in the case of the installation position 2.

First, the reason why the performance is low in the installation position 2 is because the generation of the high static pressure region is hindered by some reasons in the vicinity of the air blowing port, and consequently, a tornado flow that greatly influence the performance cannot stably be generated. The cause of the above is presumably ascribed firstly to the fact that the influence of the wall surface of the room exerted on the vortex flow blown from the air blowing port is greater than that in the cases of the other installation positions in the case of the installation position 2 and secondly to the fact that a velocity boundary layer is formed by the vortex flow that is blown from the air blowing port and brought in contact with the peripheral wall surfaces of the air blowing port and the fact that the vortex flow is blown from the air blowing port and thereafter reduced in velocity in an early stage to impair the operation of conversion from the dynamic pressure to a static pressure, by which the generation of the high static pressure region in the vicinity of the air blowing port is hard to achieve.

Accordingly, the present inventor et al. came to realize a construction in which a bank-shaped member was arranged so as to enclose the air blowing port with interposition of an appropriate interval outside the air blowing port as a measure for improving on the basis of the aforementioned presumption. Then, in the case of the installation position 2, the bank-shaped member was arranged outside the air blowing port of the air intake and blowing device Y and the aforementioned experiment was executed again in this state. As a result, it was confirmed that a high performance equivalent to the performance in the case of the installation position 1 could be obtained by providing the bank-shaped member as indicated by the performance point of the ■ mark in FIG. 54B even in the case of the installation position 2. It was further confirmed that a high static pressure region was formed so as to enclose the outside of the vortex flow in the vicinity of the air blowing port of the air intake and blowing device Y in this case. It was further confirmed that a very stable tornado flow was generated in the negative pressure region inside the vortex flow, consequently proving the appropriateness of the aforementioned presumption.

From the understanding of the aforementioned items (A) through (D), the present inventor et al. came to realize it is effective to control the vortex flow blown from the air blowing port by arranging the bank-shaped member with interposition of an appropriate interval outside the air blowing port in order to obtain high performance regardless of the installation position of the air intake and blowing device.

DISCLOSURE OF THE INVENTION

It is an object of the present invention to provide an air intake and blowing device that generates a spirally swirl-blowing air flow by installing an air blowing fan capable of blowing air in all directions inside a main casing provided with an air intake port and an air blowing port enclosing the air intake port and providing a vortex flow creating member for creating a vortex air flow in the air blowing port, generating a tornado-like air intake vortex flow spirally rising inwardly in the center axis direction.

Another object of the present invention is to ensure high air intake and blowing performance by obtaining a stable tornado flow by an air intake and blowing device utilizing a tornado flow regardless of the installation position of the device and improve the versatility of the device.

Yet another object of the present invention is to obtain high performance of the air intake and blowing device utilizing a tornado flow regardless of the installation position of the device.

In order to achieve the aforementioned objects, the present invention provides an air intake and blowing device wherein a main casing is provided with an air intake port and an air blowing port substantially enclosing the air intake port, and wherein an air passage is formed within the main casing so as to extend from the air intake port to the air blowing port (9), and wherein an air blowing fan capable of blowing air circumferentially in all periphery thereof is provided in the air passage, and wherein a vortex flow creating member for creating a vortex air flow is provided in the air blowing port so that a spiral swirl-blowing air flow is formed so as to generate an intake swirl flow having a sucking force toward a center axis of the spiral swirl-blowing air flow and the air intake port.

In this case, the phrase of "substantially enclosing the air intake port" includes the meaning that the continuous annular air blowing port is completely enclosing the air intake port, the meaning that a plurality of air blowing ports are discontinuously annularly arranged and the plurality of discontinuous annular air blowing ports enclose the air intake port and the meaning that an air blowing port having a polygonal shape, a U-figured shape, a V-figured shape or a shape obtained by removing part of any of the shapes is enclosing the air intake port.

According to the above-mentioned construction, if the air blowing fan is driven, then air in a specified spot region below the air intake port is sucked from the air intake port and blown outwardly of the periphery of an air blowing fan.

Next, the air blown outwardly of the periphery of the air blowing fan is blown toward the floor surface while being formed into a vortex air flow by the operation of the vortex flow creating member of the air blowing port.

Then, the swirl air flow blown from the air blowing port toward the floor surface forms an intake air vortex flow rising up in a tornado form accompanied by a great sucking force of an air flow inwardly in the center axis direction from the floor surface to the air intake port.

As a result, the air in the specified spot region on the floor surface is surely interrupted by the blowing vortex air flow in an air curtain shape provided outside, by which the air is effectively sucked from the air intake port toward the air blowing fan without leaking to the outside. For example, if an air purifying means such as an air filter or an air heat exchanger such as an evaporator or a condenser is provided, then the air conditioning (cooling and heating) efficiency is improved together with the air purifying efficiency.

In one embodiment of the present invention, the air blowing port is comprised of an annular opening continuous in the circumferential direction.

Therefore, the vortex air flow created by the vortex flow creating member is blown from the annular opening that is continuous in the circumferential direction toward the floor surface in a stable state without being disturbed, effecting a reliable air curtain function on the space region located inwardly in the center axis direction and generating a stable intake air vortex flow inwardly in the center axis direction.

In one embodiment of the present invention, the air blowing port is comprised of a plurality of slit-shaped openings arranged at a specified interval in the circumferential direction.

Therefore, the vortex air flow created by the vortex flow creating member is blown from the plurality of slit-shaped openings arranged at a specified interval in the circumferential direction toward the floor surface in a stable state without being disturbed, effecting a reliable air curtain function on the space region inwardly in the center axis direction and generating a stable intake air vortex flow inwardly in the center axis direction.

In one embodiment of the present invention, the vortex flow creating member is comprised of a plurality of stators that have a specified inclination angle of in an air turn direction and are provided in the air blowing port.

Therefore, the air blown outwardly of the periphery by the air blowing fan is blown toward the floor surface while being formed into a stable vortex air flow by the operation of the vortex flow creating member constructed of the plurality of vortex flow creating stators that have a specified inclination angle of in the air turn direction and are provided in the air blowing port.

Then, the stable vortex air flow blown from the air blowing port forms an effective intake air vortex flow rising up in a tornado form accompanied by a great sucking force of an air flow inwardly in the center axis direction from the floor surface to the air intake port.

In one embodiment of the present invention, the vortex flow creating member is comprised of a plurality of first stators that are provided in the air blowing port to adjust an angle of an air turn direction and a plurality of second stators that are provided in the air blowing port to adjust an angle of an air blow direction.

Therefore, the air blown outwardly of the periphery by the air blowing fan firstly gains a vector in the direction of air turn by the first vortex flow creating stator for adjusting the angle of the air turn direction and thereafter has its flare angle in the air blow direction of the vortex flow by the second vortex flow creating stator for adjusting the angle of the air blow direction, by which a vortex flow of the desired turn angle is blown toward the floor surface with the desired flare angle, enabling the arbitrary adjustment corresponding to the broadness of the area of the specified spot region and the required magnitude of the sucking force. This consequently enables the air intake and blowing device to freely cope with the air blow condition corresponding to the installation position of the device.

In one embodiment of the present invention, the air blowing port is formed while being inclined obliquely outwardly from an upstream side to a downstream side of air flow.

Therefore, the air blown outwardly of the periphery from the air blowing fan is smoothly blown from the air blowing port with a smaller ventilation resistance, efficiently forming a vortex air flow.

In one embodiment of the present invention, the air blowing port is formed in a vertical direction from an upstream side to a downstream side of air flow.

Therefore, the air blown outwardly of the periphery from the air blowing fan is surely blown downward from the air blowing port toward the floor surface located below in the vertical direction without causing adhesion in the horizontal direction, by which the vortex air flow is efficiently created by the first and second vortex flow creating stators.

In one embodiment of the present invention, an air blow condition of the air blowing port is set so that a ratio between a circumferential velocity component and a vertical velocity component becomes 0.25 to 1.

As described above, if the air blow condition at the air blowing port is set so that the ratio between the circumferential velocity component and the vertical velocity component becomes 0.25 to 1, then the leak rate of the air in the specified air intake region leaking to the outside is reduced to improve the ventilation efficiency.

The present invention also provides an air intake and blowing device wherein an air intake port and an air blowing port substantially enclosing the air intake port are opened on a casing, and wherein a tornado flow directed toward the air intake port is generated inside a vortex flow by blowing air sucked through the air intake port from the air blowing port as the vortex flow, and wherein the air blowing port is provided with an air flow adhesion preventing member for preventing the vortex flow blown from the air blowing port from adhering to a casing surface.

Therefore, according to this air intake and blowing device, the air flow blown from the air blowing port is prevented from adhering to the surface of the casing by the air flow adhesion preventing operation of the air flow adhesion preventing member, and a vortex flow is stably formed by the air flow. In accordance with this, the internal tornado flow is stably formed to secure high air intake and blowing performance by the strong sucking force of the tornado flow.

In this case, by virtue of the existence of the air flow adhesion preventing member, the vortex flow is stably formed by the air flow blown from the air blowing port even when the surface of a ceiling or the like that may cause the occurrence of the Coanda effect in the vicinity of the air blowing port exists. Accordingly, there is almost no restriction on the installation position of the air intake and blowing device, and the versatility of the air intake and blowing device is improved by that much.

In one embodiment of the present invention, the air flow adhesion preventing member is comprised of an annular body that extends from an outer peripheral edge of the air blowing port to an extension of the outer peripheral edge substantially along the air blow direction of the air blowing port throughout an entire circumference of the outer peripheral edge in a state in which the annular body is protruded from the casing surface.

Therefore, according to this air intake and blowing device, the air flow blown from the air blowing port is blown substantially along the extension in the air blow direction of the air blowing port by the air flow guiding operation of the annular body. Even if the surface of the ceiling or the like that may cause the occurrence of the Coanda effect exists in the vicinity of the air blowing port, then the adhesion of the blowing air toward the surface is immediately prevented, by which the vortex flow is stably created by the air flow. As a result, the aforementioned effect can be reliably obtained by the simple inexpensive construction of the provision of the annular body.

In one embodiment of the present invention, the air flow adhesion preventing member is comprised of an annular body protruded from an outer peripheral edge of the air blowing port into an air blowing passage of the air blowing port throughout an entire circumference of the outer peripheral edge.

Therefore, according to this air intake and blowing device, the corner portion is formed between the annular body and the outer peripheral side edge of the air blowing port, and a swirl flow is formed by the air that flows through the blowing air flow passage toward the air blowing port in this corner portion and stays there. Therefore, by virtue of a synergistic effect produced by the radially inwardly deflecting operation exerted on the air flow blown through the blowing air flow passage from the air blowing port by the swirl flow generated in the blowing air flow passage and the operation of strengthening the directivity in the air blow direction by an increase in flow rate as a consequence of contraction operation due to a reduction in the air flow passage area of the air flow passage ascribed to the generation of the swirl flow, the adhesion of air to the plane in the vicinity of the air blowing port is immediately prevented, and this stably forms the vortex flow, stably generate the tornado flow and ensure high air intake and blowing performance by the sucking force of the tornado flow.

In one embodiment of the present invention, the air flow adhesion preventing member is comprised of an outer annular body protruded from an outer peripheral edge of the air blowing port into an air blowing passage of the air blowing port throughout an entire circumference of the outer peripheral edge and an inner annular body protruded from an inner peripheral edge of the air blowing port into the air blowing passage throughout an entire circumference of the inner peripheral edge.

Therefore, according to this air intake and blowing device, the air flow blown through the blowing air flow passage from the air blowing port has its flow rate increased by the contraction operation due to the reduction in the blowing air flow passage area of the air blowing passage ascribed to the provision of the outer annular body and the inner annular body, and the directivity in the air blow direction is further strengthened. As a result, the adhesion of the blowing air to the plane in the vicinity of the air blowing port is immediately restricted to more stably create the vortex flow, by which the tornado flow is stably formed, ensuring high air intake and blowing performance by the sucking force of the tornado flow.

In one embodiment of the present invention, an air heat exchanger or an air purifying element or both the air heat exchanger and the air purifying element are arranged in an air passage that extends from the air intake port to the air blowing port.

Therefore, according to this air intake and blowing device, a high-performance air conditioner can be provided by the addition of the air temperature adjusting function in the case of the device provided with the air heat exchanger. In the device provided with the air purifying element, a high-performance deodorizing device can be provided in the case where the air purifying element is, for example, an deodorizing element, and a high-performance dust removing device can be provided in the case where the air purifying element is a dust removing element. In the device provided with both the air heat exchanger and the air purifying element, a high-performance air conditioner provided with a deodorizing function or a high-performance air conditioner provided with a dust removing function can be provided.

In one embodiment of the present invention, the air intake port and the air blowing port are connected to an air discharge means and an air supply means, respectively.

Therefore, according to this air intake and blowing device, the air supplied from the air supply means is blown as a vortex flow from the air blowing port, and according to the creation of this vortex flow, the air in the internal region of the vortex flow is sucked in as a tornado flow into the air intake port and discharged to the outside by the air supply means, by which the ventilation operation of the aforementioned region is effectively performed.

In this case, the air intake port and the air blowing port are connected to the air discharge means and the air supply means, respectively. Therefore, for example, by constructing one air intake and blowing unit of the air intake port and the air blowing port, arranging a plurality of air intake and blowing units and connecting the air intake ports and the air blowing ports of the plurality of air intake and blowing units to a single air discharge means and a single air supply means, respectively, a ventilation system capable of concurrently performing the ventilating operation of a plurality of regions can be obtained.

In one embodiment of the present invention, the air supply means is an air conditioning mechanism for supplying temperature controlled air.

Therefore, according to this air intake and blowing device, by constructing the air supply means of an air conditioner mechanism for supplying temperature controlled air, an air conditioner system provided with a ventilating function can be obtained.

In one embodiment of the present invention, a total heat exchange mechanism for performing heat exchange between exhaust air discharged by the air discharge means and supply air supplied by the air supply means is interposed between the air discharge means and the air supply means.

Therefore, according to this air intake and blowing device, a ventilation system having a satisfactory thermal efficiency can be obtained.

The present invention further provides an air intake and blowing device wherein an air intake port and an air blowing port substantially enclosing the air intake port are provided to form a tornado flow directed toward the air intake port inside an vortex flow by blowing air sucked through the air intake port from the air blowing port as the vortex flow, and wherein a wall member that forms a specified corner portion between the wall member and an air blowing side surface of a panel member is provided with the air blowing port in a position outwardly separated by a specified distance from the air blowing port in terms of a plan view.

Therefore, according to this air intake and blowing device, a swirl flow is generated in the corner portion located outside apart from the air blowing port when air is blown from the air blowing port obliquely downward as a vortex flow, and the vortex flow is guided by the swirl flow to reach the lower end of the wall member and thereafter blown into a free space.

As a result, the vortex flow is blown from the air blowing port and thereafter prevented from flowing along the panel member, by which the vortex flow is blown into the free space with its blow velocity almost maintained without velocity reduction ascribed to the formation of a velocity boundary layer between the air flow and the panel member. Then, by the air blowing into the free space, the vortex flow is gradually attenuated in velocity to gradually convert the dynamic pressure thereof into a static pressure, as a consequence of which a high static pressure region is generated in the vicinity of the air blowing port so as to surround a negative pressure region that is the region where the tornado flow is generated. By the formation of the high static pressure region in the vicinity of the air blowing port, the tornado flow in the internal negative pressure region is suppressed by the high static pressure. By the stable formation of the tornado flow in the negative pressure region and the reflection of the sucking force of this tornado flow on the air intake operation, the air intake and blowing device produces high air intake and blowing performance.

Furthermore, this stable tornado flow is achieved by the provision of the wall member outside the air blowing port. This wall member has the function of preventing the influence from the outer space portion from being exerted on the internal vortex flow, and therefore, the performance of the air intake and blowing device is satisfactorily maintained regardless of the installation position of the device. Furthermore, the improvement in performance of the air intake and blowing device is achieved by the very simple construction in which the wall member is arranged, and this allows the maintaining of the performance and cost reduction to be compatible.

In one embodiment of the present invention, the wall member is comprised of a protruding body that is protruded ahead in the air blow direction from the air blowing side surface of the panel member and extended so as to enclose the air blowing port.

Therefore, according to this air intake and blowing device, the cost reduction of the device is further promoted with the very simple construction in which the protruding body is provided.

In one embodiment of the present invention, the wall member is formed integrally with the panel member provided with the air blowing port.

Therefore, according to this air intake and blowing device, the aforementioned effect can be obtained while preventing the increase in number of components.

In one embodiment of the present invention, the wall member is comprised of a room interior wall that is arranged so as to be extended in a direction approximately perpendicular to a surface of the panel member in a state in which the wall surface encloses the panel member provided with the air blowing port.

Therefore, according to this air intake and blowing device, the cost reduction can be achieved by the reduction in number of components by virtue of the needlessness of the special member as the wall member, and high performance can be effected regardless of the installation position of the device by using the air intake and blowing device having the conventional structure provided with no wall member as it is.

In one embodiment of the present invention, a guide member extended in a direction of extension of an outer peripheral wall of the air blowing port is provided throughout the entire region of the air blowing port.

Therefore, according to this air intake and blowing device, the vortex flow blown from the air blowing port is prevented from adhering to the air blowing side surface of the panel member by being guided by the guide member, reliably preventing the formation of the velocity boundary layer ascribed to the adhesion to the air blowing side surface. Therefore, the formation of the high static pressure region in the vicinity of the air blowing port is further ensured.

In one embodiment of the present invention, an air heat exchanger is arranged inside an air passage that extends from the air intake port to the air blowing port.

Therefore, according to this air intake and blowing device, the air conditioning function is added to allow the increase in number of functions, and it can be accordingly expected to improve the versatility and commercial value of the air intake and blowing device.

In one embodiment of the present invention, an air purifying element is arranged inside an air passage that extends from the air intake port to the air blowing port.

Therefore, according to this air intake and blowing device, the air purifying function is added to allow the increase in number of functions, and it can be accordingly expected to improve the versatility and commercial value of the air intake and blowing device.

The present invention provides an air intake and blowing device comprising: a panel having an air intake port and an air blowing port that substantially encloses the air intake port; a main casing which internally has an air passage that extends from the air intake port and an air passage that extends to the air blowing port and to which the panel is attached; and a vortex flow creating member for creating a vortex air flow from the air blowing port.

According to this air intake and blowing device, air below the air intake port arranged in an upper portion of the room is interrupted by the vortex flow blown from the air blowing port and rises up in the form of a tornado flow to be sucked into the air intake port. The air sucked into the air intake port is the tornado flow, and therefore, the tornado flow is efficiently sucked in even if the air to be sucked is separated apart from the air intake port.

In one embodiment of the present invention, the air intake port is provided with an exhaust air passage that communicates with the air intake port via the air passage.

According to this air intake and blowing device, the air sucked into the air intake port is discharged through the exhaust air passage via the air passage from the air intake port. Therefore, the contaminated air inside the room can be discharged out of the room.

In one embodiment of the present invention, the air blowing port is provided with a fresh air intake passage that communicates with the air blowing port via the air passage.

According to this air intake and blowing device, fresh air is sucked from the fresh air intake passage and blown from the air blowing port via the air passage to the air blowing port. Therefore, clean fresh air can be introduced into the room.

In one embodiment of the present invention, an air flow adhesion preventing member for preventing the vortex air flow blown from the air blowing port from adhering to a surface of the panel.

According to this air intake and blowing device, the air flow adhesion preventing member prevents the vortex air flow blown from the air blowing port from adhering to the surface of the panel. Therefore, the Coanda effect does not occur in the vortex air flow blown from the air blowing port, stabilizing the vortex flow.

In one embodiment of the present invention, a wall member is provided on a surface of the panel separated apart by a specified distance from the air blowing port toward the outer periphery of the panel, forming a specified corner portion between the panel and the wall member.

According to this air intake and blowing device, the corner portion generates a swirl flow, and this swirl flow stabilizes the vortex flow blown from the air blowing port.

In one embodiment of the present invention, a fan for sucking in air from the air intake port via the air passage and blowing air to the air blowing port via the air passage is provided inside the casing.

According to this air intake and blowing device, the fan inside the casing sucks in the air located below the air intake port from the air intake port through the air passage and blows the air sucked in to the air blowing port via the air passage.

In one embodiment of the present invention, an air intake and blowing device comprises an exhaust fan for blowing to the exhaust air passage the air sucked from the air intake port via the air passage.

According to this air intake and blowing device, the air inside the room can be sucked in through the air passage of the air intake port and discharged out of the room from the exhaust air passage by the exhaust fan. Therefore, the contaminated air inside the room can be discharged.

In one embodiment of the present invention, an air intake and blowing device comprises a supply air fan for blowing the fresh air sucked from the fresh air intake passage to the air blowing port via the air passage.

According to this air intake and blowing device, the supply air fan sucks in fresh air from the fresh air intake passage and blows the fresh air sucked in to the air blowing port via the air passage. Therefore, the clean air outside the room can be supplied.

BEST MODE FOR CARRYING OUT THE INVENTION

First Embodiment

Figure 1:
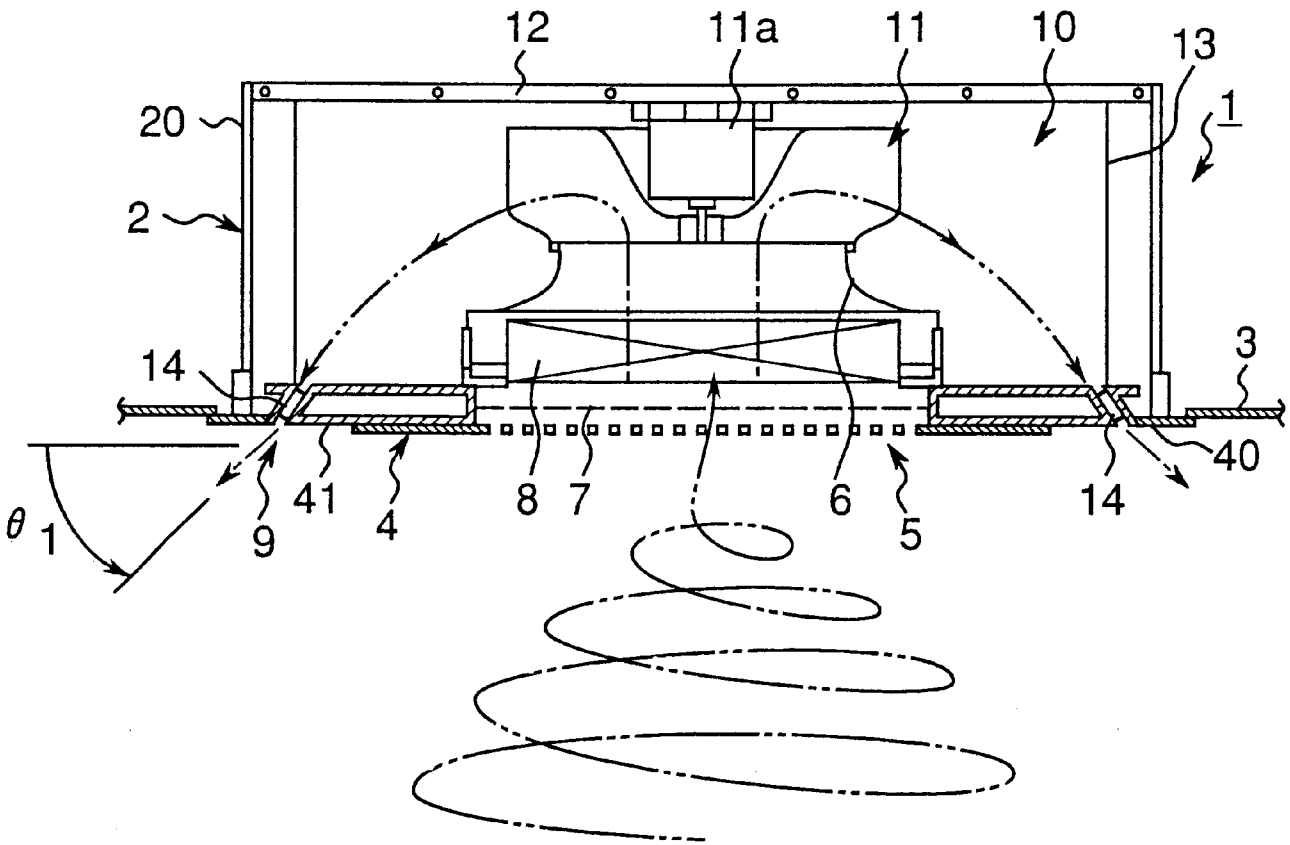
FIG. 1 is a sectional view (A—A of FIG. 2) showing the construction of an air intake and blowing device according to a first embodiment of the present invention.

FIG. 1 through FIG. 10 show the construction, operation and effect of an air intake and blowing device according to a first embodiment of the present invention, applied to, for example, a ceiling embedded type air purifier.

In the figures, the reference numeral 2 first denotes a cassette type main casing of the ceiling embedded type air purifier 1. The main casing 2 is embedded in a ceiling 3 as shown in, for example, FIG. 1 in a manner that its air intake and blowing panel (lower surface panel section) 4 is roughly flush with the ceiling 3 in an approximate identical plane.

Figure 2:
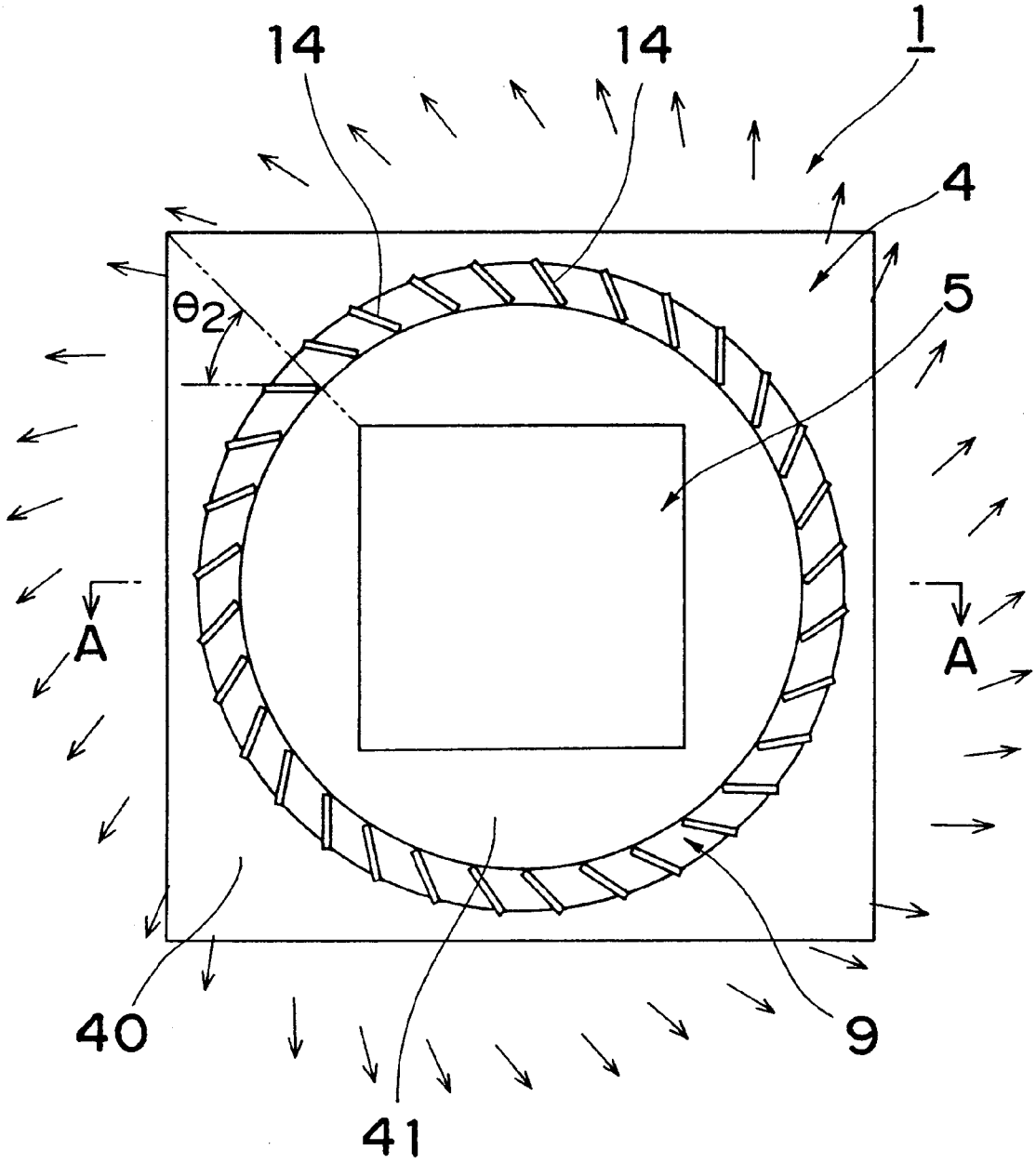
FIG. 2 is a bottom view of the air intake and blowing device of the first embodiment of the present invention.

Then, as shown in, for example, FIG. 2, the air intake and blowing panel 4 of the main casing 2 is provided with a square air intake grill 5 located in a center portion and further internally provided with a bellmouth 6 for a turbo fan 11. Then, a pre-filter 7 and an air purifying element 8 are arranged adjacently in this order from the air flow upstream side to the downstream side between them.

Likewise, as shown in FIG. 2, an annular air blowing port 9 having a specified width is provided around the air intake grill 5 of the air intake and blowing panel 4 of the main casing 2.

Figure 3:
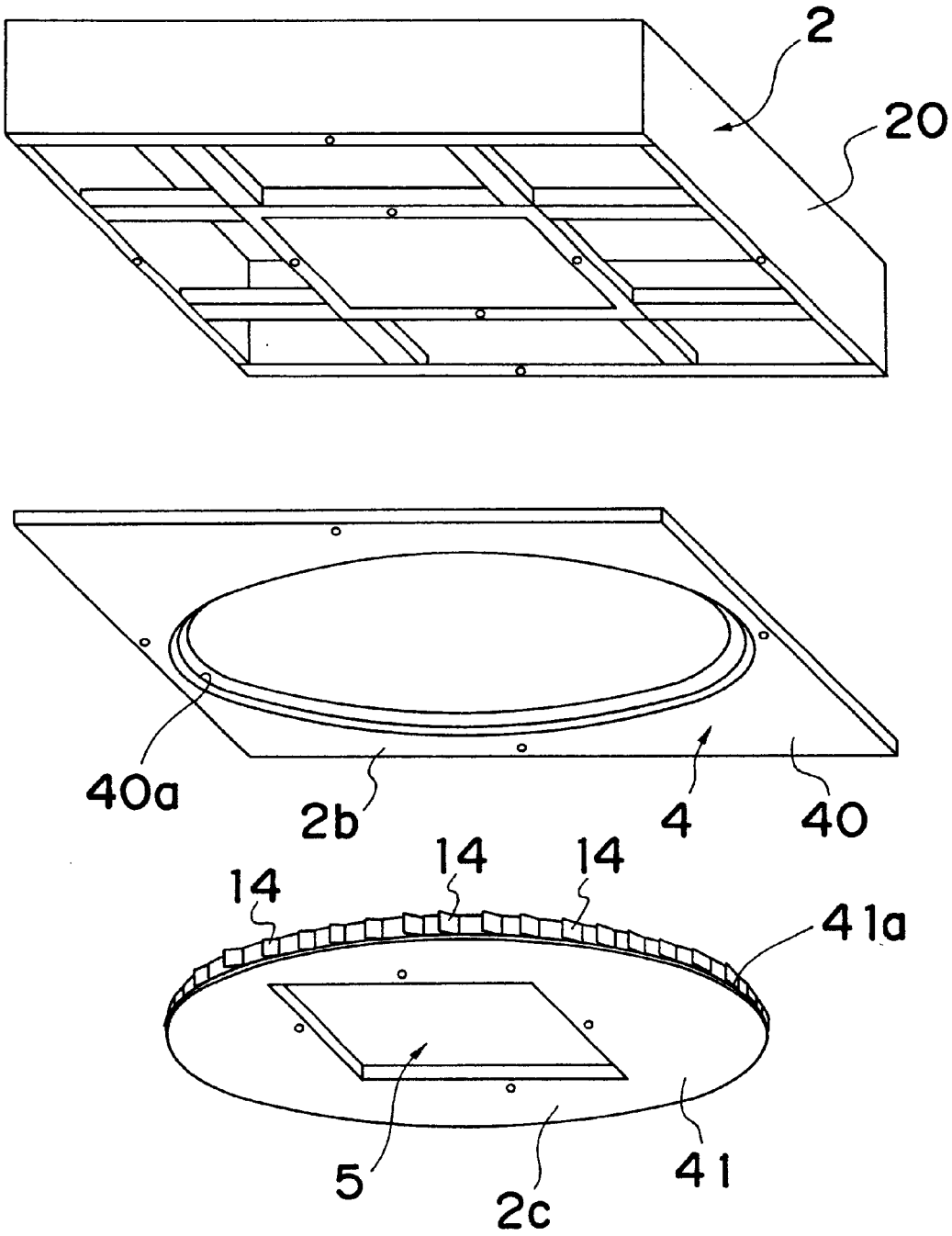
FIG. 3 is an exploded perspective view of the air intake and blowing device of the first embodiment of the present invention.

As shown in, for example, FIG. 1 through FIG. 3, the main casing 2 is constructed by integrating a ceiling panel 12 with an upper surface side of a box-shaped frame 20 whose upper and lower ends are both opened and detachably integrating the air intake and blowing panel 4 with the lower surface side. As shown in detail in, for example, FIG. 3, this air intake and blowing panel 4 is constructed of a square outer frame panel 40 having a circular opening that has a tapered inner peripheral surface 40*a* for forming a tapered outside surface of an air blowing passage of the annular air blowing port 9 and a circular inner frame panel 41 having a tapered outer peripheral surface 41*a* that is fitted into the circular opening of the outer frame panel 40 and forms a tapered inside surface of the air blowing passage of the annular air blowing port 9 and formed by mutually separably fitting and integrating the outer frame panel 40 with the inner frame panel 41, as shown in FIG. 1 and FIG. 2.

Then, the opening of the air intake grill 5 is formed at the center of the inner frame panel 41.

The annular air blowing port 9 is formed into an annular air blowing ports 9 having an air blowing passage inclined at a specified angle $\theta_1$ outwardly of the periphery by the tapered inner peripheral surface 40*a* of the circular opening of the outer frame panel 40 and the tapered outer peripheral surface 41*a* of the inner frame panel 41. Then, the angle of inclination $\theta_1$ of this air blowing passage becomes an air blowing angle $\theta_1$ of the air blowing port 9.

Then, with the above-mentioned construction, an air passage 10 is formed throughout the entire circumference extending from the air intake grill 5 via the pre-filter 7, the air purifying element 8 and the bellmouth 6 to the air blowing port 9 inside the main casing 2. The turbo fan 11 that is positioned at the center behind (in the upper portion in the figure) the air purifying element 8 of the air passage 10 and has its air intake side (shroud side) corresponding to the bellmouth 6 is hung on the ceiling panel 12 of the main casing 2 via a fan motor 11*a*.

A scroll 13 directed to the air blowing port 9 is provided in a state in which it encloses the turbo fan 11 inside the main casing 2.

The air blowing port, 9 is provided with a plurality of vortex flow creating stators (fixed vanes) 14 and 14 that are the vortex flow creating members for creating a swirl-blowing vortex air flow in the spiral direction in correspondence with the scroll 13 and are arranged at regular intervals in the circumferential direction with an angle of inclination $\theta_2$ in the specified direction of turn.

The stators 14, 14, . . . are fixed to the tapered outer peripheral surface 41*a* of the inner frame panel 41.

As described above, according to the air intake and blowing device of the present embodiment, in the ceiling embedded cassette type air purifier, by providing the square air intake grill 5 at the center of the air intake and blowing panel 4 located on the lower surface side of the cassette type main casing 2, providing the annular air blowing port 9 having an air blowing passage inclined at the specified angle $\theta_1$ outwardly of the periphery around the air intake grill 5, forming the circulation type air passage 10 that extends from the air intake grill 5 to the air blowing port 9 and providing the turbo fan 11 at the center of the air passage 10, air sucked from the air intake grill 5 is blown from the air blowing port 9 via the pre-filter 7 and the air purifying element 8 toward the downside floor surface of the room at the specified air blow angle $\theta_1$.

Then, in the air blowing port 9 of the main casing 2 forming the air passage 10, the vortex flow creating stators 14, 14, . . . for giving a vector in the direction of turn to the air flow blown from the air blowing port 9 are provided at specified intervals in the circumferential direction with the specified turn angle $\theta_2$.

Therefore, if the turbo fan 11 is driven, then the room air in a specified spot region below the air intake grill 5 is sucked from the air intake grill 5, purified through the pre-filter 7 and the air purifying element 8 and thereafter blown outwardly of the periphery by the turbo fan 11. A vector in the direction of turn is given to the air flow by the vortex flow creating stators 14, 14, . . . in the air blowing passage of the air blowing port 9, and the air is blown as a spiral vortex flow in the oblique direction toward the downside floor surface.

As a result, by the spiral blowing vortex air flow, a tornado-shaped intake air vortex flow having a great sucking force rising up due to the sucking force of the turbo fan 11 in the opposite direction is formed inwardly in the center axis direction.

Then, this enables the reliable purification of air in the specified spot region surrounded by the spiral blowing vortex air flow.

The air blow condition in the annular air blowing port 9 is examined as follows.

Figure 5:
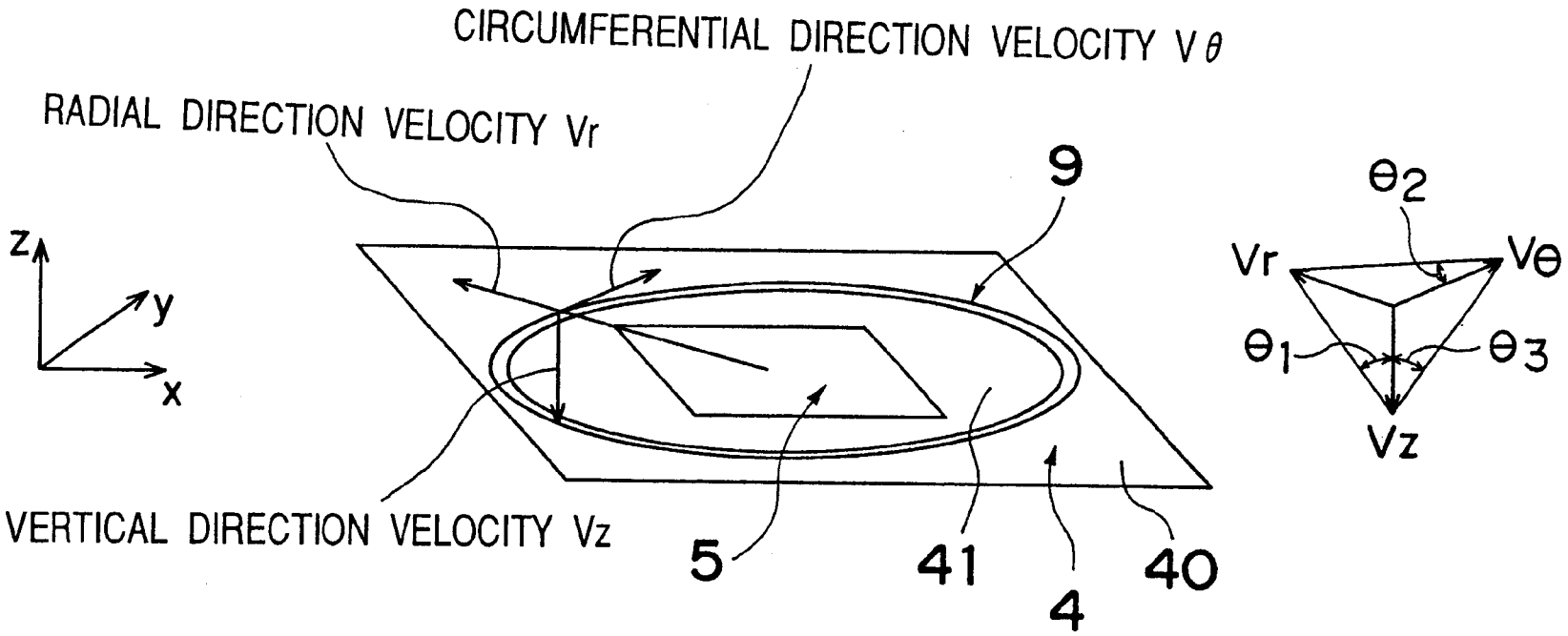
FIG. 5 is a vector diagram for explaining an analysis of the vortex flow generating operation of the air blowing port of the air intake and blowing device of the first embodiment of the present invention.

For example, as shown in FIG. 5, the air blow condition of the blowing vortex air flow in the air blowing port 9 is determined depending on a vertical velocity component (downward velocity) Vz, a radial velocity component (velocity in the centrifugal direction) Vr and a circumferential velocity component (horizontal velocity) Vθ.

Therefore, by appropriately setting the mutual relations between Vz, Vr and Vθ, the desired blowing and intake air vortex flow of the highest ventilation efficiency can be generated.

Figure 4:
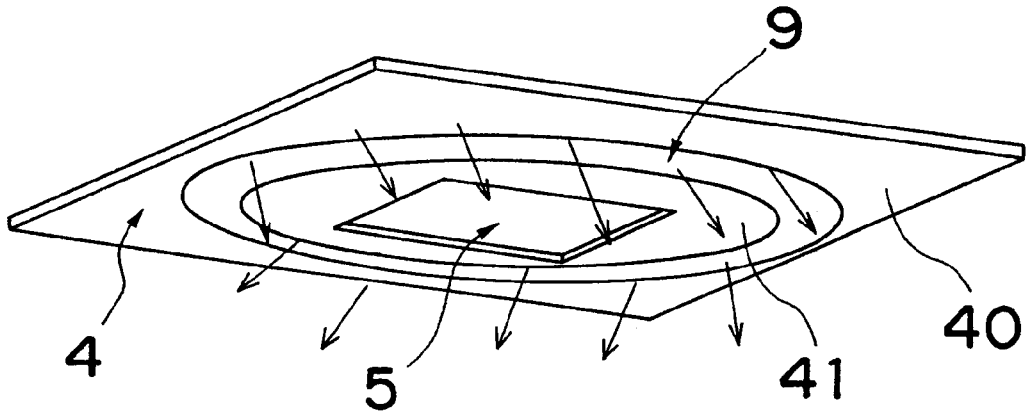
FIG. 4 is an explanatory view showing the vortex flow generating operation of an air blowing port of the air intake and blowing device of the first embodiment of the present invention.
Figure 6:
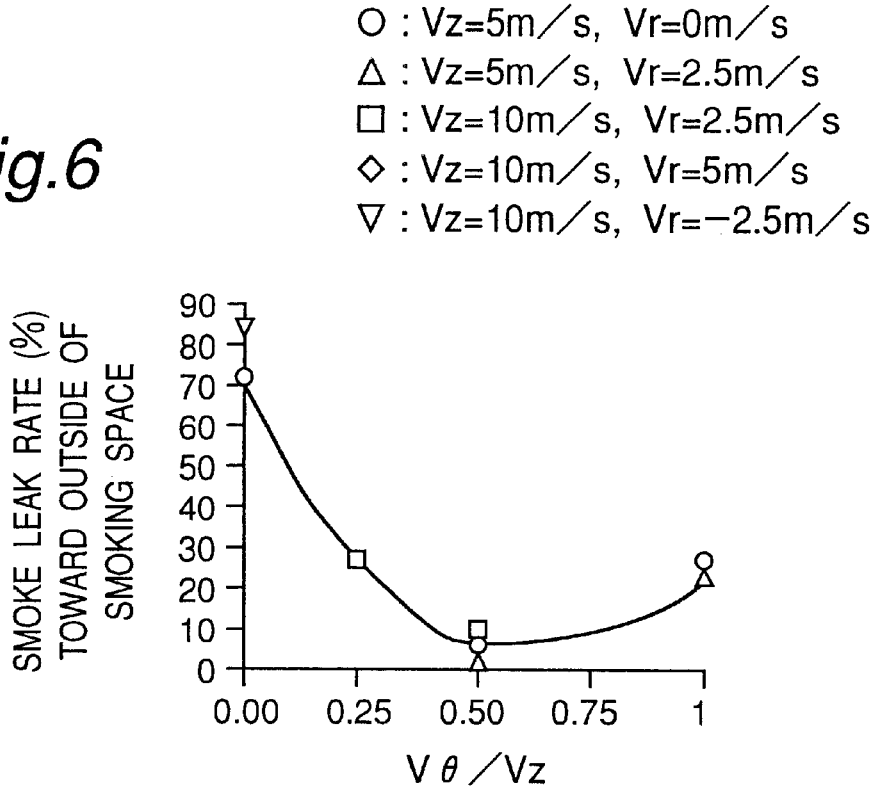
FIG. 6 is a graph of simulation measurement data showing a relation between a vertical velocity component Vz and a circumferential velocity component Vθ of the blowing air flow in the vector diagram of FIG. 5.

Under the air intake and blow conditions as shown in, for example, FIG. 4, a smoke generating source (dry ice) was placed at the center of a ventilation region (1.1-m square region) on the floor surface located vertically downside a specified distance (2.5 m) apart from the air intake grill 5, and a leak rate of the smoke to the outside of the ventilation region was measured by simulation with the values of Vz and Vr varied, for example, as shown in FIG. 6.

As a result, firstly as shown in the graph of FIG. 6, it was found that the smoke leak rate was minimized and the maximum ventilation efficiency was achieved when the ratio Vθ/Vz of Vθ to Vz was 0.50.

Figure 7:
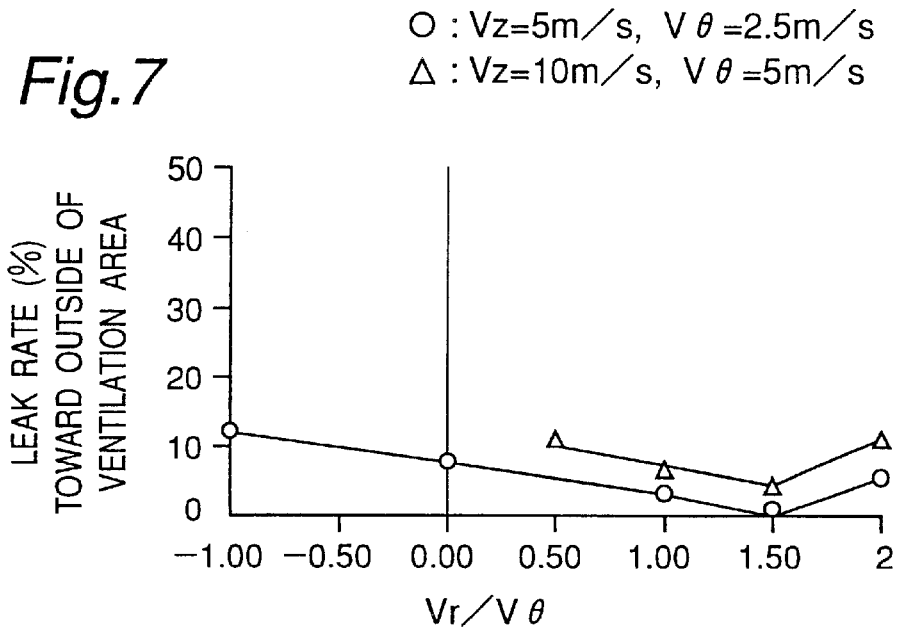
FIG. 7 is a graph of simulation measurement data showing a relation between a radial velocity component Vr and the circumferential velocity component Vθ of the blowing air flow in the vector diagram of FIG. 5.

A ratio Vr/Vθ of Vr to Vθ when the ratio Vθ/Vz was set to 0.50 and the smoke leak rate was not higher than 10% was satisfactory approximately within a range of 0 to 2, as shown in, for example, the graph of FIG. 7.

Figure 8:
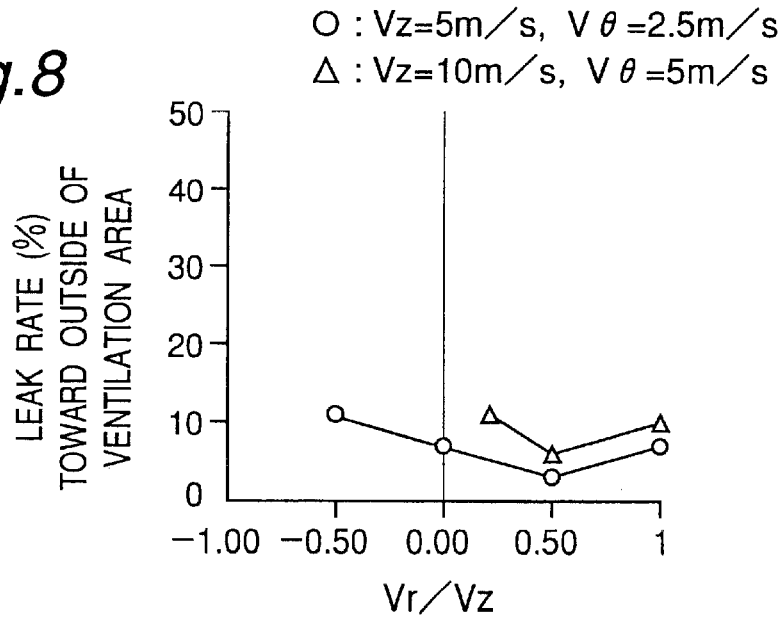
FIG. 8 is a graph of simulation measurement data showing a relation between the vertical velocity component Vz and the radial velocity component Vr of the blowing air flow in the vector diagram of FIG. 5.

With regard to a relation of Vz to Vr when the ratio Vθ/Vz was set to 0.50 was as shown in, for example, FIG. 8, and a ratio Vz/Vr of Vz to Vr when the smoke leak rate was not higher than 10% was satisfactory within a range of 0 to 1.

Figure 9:
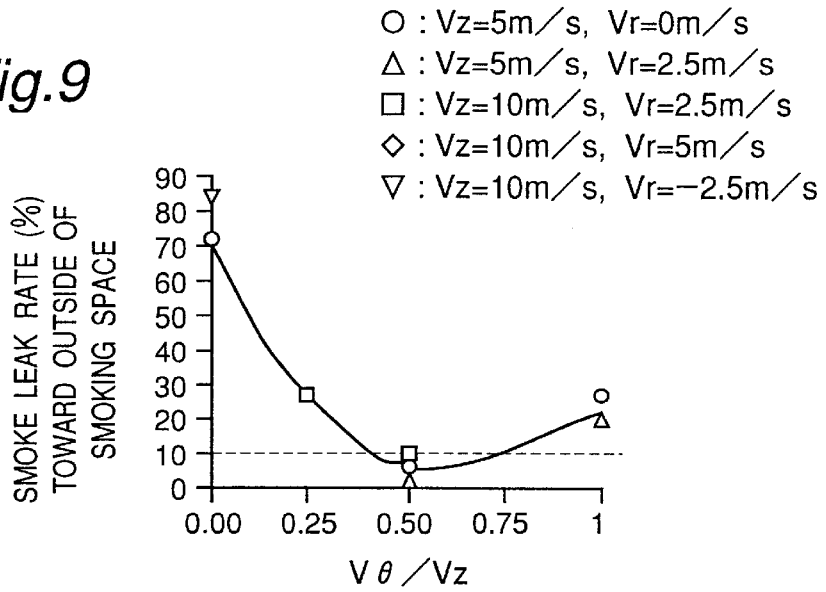
FIG. 9 is a graph of simulation measurement data showing a relation between Vz and Vθ when a smoke leak rate becomes equal to 10% or less in the vector diagram of FIG. 5.

A ratio Vθ/Vr when the smoke leak rate was not higher than 10% was as shown in, for example, FIG. 9, in which the ratio was satisfactory within a range of 0.4 ($\theta_3$=20°) to 0.75 ($\theta_3$≈27°).

Figure 10:
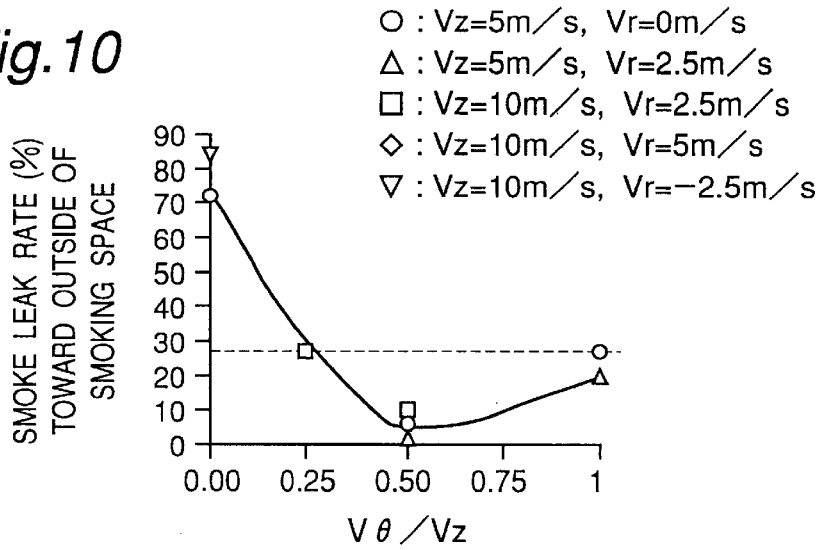
FIG. 10 is a graph of simulation measurement data showing a relation between Vz and Vθ when an intake vortex flow is formed in a stable state in the vector diagram of FIG. 5.

A ratio Vθ/Vz formed in a state in which the intake vortex flow is stably formed in the aforementioned conditions was as shown in, for example, FIG. 10, in which the ratio was satisfactory within a range of 0.25 ($\theta_3$=15°) to 1 ($\theta_3$≈45°).

Therefore, by setting the angle of inclination $\theta_1$ in the air blow direction of the air blowing port 9 and setting the turn angle $\theta_2$ of the vortex flow creating stators 14, 14, . . . so that Vz, Vr and Vθ shown in FIG. 5 come to have the aforementioned relations, an effective ventilation efficiency can be achieved.

Figure 12:
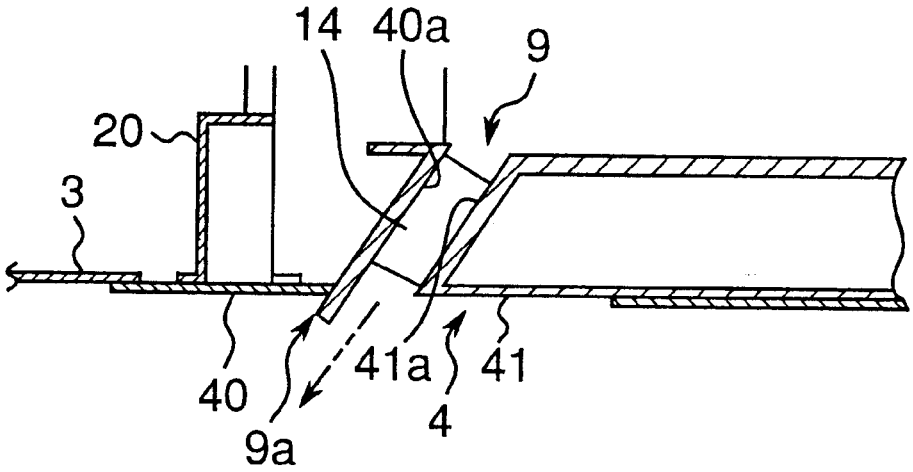
FIG. 12 is a sectional view showing a first modification example of the construction of the essential part of the air intake and blowing device of the first embodiment of the present invention.

First, FIG. 12 shows the construction of a first modification example obtained by improving the essential part of the air intake and blowing device of the first embodiment of the present invention.

Figure 11:
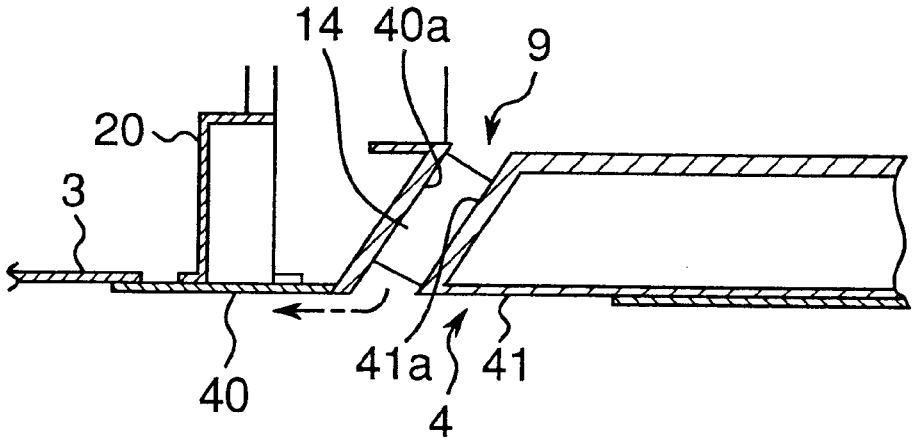
FIG. 11 is a sectional view showing the construction of the essential part of the air intake and blowing device of the first embodiment of the present invention.

According to the construction of the air blowing port 9 of the first embodiment, as shown in, for example, FIG. 11, the air blowing passage is formed while being inclined at a specified angle $\theta_1$ obliquely toward the outer periphery. Furthermore, air is blown with a vector in the direction of turn by the vortex flow creating stators 14, 14, . . . Therefore, the blown vortex air flow tends to adhere to the outer periphery of the air intake and blowing panel 4 located at the lower surface of the main casing 2 from the outer peripheral end portion of the air blowing port 9, and this leads to the problem that the flow is disturbed to hinder the creation of an effective blowing vortex air flow.

Therefore, according to the first modification example, as shown in, for example, FIG. 12, an air flow guide segment 9*a* is provided by extending by a specified length part of the air blowing side end portion of the circular opening inner peripheral surface 40*a* of the outer frame panel 40 of the air blowing port 9 in the air blow direction.

As a result, as indicated by arrow in FIG. 12, the air flow blown from the air blowing port 9 is prevented from adhering to the surface of the air intake and blowing panel 4 and smoothly blown, creating an effective blowing vortex air flow.

Figure 13:
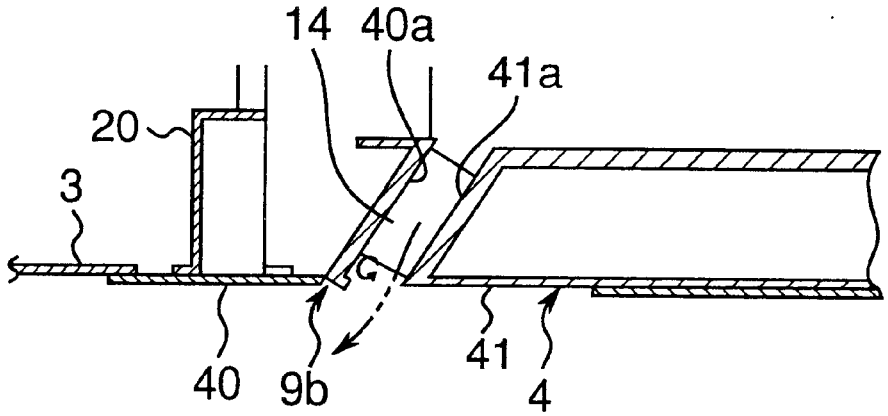
FIG. 13 is a sectional view showing a second modification example of the construction of the essential part of the air intake and blowing device of the first embodiment of the present invention.

Next, FIG. 13 shows the construction of a second modification example obtained by improving the essential part of the air intake and blowing device of the first embodiment of the present invention.

According to the construction of the air blowing port 9 of the first embodiment, the air blowing passage is inclined at a specified angle $\theta_1$ obliquely toward the outer periphery as shown in FIG. 11, and the air is blown with a vector in the direction of turn by the vortex flow creating stators 14, 14, . . . Therefore, the blown vortex air flow tends to adhere to the outer periphery of the air intake and blowing panel 4 located on the lower surface of the main casing 2 from the outer peripheral end portion of the air blowing port 9, and this leads to the problem that the flow is disturbed to hinder the creation of an effective blowing vortex air flow.

Therefore, according to the second modification example, as shown in, for example, FIG. 13, the air flow on the outer peripheral side is suppressed to the inner peripheral side by providing a protruding segment 9*b* on the air blowing side end portion of the circular opening inner peripheral surface 40*a* of the outer frame panel 40 of the air blowing port 9.

As a result, as indicated by arrow in FIG. 13, the air flow blown from the air blowing port 9 is prevented from adhering to the surface of the air intake and blowing panel 4 located on the lower surface side and smoothly blown, creating an effective blowing vortex air flow.

Figure 14:
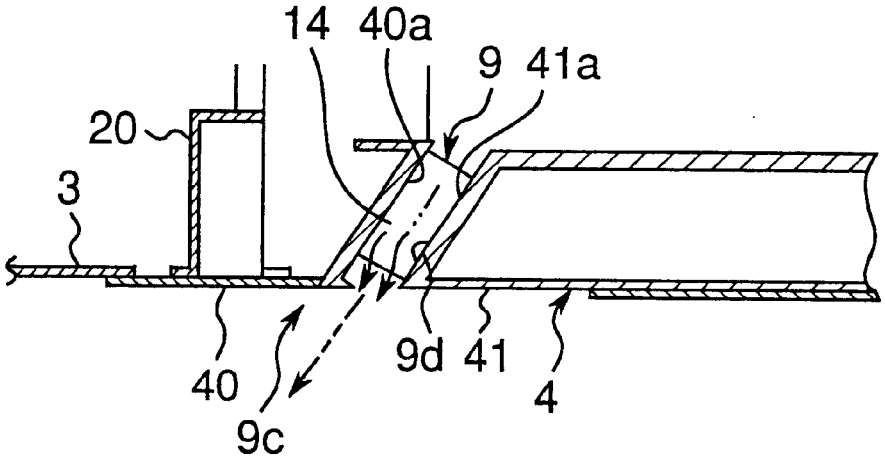
FIG. 14 is a sectional view showing a third modification example of the construction of the essential part of the air intake and blowing device of the first embodiment of the present invention.

Further, FIG. 14 shows the construction of a third modification example obtained by improving the essential part of the air intake and blowing device of the first embodiment of the present invention.

According to the construction of the air blowing port 9 of the first embodiment, the air blowing passage is inclined at a specified angle $\theta_1$ obliquely toward the outer periphery as shown in FIG. 11, and the air is blown with a vector in the direction of turn by the vortex flow creating stators 14, 14 . . . Therefore, the blown vortex air flow tends to adhere to the outer periphery of the air intake and blowing panel 4 located on the lower surface of the main casing 2 from the outer peripheral end portion of the air blowing port 9, and this leads to the problem that the flow is disturbed to hinder the creation of an effective blowing vortex air flow.

Therefore, according to the third modification example, as shown in, for example, FIG. 14, the blowing air flow is smoothly suppressed to the inner peripheral side by providing a sectionally triangular protrusion 9*c* in the air blowing side end portion of the circular opening inner peripheral surface 40*a* of the outer frame panel 40 of the air blowing port 9 and a semi-streamline-shaped protrusion 9*d* on the outer peripheral surface 41*a* of the inner frame panel 41 for the narrowing of the air flow and an increase in flow rate.

As a result, as indicated by arrow in FIG. 14, the air flow blown from the air blowing port 9 is prevented from adhering to the surface of the air intake and blowing panel 4 and smoothly blown, forming an effective blowing vortex air flow.

Second Embodiment

Figure 15:
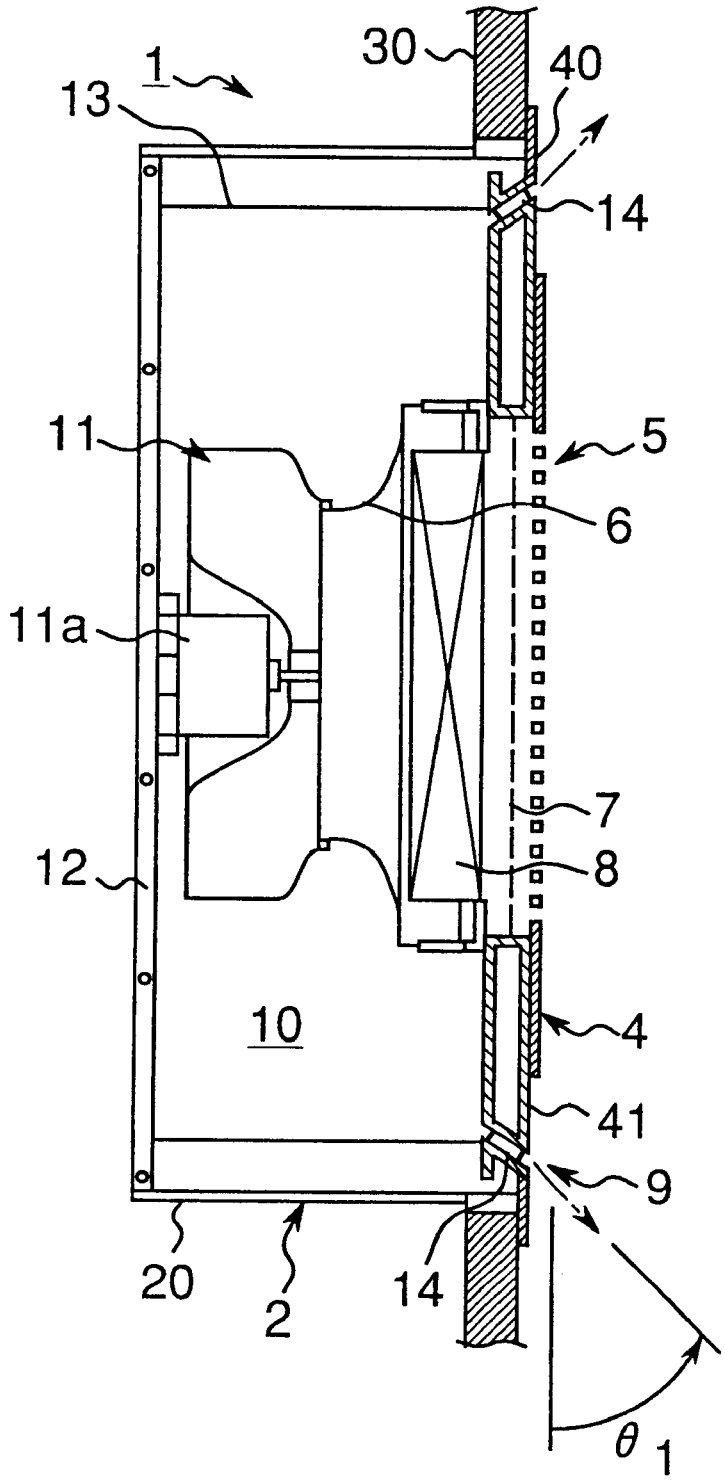
FIG. 15 is a sectional view showing the construction of an air intake and blowing device according to a second embodiment of the present invention.

Next, FIG. 15 shows the construction of an air intake and blowing device according to the second embodiment of the present invention.

This embodiment is characterized in that air in a specified spot region in the space beside a wall 30 can be purified by embedding an air intake and blowing device having a construction identical to that of the first embodiment constituting the air purifier 1 in the wall 30 of a room so that the air intake and blowing panel 4 is flush with the wall surface in an approximate identical plane, as shown in FIG. 15.

Third Embodiment

Figure 16:
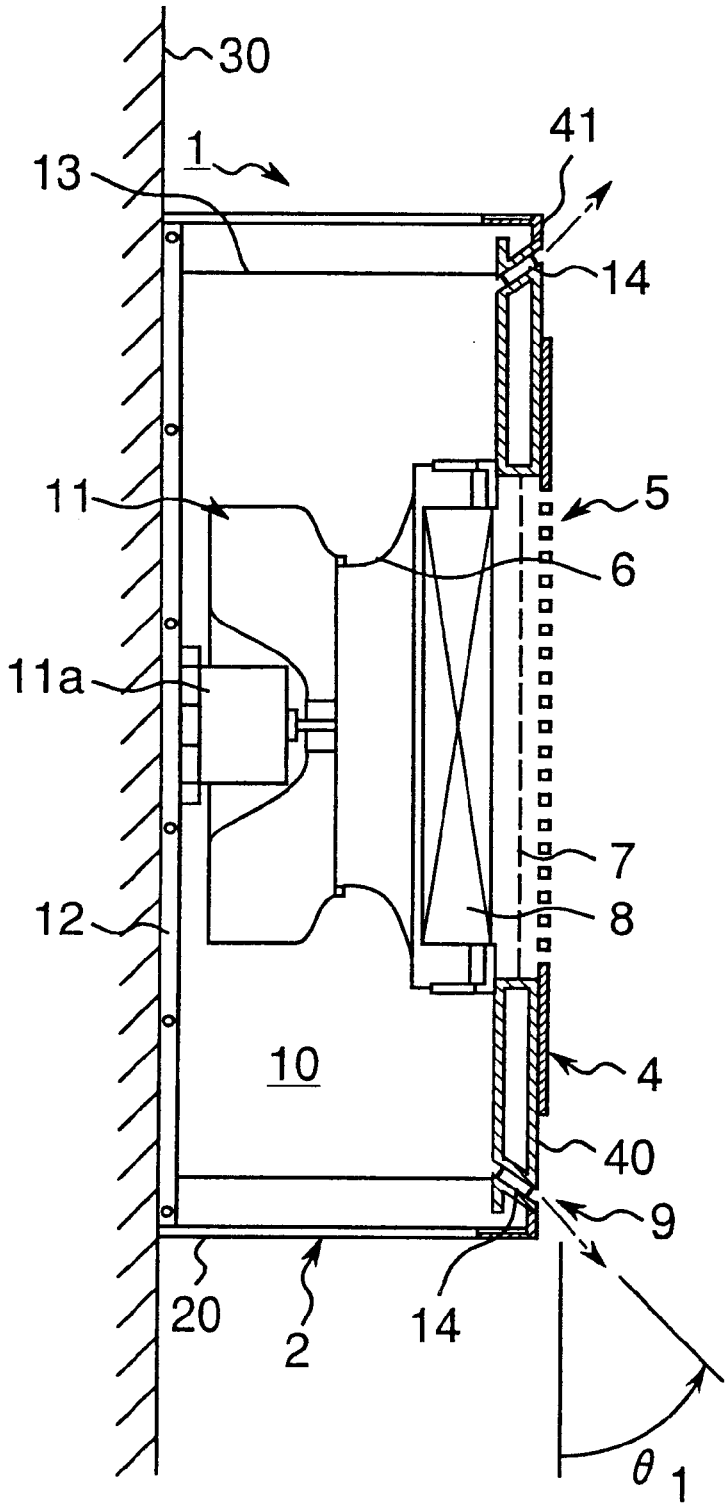
FIG. 16 is a sectional view showing the construction of an air intake and blowing device according to a third embodiment of the present invention.

FIG. 16 shows the construction of an air intake and blowing device according to the third embodiment of the present invention.

This embodiment is characterized in that air in a specified spot region in the space beside a wall 30 can be purified similarly to the device of the second embodiment by hanging an air intake and blowing device having a construction identical to that of the first embodiment constituting the air purifier 1 on the wall 30 of a room, as shown in FIG. 16.

Fourth Embodiment

Figure 17:
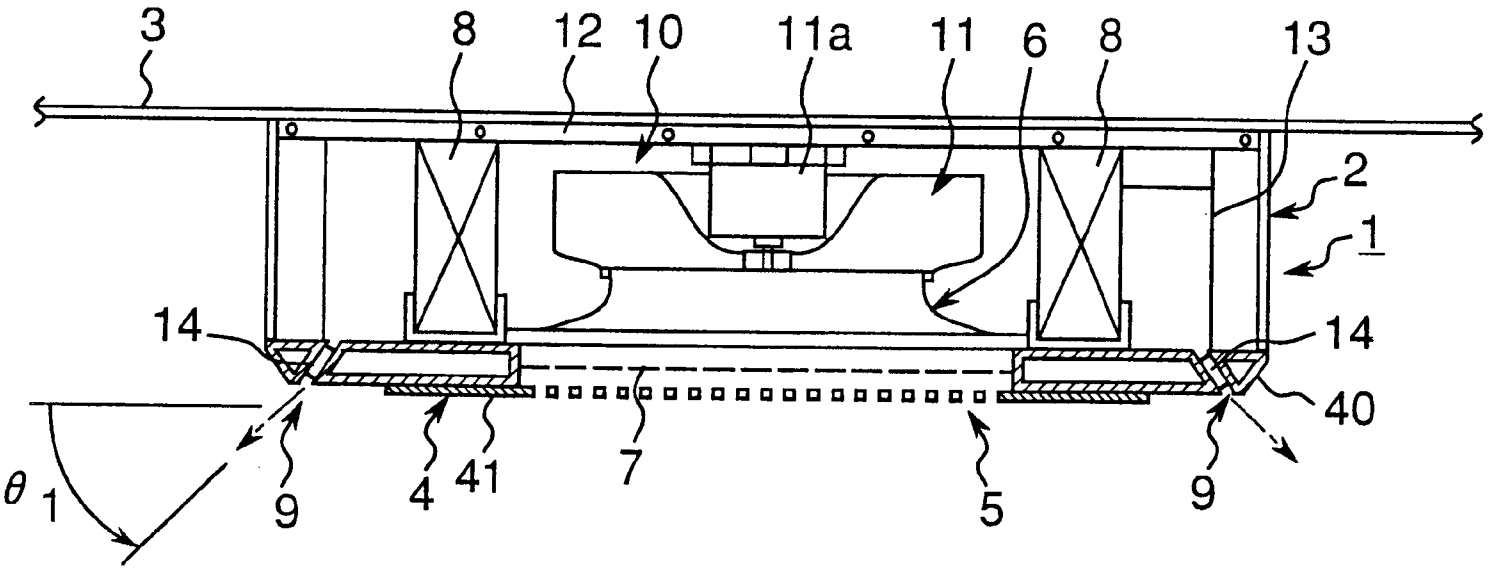
FIG. 17 is a sectional view showing the construction of an air intake and blowing device according to a fourth embodiment of the present invention.

Next, FIG. 17 shows the construction of an air intake and blowing device according to the fourth embodiment of the present invention.

The air intake and blowing device of this embodiment is characterized in that the air purifying element 8 of the air intake and blowing device of the first embodiment constructed as the air purifier 1 is arranged in an annular structure around the turbo fan 11. The other construction is identical to that of the first embodiment.

Also with this construction, if the turbo fan 11 is driven, then air in the specified spot region below the air intake grill 5 is sucked from the air intake grill 5 quite similarly to the air purifier 1 of the first embodiment. After large dust particles are removed via the pre-filter 7, air is blown toward the air purifying element 8 provided around the fan.

Next, the blowing air is purified through the air purifying element 8 and blown in the form of a spiral vortex air flow from the air blowing port 9 by the operation of the vortex flow creating stators 14, 14, . . .

Then, the spiral vortex air flow blown from the air blowing port 9 forms an intake air vortex flow rising up in a tornado form accompanied by a great sucking force inwardly in the center axis direction from the floor surface to the air intake grill 5.

As a result, the air in the specified spot region on the floor surface side is surely interrupted by the blowing vortex air flow in an air curtain shape provided outside, by which the air is effectively sucked from the air intake grill 5 toward the air purifying element 8 without leaking to the outside, improving the air purifying efficiency.

Fifth Embodiment

Figure 18:
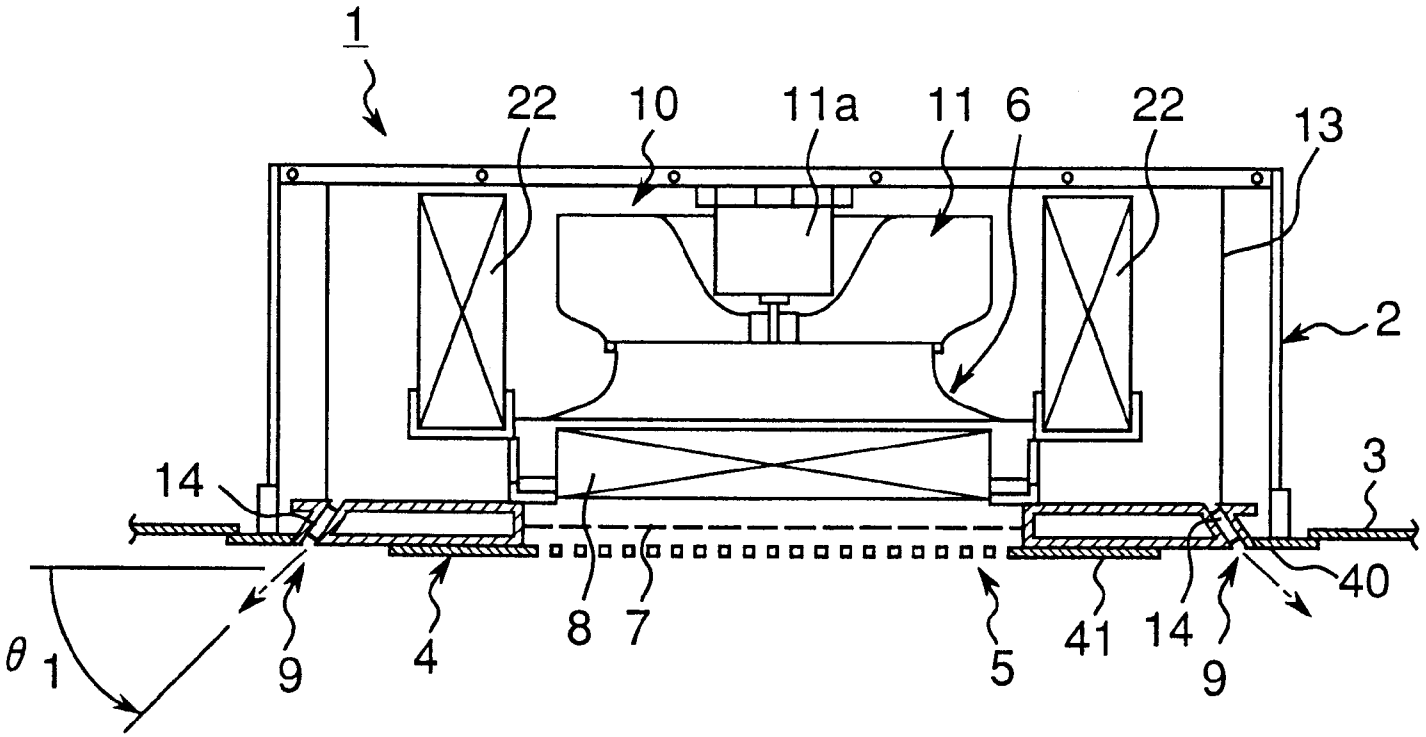
FIG. 18 is a sectional view showing the construction of an air intake and blowing device according to a fifth embodiment of the present invention.

Next, FIG. 18 shows the construction of an air intake and blowing device according to a fifth embodiment of the present invention.

The air intake and blowing device of this embodiment is characterized in that an air heat exchanger 22 having an annular structure is provided around the turbo fan 11 in the air intake and blowing device of the first embodiment constructed as an air purifier 1, constituting an air conditioner for cooling and heating use. The other construction is identical to that of the first embodiment.

According to the above construction, if the turbo fan 11 is driven, then air in the specified spot region below the air intake grill 5 is sucked from the air intake grill 5 similarly to the air purifier 1 of the first embodiment. Large dust particles are removed via the pre-filter 7 and air is further purified via the air purifying element 8 and thereafter blown toward the air heat exchanger 22 provided around it.

Next, the blowing air is subjected to heat exchange through the air heat exchanger 22 and blown in the form of a spiral vortex air flow from the air blowing port 9 toward the floor surface by the operation of the stators 14, 14, . . .

Then, a spiral vortex air flow blown from the air blowing port 9 forms an intake air vortex flow rising in a tornado form accompanied by a great sucking force inwardly in the center axis direction from the floor surface to the air intake grill 5.

As a result, the air in the specified spot region on the floor surface side is surely interrupted by the blowing vortex air flow in an air curtain shape provided outside, by which the air is effectively sucked from the air intake grill 5 toward the air purifying element 8 and the air heat exchanger 22 without leaking to the outside, improving the air conditioning (cooling and heating) efficiency together with the air purifying efficiency.

Sixth Embodiment

FIG. 19 through FIG. 23 show the construction, operation and effect of an air intake and blowing device according to the sixth embodiment of the present invention, applied to a ceiling embedded type air purifier similar to, for example, the device of the first embodiment.

Figure 19:
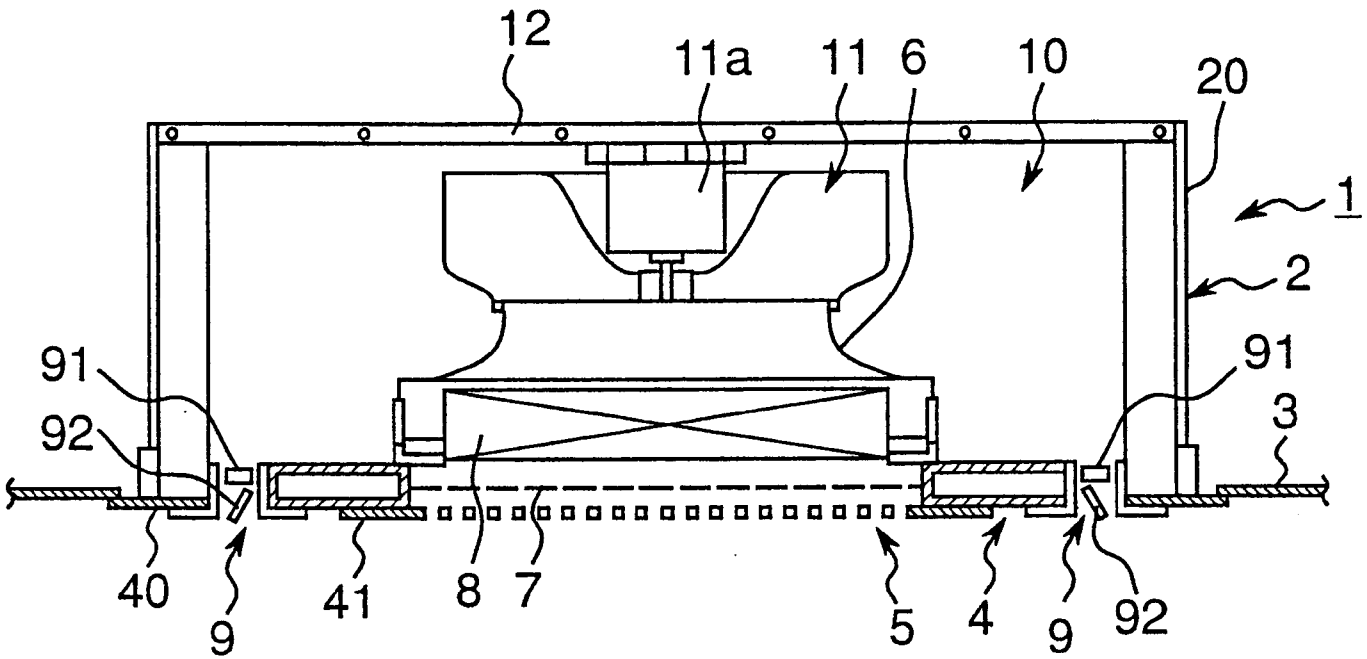
FIG. 19 is a sectional view (B—B of FIG. 20) showing the construction of an air intake and blowing device according to a sixth embodiment of the present invention.

In the figures, the reference numeral 2 first denotes a cassette type main casing of the ceiling embedded type air purifier 1. The main casing 2 is constructed so that its air intake and blowing panel 4 located on one surface side is constructed of one panel that can be detached from the main casing 2 and is embedded in the ceiling 3 so as to be roughly flush with the ceiling 3 of a room in an approximate identical plane, as shown in FIG. 19.

Figure 20:
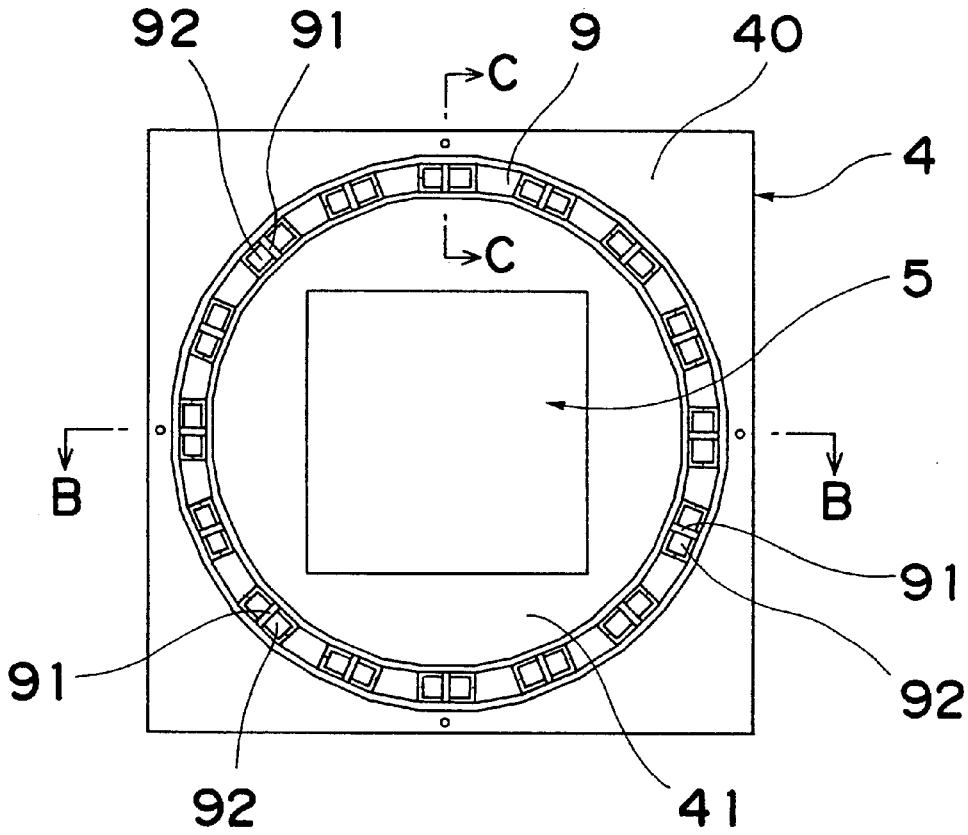
FIG. 20 is a plan view of the essential part of the air intake and blowing device of the sixth embodiment of the present invention.
Figure 21:
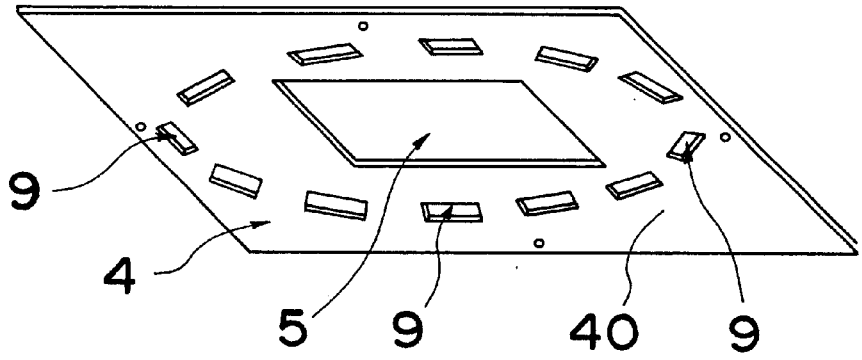
FIG. 21 is a perspective bottom view of the essential part of the air intake and blowing device of the sixth embodiment of the present invention.

Then, the air intake and blowing panel 4 of the main casing 2 is provided with a square air intake grill 5 located in the center portion, as shown in, for example, FIG. 20 and FIG. 21 and is further provided adjacently with a bellmouth 6 for air intake use located inside (on the upper side) thereof. Then, a pre-filter 7 and an air purifying element 8 are arranged adjacently in this order from the air flow upstream side to the downstream side between them.

Around the air intake grill 5 of the air intake and blowing panel 4 of the main casing 2 is provided a plurality of slit-shaped air blowing ports 9, 9, . . . having a specified width and a specified length arranged at specified intervals in the circumferential direction, as shown in, for example, FIG. 21.

Then, with the above construction, an air passage 10 is formed throughout the entire circumference extending from the air intake grill 5 via the pre-filter 7, the air purifying element 8 and the bellmouth 6 to the air blowing port 9. The turbo fan 11 that is positioned at the center behind (in the upper portion in the figure) the air purifying element 8 of the air passage 10 and has its air intake side (shroud side) corresponding to the bellmouth 6 is hung on the ceiling panel 12 of the main casing 2 via a fan motor 11*a*.

A scroll 13 directed to the air blowing port 9 is provided in a state in which it encloses the turbo fan 11 inside the main casing 2.

Figure 22:
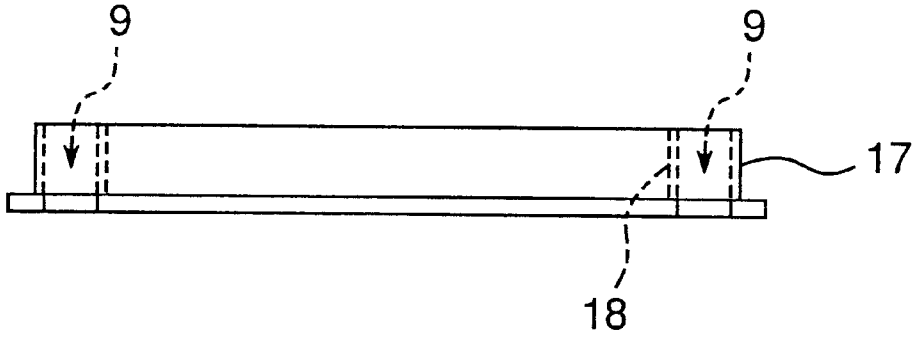
FIG. 22 is a side view of the essential part of the air intake and blowing device of the sixth embodiment of the present invention.
Figure 23:
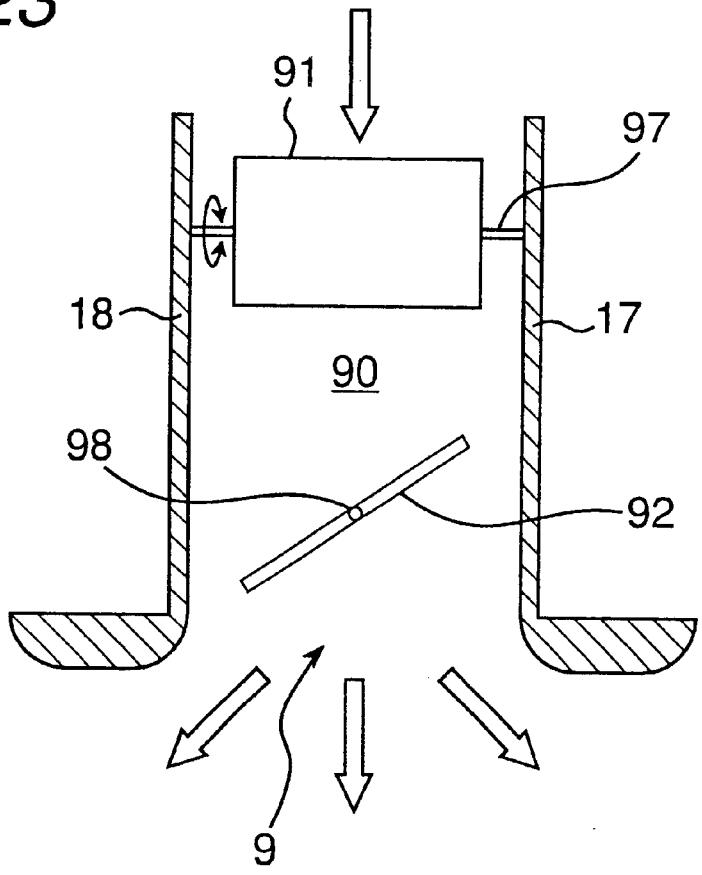
FIG. 23 is a sectional view (C—C of FIG. 20) of the essential part of the air intake and blowing device of the sixth embodiment of the present invention.

As shown in, for example, FIG. 22 and FIG. 23, an air blowing passage 90 is formed in an upper portion of the air blowing ports 9 by engaging an outer peripheral radial first sleeve 17 with an outer peripheral radial second sleeve 18 at specified intervals. In the air blowing passage 90, first vortex flow creating stators 91, 91, . . . and second vortex flow creating stators 92, 92, . . . for generating a vortex swirl flow in the spiral direction are provided perpendicular to each other correspondingly in the vertical direction in correspondence with the scroll 13.

The first vortex flow creating stators 91, 91, . . . are pivotally supported so that the turn angle $\theta_2$ of the blowing air can be set by shafts 97, 97, . . . perpendicular to the lengthwise direction of the air blowing passage 90 and adjacently arranged at specified regular intervals in the lengthwise direction of the air blowing passage 90.

On the other hand, the second vortex flow creating stators 92, 92, . . . are pivotally supported so that the blowing air flare angle (air blow angle) $\theta_1$ can be set by a shaft 98 extending in the lengthwise direction of the air blowing passage 90 and adjacently arranged at specified regular intervals in the lengthwise direction of the air blowing passage 90.

As described above, according to the air intake and blowing device of the present embodiment, in the ceiling embedded cassette type air purifier, by providing the square air intake grill 5 at the center of the air intake and blowing panel 4 located on the lower surface side of the cassette type main casing 2, providing the plurality of slit-shaped air blowing port 9 arranged totally annularly around the air intake grill 5, forming the circulation type air passage 10 that extends from the air intake grill 5 to the air blowing port 9 and providing the turbo fan 11 partway in the air passage 10, air sucked from the air intake grill 5 is purified via the pre-filter 7 and the air purifying element 8 and thereafter blown from the air blowing port 9 toward the downside floor surface of the room.

Then, the air blowing passage 90 for air blowing use is formed in the upper portion of the air blowing ports 9, 9, . . . of the main casing 2 that forms the air passage 10. In the air blowing passage 90, the plurality of first vortex flow creating stators 91, 91, . . . for giving a vector in the direction of turn to the air flow blown from the air blowing ports 9 and the plurality of second vortex flow creating stators 92, 92, . . . for adjusting the flare angle (air blow angle) $\theta_1$ by expanding the spiral vortex air flow created by the first vortex flow creating stators 91, 91, . . . outwardly of the periphery and reducing the angle inwardly of the periphery are provided at specified intervals in the circumferential direction.

Therefore, if the turbo fan 11 is driven, then the room air in the specified spot region located on the floor surface side below the air intake grill 5 is sucked from the air intake grill 5, purified through the pre-filter 7 and the air purifying element 8 and thereafter blown outwardly of the periphery by the turbo fan 11. A vector in the direction of turn is first given from the scroll 13 to the air flow by the first vortex flow creating stators 91, 91, . . . in the first stage. Subsequently, a vector in the expansion direction from the air blowing ports 9 is given to the air flow by the second vortex flow creating stators 92, 92, . . . and blown as a spiral blowing vortex air flow of the desired flare angle toward the downside floor surface in the second stage.

As a result, by the spiral blowing vortex air flow, a tornado-shaped intake air vortex flow having a great sucking force rising up due to the sucking force of the turbo fan 11 in the opposite direction is formed inwardly in the center axis direction.

Then, this enables the reliable purification of air in the specified spot region surrounded by the spiral blowing vortex air flow of the desired flare angle.

In particular, according to the aforementioned construction, the first and second vortex flow creating stators 91, 91, . . . and 92, 92, . . . are not fixed but allowed to be adjusted to an arbitrary angle of inclination. Therefore, the turn angle and the flare angle can be arbitrarily adjusted and set to a flare angle corresponding to the broadness of the spot region.

As a result, according to the aforementioned air intake and blowing device, there can be obtained the advantageous effects as follows.

(1) Air intake and blowing can be achieved in a circulating state from an air intake port in an identical plane toward the air blowing port by one air blowing fan, and this requires no such duct device as in the conventional air supply and discharge system and enables the compacting.

(2) A stable air-curtain-shaped blowing vortex air flow and an intake air vortex flow inwardly in the center axis direction can be formed without receiving any external disturbance. Therefore, air in the specified spot region can be reliably ventilated without being leaked to the outside.

(3) The air intake and blowing panel provided with the vortex flow creating stators located at the air intake port and the air blowing port can be mounted on the main casing, and therefore, the vortex flow creating stators can be freely mounted and removed.

Therefore, by merely mounting the air intake and blowing panel having the aforementioned construction on the main casing of the normal air purifier or air conditioner, the aforementioned air intake and blowing functions can be added.

(4) As a result, a compact air intake and blowing device of high ventilating function suitable for a spot type air purifier, air conditioner and the like can be provided.

Seventh Embodiment

FIG. 24 through FIG. 28 show the construction, operation and effect of an air intake and blowing device according to a seventh embodiment of the present invention appropriate for a ceiling embedded type air purifier similar to that of, for example, the aforementioned first embodiment.

Figure 24:
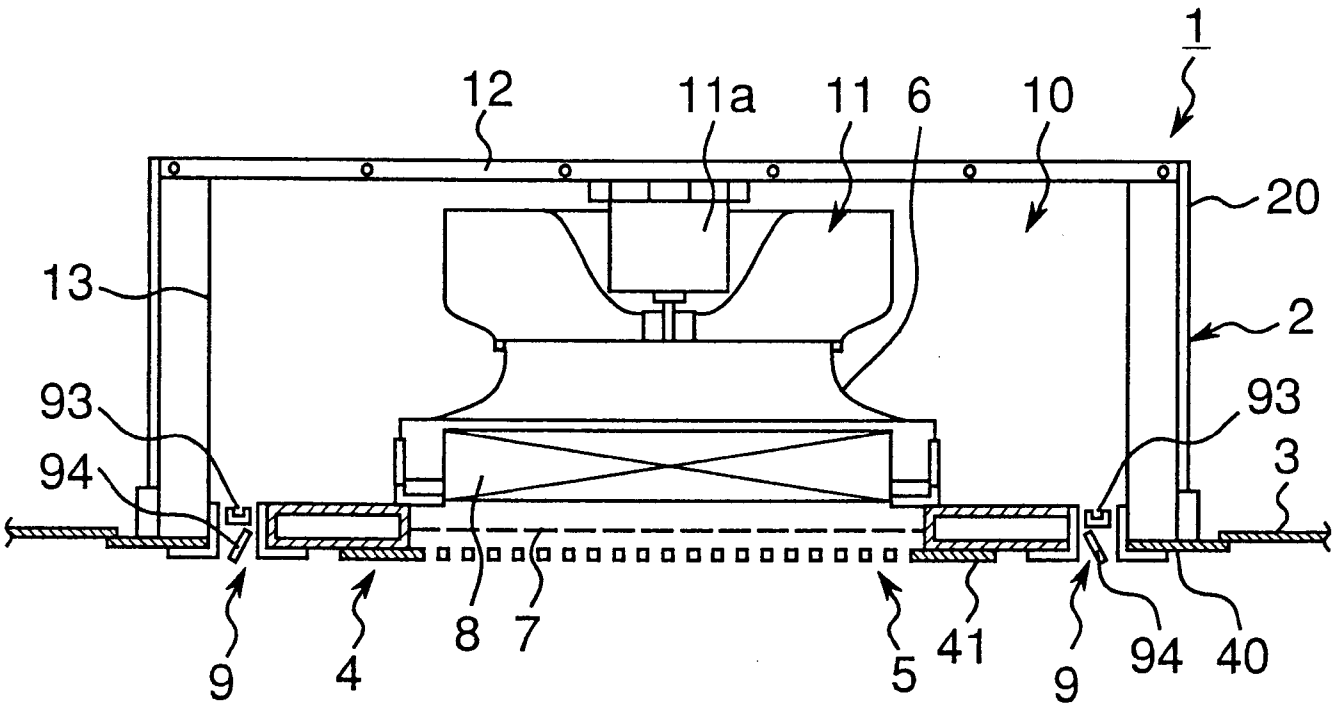
FIG. 24 is a sectional view (D—D of FIG. 25) showing the construction of an air intake and blowing device according to a seventh embodiment of the present invention.

In the figures, the reference numeral 2 first denotes a cassette type main casing of the ceiling embedded type air purifier 1. The main casing 2 is constructed so that its air intake and blowing panel 4 located on one surface side is constructed of one panel as shown in FIG. 26 and is embedded in the ceiling 3 so as to be roughly flush with the ceiling 3 of a room in an approximate identical plane, as shown in FIG. 24.

Figure 25:
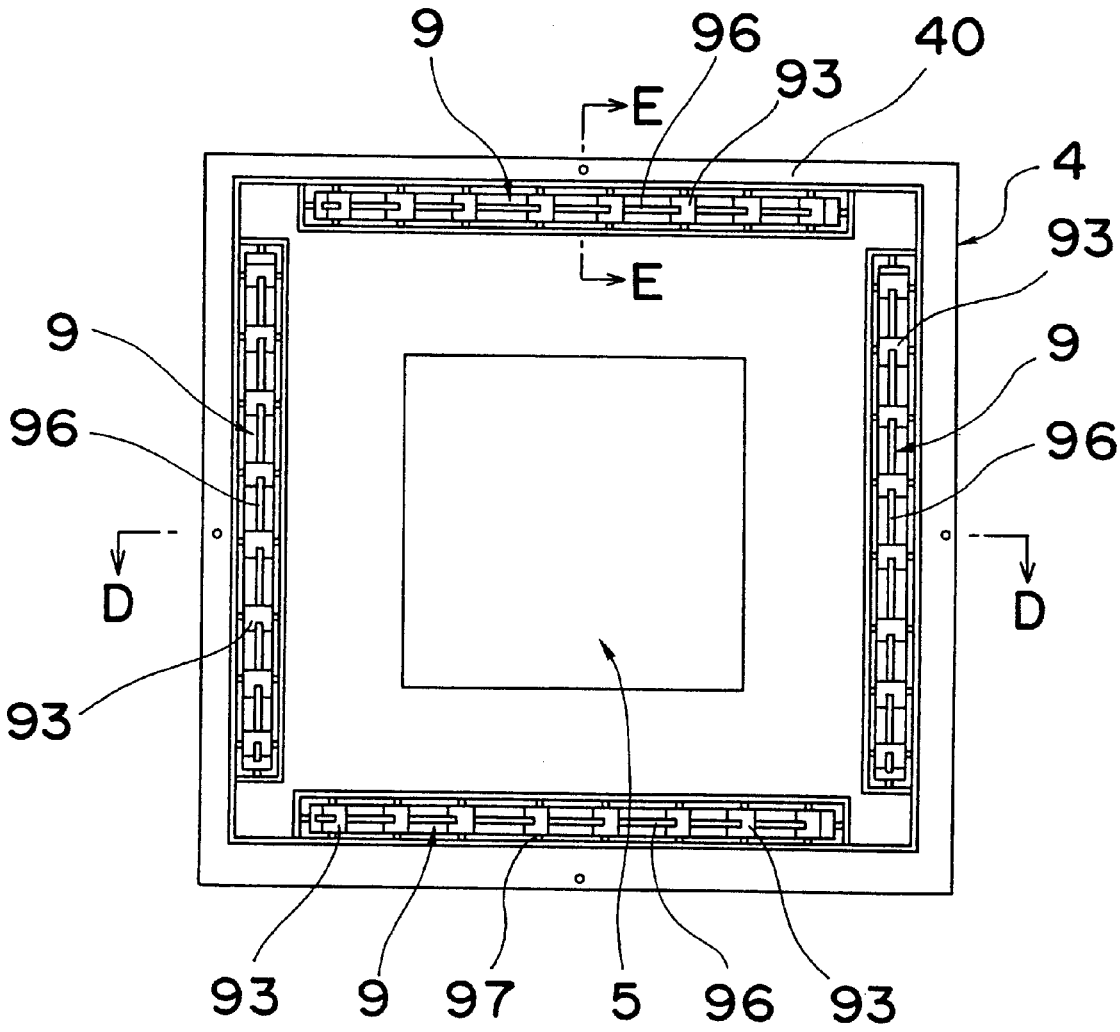
FIG. 25 is a plan view of the essential part of the air intake and blowing device of the seventh embodiment of the present invention.
Figure 26:
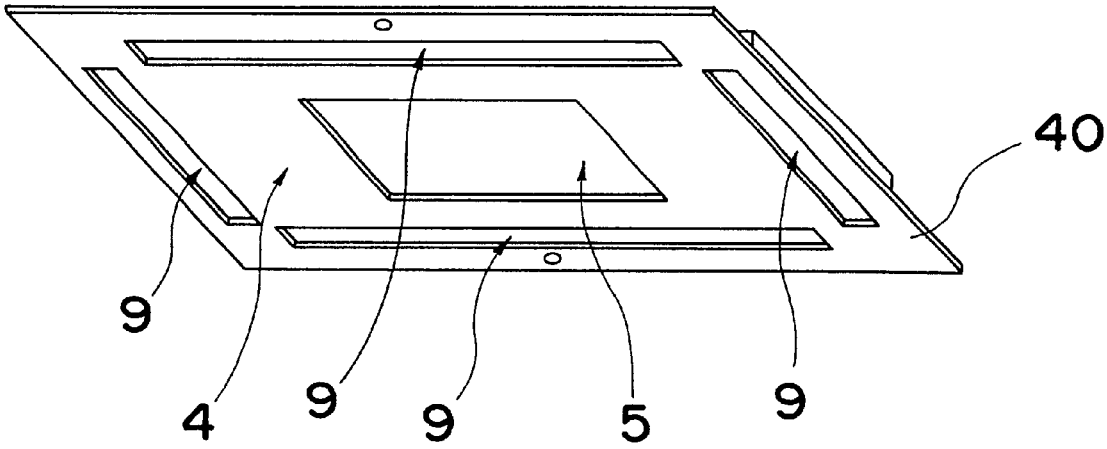
FIG. 26 is a perspective bottom view of the essential part of the air intake and blowing device of the seventh embodiment of the present invention.

Then, the air intake and blowing panel 4 of the main casing 2 is provided with a square air intake grill 5 located in the center portion, as shown in, for example, FIG. 25 and FIG. 26 and is further provided adjacently with a bellmouth 6 for air intake use of the turbo fan 11 inside (on the upper side) thereof. Then, a pre-filter 7 and an air purifying element 8 are arranged adjacently in this order from the air flow upstream side to the downstream side between them.

Around the air intake grill 5 of the air intake and blowing panel 4 of the main casing 2 is provided a plurality of slit-shaped air blowing ports 9, 9, . . . having a specified width and a specified length arranged at specified intervals in four vertical and horizontal positions, as shown in, for example, FIG. 26.

Then, with the above construction, an air passage 10 is formed throughout the entire circumference extending from the air intake grill 5 via the pre-filter 7, the air purifying element 8 and the bellmouth 6 to the air blowing port 9. The turbo fan 11 that is positioned at the center behind (in the upper portion in the figure) the air purifying element 8 of the air passage 10 and has its air intake side (shroud side) corresponding to the bellmouth 6 is hung on the ceiling panel 12 of the main casing 2 via a fan motor 11*a*.

A scroll 13 directed to the air blowing port 9 is provided in a state in which it encloses the turbo fan 11 inside the main casing 2.

Figure 27:
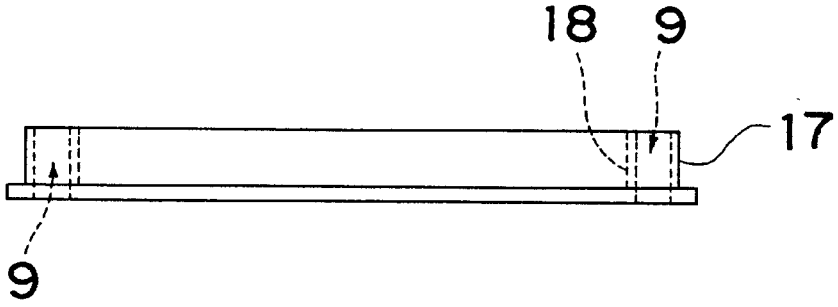
FIG. 27 is a side view of the essential part of the air intake and blowing device of the seventh embodiment of the present invention.
Figure 28:
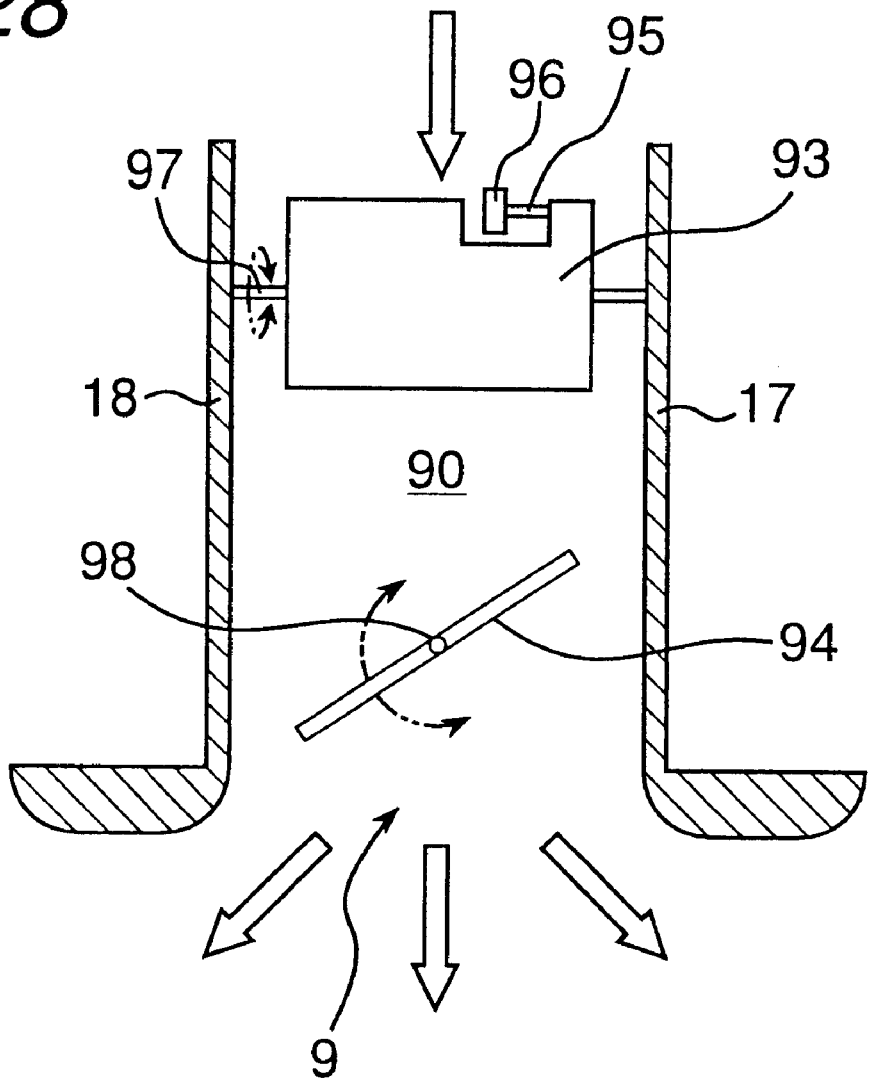
FIG. 28 is a sectional view (E—E of FIG. 25) of the essential part of the air intake and blowing device of the seventh embodiment of the present invention.

As shown in, for example, FIG. 27 and FIG. 28, air blowing passages 90, 90, . . . are formed in upper portions of the air blowing ports 9, 9, . . . by engaging a rectangular pipe shaped radially outer peripheral first sleeve 17 with a rectangular pipe shaped radially inner peripheral second sleeve 18 at specified intervals. In the air blowing passage 90, first vortex flow creating stators 93, 93, . . . and second vortex flow creating stators 94, 94, . . . for creating a vortex flow in the spiral direction are pivotally supported perpendicular to each other oppositely in the vertical direction in correspondence with the scroll 13.

The first vortex flow creating stators 93, 93, . . . are pivotally supported so that the turn angle $\theta_2$ of the blowing air can be set by shafts 97, 97, . . . perpendicular to the lengthwise direction of the air blowing passages 90, 90, . . . and adjacently arranged at specified regular intervals in the lengthwise direction of the air blowing passages 90, 90, . . .

By operating a connecting rod 96 connected relatively pivotally in an upper portion via shafts 95, 95, . . . , the angle of inclination $\theta_2$ in the direction of turn of the plurality of first vortex flow creating stators 93, 93, . . . of the air blowing passages 90, 90, . . . are commonly changed.

On the other hand, the second vortex flow creating stators 94, 94, . . . are pivotally supported so that the blowing air flare angle (air blow angle) $\theta_1$ can be set by shafts 98, 98, . . . extending in the lengthwise direction of the air blowing passages 90, 90, . . . and adjacently arranged at specified regular intervals in the lengthwise direction of the air blowing passages 90, 90, . . .

As described above, according to the air intake and blowing device of the present embodiment, in a ceiling embedded type cassette type air purifier, by providing the square air intake grill 5 at the center of the air intake and blowing panel 4 located on the lower surface side of the cassette type main casing 2, providing the plurality of slit-shaped air blowing ports 9, 9, . . . arranged in four vertical and horizontal positions around the air intake grill 5, forming the circulation type air passage 10 that extends from the air intake grill 5 to the air blowing ports 9, 9, . . . and providing the turbo fan 11 at the center of the air passage 10, air sucked from the air intake grill 5 is purified via the pre-filter 7 and the air purifying element 8 and thereafter blown from the air blowing ports 9, 9, . . . toward the downside floor surface of the room.

Then, the air blowing passages 90, 90, . . . are formed in the upper portions of the air blowing ports 9, 9, . . . of the main casing 2 that forms the air passage 10. In the air blowing passages 90, 90, . . . , the plurality of first vortex flow creating stators 93, 93, . . . for giving a vector in the direction of turn to the air flow blown from the air blowing ports 9, 9, . . . and the plurality of second vortex flow creating stators 94, 94, . . . for adjusting the flare angle by expanding the vortex air flow created by the first vortex flow creating stators 93, 93, . . . outwardly of the periphery and reducing the angle inwardly of the periphery are provided at specified intervals in the air passage direction.

Therefore, if the turbo fan 11 is driven, then the room air in the specified spot region located on the floor surface side below the air intake grill 5 is sucked from the air intake grill 5, purified through the pre-filter 7 and the air purifying element 8 and thereafter blown outwardly of the periphery by the turbo fan 11. A vector in the direction of turn is first given from the scroll 13 to the air flow by the first vortex flow creating stators 93, 93, . . . in the first stage. Subsequently, a vector in the expansion direction or in the contraction direction from the air blowing ports 9 is given to the air flow by the second vortex flow creating stators 94, 94, . . . and blown as a spiral blowing vortex air flow of the desired flare angle toward the downside floor surface in the second stage.

As a result, by the spiral blowing vortex air flow, a tornado-shaped intake air vortex flow having a great sucking force rising up due to the sucking force of the turbo fan 11 in the opposite direction is formed inwardly in the center axis direction.

Then, this enables the reliable purification of air in the specified spot region surrounded by the spiral blowing vortex air flow of the desired flare angle.

In particular, according to the aforementioned construction, the first and second vortex flow creating stators 93, 93, . . . and 94, 94, . . . are not fixed but allowed to be adjusted to an arbitrary angle of inclination by the common operation of the connecting rod 96. Therefore, the turn angle $\theta_2$ and the flare angle $\theta_1$ in the air blow direction are able to be desirably adjusted and to freely cope with an appropriate air blow condition corresponding to the installation conditions of the air purifier or air conditioner. The flare angle can be set to an arbitrary angle corresponding to the broadness of the spot region.

As a result, according to the aforementioned air intake and blowing device, there can be obtained the advantageous effects as follows.

(1) Air intake and blowing can be achieved in a circulating state from an air intake port in an identical plane toward the air blowing port by one air blowing fan, and this requires no such duct device as in the conventional air supply and discharge system and enables the compacting.

(2) A stable air-curtain-shaped blowing vortex air flow and an intake air vortex flow inwardly in the center axis direction can be formed without receiving any external disturbance. Therefore, air in the specified spot region can be reliably ventilated without being leaked to the outside.

(3) By virtue of the provision of the air blowing ports and the vortex flow creating stators for the air intake and blowing panel, the vortex flow creating stators can be freely mounted and removed.

Therefore, by merely mounting the air intake and blowing panel having the aforementioned construction on the main casing of the normal air purifier or air conditioner, the aforementioned air intake and blowing functions can be added.

(4) As a result, a compact air intake and blowing device of high ventilating function suitable for a spot type air purifier, air conditioner and the like can be provided.

Although the turbo fan 11 is adopted as an air blowing fan in each of the aforementioned embodiments, this can be changed to, for example, an axial flow fan or a mixed flow fan by devising the construction of the air passage 10.

Eighth Embodiment

Figure 29:
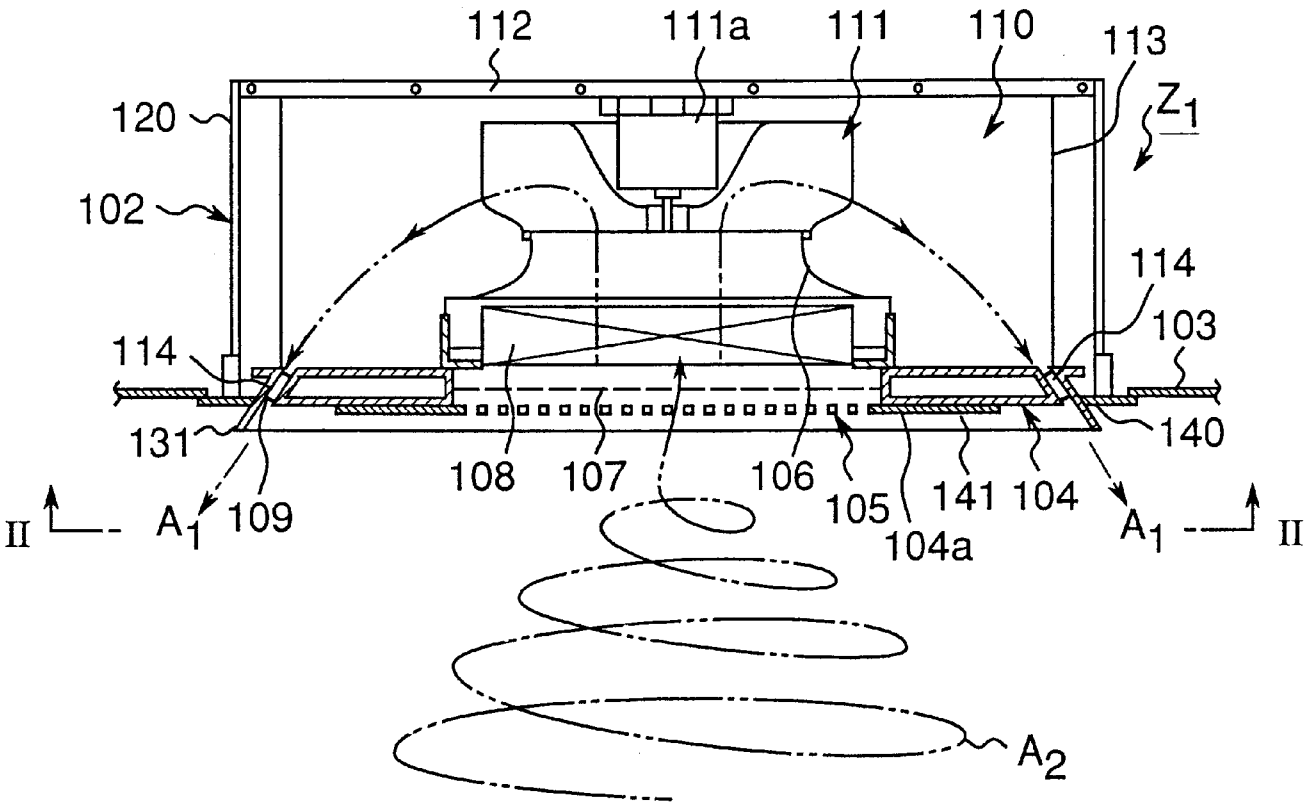
FIG. 29 is a sectional view of an air purifier of an eighth embodiment of the air intake and blowing device of the present invention.

FIG. 29 shows a ceiling embedded type air purifier $Z_1$ according to the eighth embodiment of the air intake and blowing device of the present invention, and the reference numeral 2 denotes a main casing in the figure.

This main casing 102 is constructed by integrally mounting a ceiling panel 112 on the upper surface of a box-shaped frame 120 whose upper and lower ends are both opened and detachably mounting a panel member described below on the lower surface and is embedded in a ceiling 103 in a manner that the panel member located at the lower end is roughly flush with the ceiling 103 in an approximate identical plane.

Figure 30:
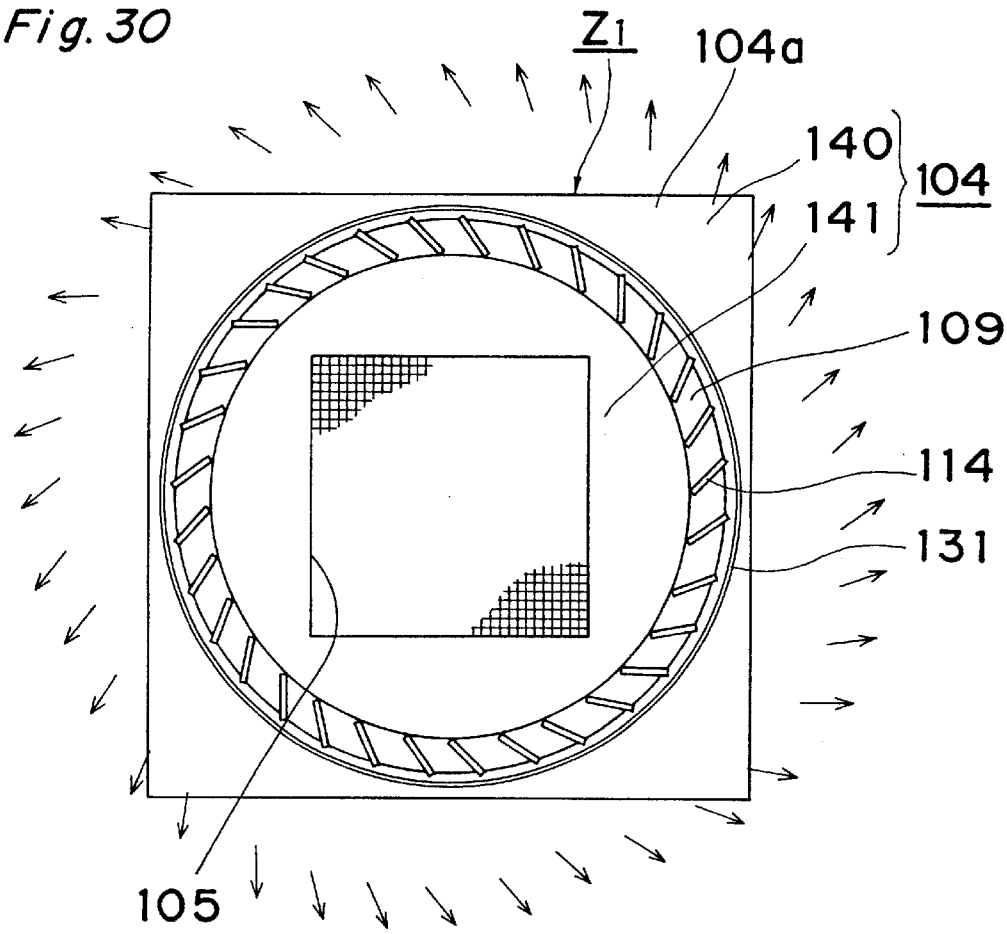
FIG. 30 is a scale-down view taken along the arrow line II—II of FIG. 29.

As shown in FIG. 29 and FIG. 30, the panel member is provided with a square air intake port 105 in the center portion. Then, a bellmouth 106 for a turbo fan 111 is adjacently provided in an upper position (position inside the machine) of this air intake port 105. A pre-filter 107 and an air purifying element 108 are arranged in this order from the air flow upstream side to the downstream side between the bellmouth 106 and the air intake port 105. Further, an air blowing port 109 constructed of an annular groove of a specified width is provided around the air intake port 105 of the panel member of the main casing 102.

As shown in the enlarged views of FIG. 29 through FIG. 31, the panel member 104 has a structure of a combination of an outer frame panel 140 and an inner frame panel 141 described below.

The outer frame panel 140 is a panel having a circular opening in its center portion, and an inner peripheral surface 140*a* of the opening has a tapered surface constituting the outer peripheral surface of the annular air blowing port 109.

The inner frame panel 141 is a circular panel having a size capable of being engaged with the inside of the opening of the outer frame panel 140 with interposition of a specified interval and forms an air blowing passage 109*a* of the air blowing port 109 between its outer peripheral surface 141*a* and the inner peripheral surface 140*a* of the outer frame panel 140 by being integrally engaged with the outer frame panel 140.

As described above, the air blowing passage 109*a* of the air blowing port 109 is formed of the inner peripheral surface 140*a* of the outer frame panel 140 and the outer peripheral surface 141*a* of the inner frame panel 141. In this case, the air blowing port 109 has an inclined passage inclined at a specified angle toward the outer periphery, and the angle of inclination of the air blowing passage 109*a* directly becomes an air blow angle in the perpendicular plane direction of the air flow blown from the air blowing port 109.

With the aforementioned construction, an air passage 10 is formed throughout the entire circumference extending from the air intake port 105 via the pre-filter 107, the air purifying element 108 and the bellmouth 106 to the air blowing port 109 inside the main casing 102. The turbo fan 111 is hung on the ceiling panel 112 of the main casing 102 via a fan motor 111*a* in a position that belongs to the air passage 10 and is located above the air purifying element 108. Further, a scroll 113 directed to the air blowing port 109 is provided in a state in which it encloses the turbo fan 111 inside the main casing 102.

The air blowing port 109 is provided with a plurality of vortex flow creating stators (fixed vanes) 114, 114, . . . arranged at regular intervals in the circumferential direction with a specified angle of inclination in the direction of turn in order to create a vortex flow in the spiral direction in correspondence with the scroll 13. These stators 114, 114, . . . are fixed to the tapered outer peripheral surface 141*a* of the inner frame panel 141.

The air purifying element 108 can be provided by, for example, a deodorizing element having a deodorizing function for absorbing and removing the odor component in the air, a dust removing element having a dust removing function for collecting and removing dust in the air or the like having a variety of functions contributing to the purification of air.

As described above, according to the air purifier $Z_1$ of this eighth embodiment, by providing the square air intake port 105 in the center portion of the panel member 104 located in the lower surface portion of the main casing 102, providing the annular air blowing port 109 inclined at the specified angle outwardly of the periphery around the air intake port 105, forming the air passage 10 that extends from the air intake port 105 to the air blowing port 109 and providing the turbo fan 111 at the center of the air passage 10, air sucked from the air intake port 105 is blown from the air blowing port 109 via the pre-filter 7 and the air purifying element 8 toward the downside floor surface of the room at the specified air blow angle.

Then, in the air blowing port 109 of the main casing 102 forming the air passage 10, the vortex flow creating stators 114, 114, . . . for giving a vector in the direction of turn to the air flow blown from the air blowing port 109 are provided at specified intervals in the circumferential direction with the specified angle of inclination.

Therefore, if the turbo fan 111 is driven, then the room air in the specified spot region below the air intake port 105 is sucked from the air intake port 105, purified through the pre-filter 107 and the air purifying element 108 and thereafter blown outwardly of the periphery by the turbo fan 111. Then, the air (clean air) blown from this turbo fan 111 outwardly of the periphery is blown as a spiral vortex flow $A_1$ obliquely from the air blowing port 109 toward the downside floor surface by gaining a velocity vector in the direction of turn by the vortex flow creating stators 114, 114, . . . in the air blowing passage of the air blowing port 109.

As a result, in accordance with the creation of the vortex flow $A_1$, a tornado flow $A_2$ having a great sucking force rising up due to the sucking force of the turbo fan 111 is formed in the direction opposite to the direction of the vortex flow $A_1$ inwardly in the center axis direction of the vortex flow $A_1$. As described above, by virtue of the generation of the tornado flow $A_2$ inside the vortex flow $A_1$ blown from the air blowing port 109, the purifying operation of air in the specified spot region surrounded by the vortex flow $A_1$ is reliably performed with high efficiency in the air purifying element 108.

The air purifying performance of the air purifying element 108 and so on of the aforementioned air purifier $Z_1$, i.e., the efficient intake performance of air located in the specified spot region is largely dominated by the state of generation of the tornado flow $A_2$. Furthermore, this tornado flow $A_2$ is provided on the basis of the stable creation of the vortex flow $A_1$ outside the tornado flow $A_2$. Then, the adhesion phenomenon of the air flow, i.e., the phenomenon of the adhesion of the air flow blown from the air blowing port 109 to the ceiling 103 can be considered as a great factor in hindering the stable creation of the vortex flow $A_1$, as mentioned hereinbefore.

Figure 31:
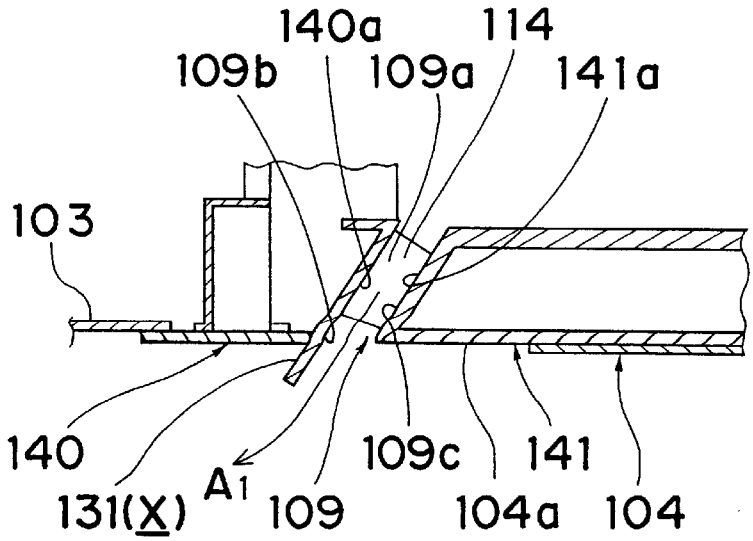
FIG. 31 is an enlarged view of an air blowing port portion of the air purifier Z shown in FIG. 29.

Therefore, according to the present embodiment, to which the present invention is applied, as shown in FIG. 29 through FIG. 31, an annular body 131 that extends in a state in which it is protruding from an air blowing side surface 104*a* of the panel member 104 is provided as an air flow adhesion preventing member X on an approximate extension in the air blow direction of the air blowing port 109 from an outer peripheral edge 109*b* throughout the entire circumference of the outer peripheral edge 109*b* of the air blowing port 109, as shown in FIG. 29 through FIG. 31.

As described above, by providing the air flow adhesion preventing member X constructed of the annular body 131 throughout the entire circumference of the outer peripheral edge 109*b* of the air blowing port 109, the air flow blown from the air blowing port 109 is to be blown roughly on the approximate extension in the air blow direction of the air blowing port 109 by the air flow guiding operation of the annular body 131, as indicated by the stream line $A_1$ in FIG. 31. As a result, regardless of the fact that the surface that may cause the Coanda effect, i.e., the lower surface of the outer frame panel 140 and the ceiling 103 continued from this exist in the vicinity of the air blowing port 109, the adhering operation of the blowing air to the surfaces is immediately prevented, stably creating the vortex flow $A_1$ by the air flow. Then, by virtue of the stable creation of the vortex flow $A_1$, the tornado flow $A_2$ is stably formed inside the vortex flow $A_1$, achieving satisfactory air intake and blowing operation, i.e., high-grade air purifying performance can be achieved by the strong sucking force of the tornado flow $A_2$.

Several other concrete examples of the air flow adhesion preventing member X that effects the air flow adhesion preventing function similarly to the annular body 131 will be described here.

Figure 32:
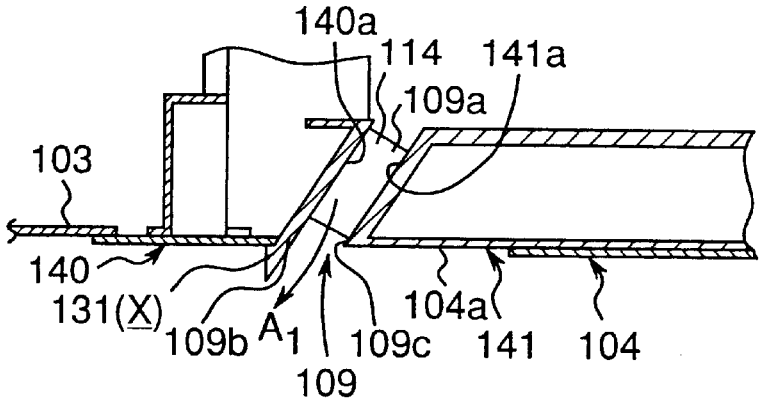
FIG. 32 is a sectional view showing another concrete example 1 of an air flow adhesion preventing member.

As shown in FIG. 32, another concrete example 1 is regarded as a modification example of the air flow adhesion preventing member X of the "eighth embodiment". That is, the air flow adhesion preventing member X in the eighth embodiment is constructed of the annular body 131 that extends in a state in which it is protruding from the air blowing side surface 104*a* of the panel member 104 toward an approximate extension in the air blow direction of the air blowing port 109 from the outer peripheral edge 109*b* throughout the entire circumference of the outer peripheral edge 109*b* of the air blowing port 109. In contrast to this, according to this concrete example 1, an annular body 131 having a wedge-like cross-section shape is mounted so that its one surface is positioned on an approximate extension in the air blow direction of the air blowing port 109 extending from the air blowing port 109 to the outer peripheral edge 109*b* of the air blowing port 109 and made to serve as the aforementioned air flow adhesion preventing member X. According to the air flow adhesion preventing member X having the above construction, an effect and operation similar to those of the eighth embodiment can be obtained. In addition, by virtue of the annular body 131 having the wedge-like cross-section shape, there is produced the unique effect of aesthetic improvement by comparison with the construction in which this is constructed of, for example, a band plate as in the eighth embodiment.

Figure 33:
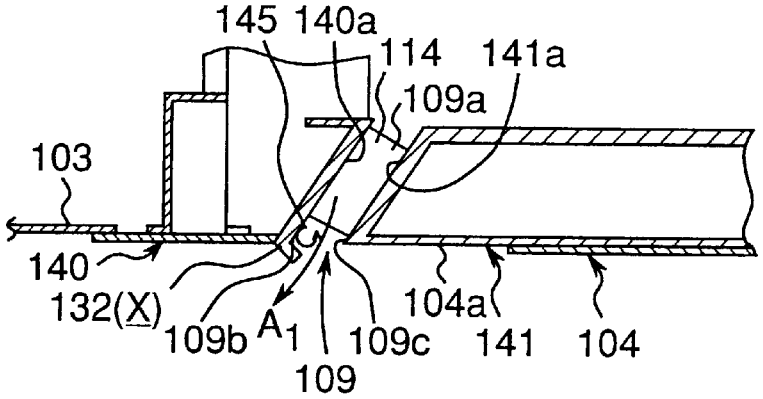
FIG. 33 is a sectional view showing another concrete example 2 of the air flow adhesion preventing member.

Another concrete example 2 is constructed as an air flow adhesion preventing member X by providing an annular body 132 that protrudes from the outer peripheral edge 109*b* into the air blowing passage 109*a* throughout the entire circumference of the outer peripheral edge 109*b* of the air blowing port 109, as shown in FIG. 33.

According to this construction, a corner portion is formed between the annular body 132 and the outer peripheral edge 109*b* of the air blowing port 109, and a swirl flow 145 is generated by air flowing through the air blowing passage 109*a* toward the air blowing port 109 and stays here. Therefore, the air flow blown from the air blowing port 109 through the air blowing passage 109*a* undergoes a radially inwardly deflecting effect by the vortex flow 145 created in the air blowing passage 109*a* and undergoes a flow contracting effect due to a reduction in the air flow passage area of the air blowing passage 109*a* ascribed to the generation of the swirl flow 145, by which the flow rate is increased to strengthen the directivity in the air blow direction. By virtue of a synergistic effect of these effects, the adhesion of the blowing air to the surface in the vicinity of the air blowing port 109 is immediately restricted, and the vortex flow $A_1$ is stably formed. Then, by virtue of the stable creation of the vortex flow $A_1$, the tornado flow $A_2$ is stably formed inside the vortex flow $A_1$, according to which satisfactory air intake and blowing operation, i.e., high-grade air purifying performance can be achieved by the strong sucking force of the tornado flow $A_2$.

Figure 34:
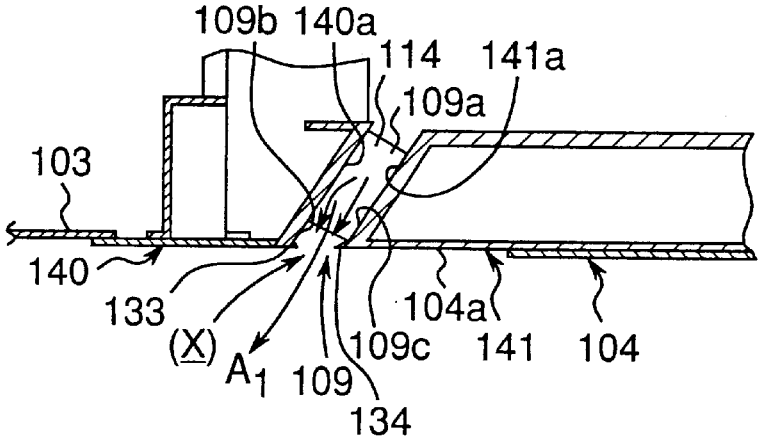
FIG. 34 is a sectional view showing another concrete example 3 of the air flow adhesion preventing member.

Another concrete example 3 is provided with an outer annular body 133 having a wedge-like cross-section shape that is protruding from the outer peripheral edge 109*b* to the inside of the air blowing passage 109*a* throughout the entire circumference of the outer peripheral edge 109*b* of the air blowing port 109 and an inner annular body 134 that has a wedge-like cross-section shape and protrudes from the outer peripheral edge 109*b* into the air blowing passage 109*a* throughout the entire circumference of the outer peripheral edge 109*b* of the air blowing port 109 and the inner annular body 134 that has wedge-like cross-section shape and protrudes from the inner peripheral edge 109*c* into the air blowing passage 109*a* throughout the entire circumference of the inner peripheral edge 109*c*, both of these members constituting the air flow adhesion preventing member X, as shown in FIG. 34.

According to the aforementioned construction, the air flow blown from the air blowing port 109 through the air blowing passage 109*a* undergoes a flow contracting effect due to a reduction in the air flow passage area of the air blowing passage 109*a* ascribed to the provision of the outer annular body 133 and the inner annular body 134, by which the flow rate is increased to strengthen the directivity in the air blow direction. As a result, the adhesion of the blowing air to the surface in the vicinity of the air blowing port 109 is immediately restricted, and the vortex flow $A_1$ is more stably formed. Then, by virtue of the stable creation of the vortex flow $A_1$, the tornado flow $A_2$ is stably generated inside the vortex flow $A_1$, according to which satisfactory air intake and blowing operation, i.e., high-grade air purifying performance can be achieved by the strong sucking force of the tornado flow $A_2$.

Figure 35:
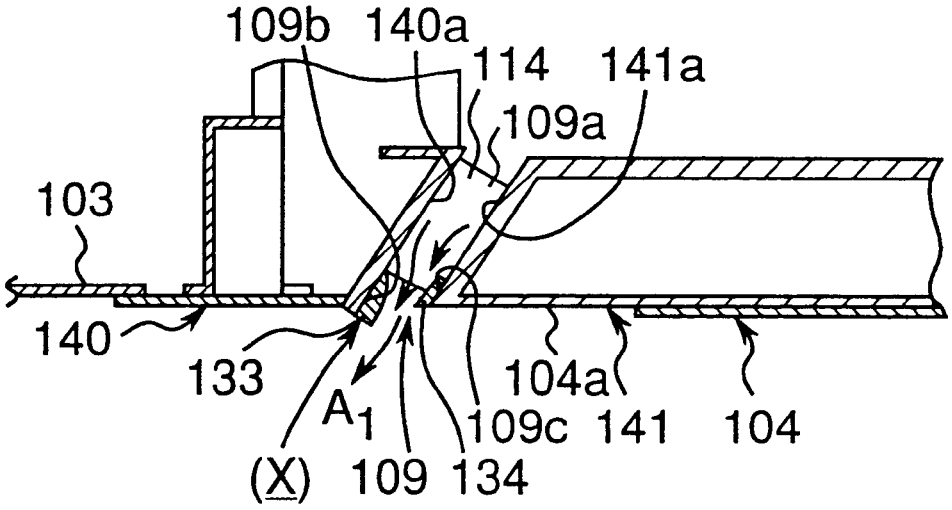
FIG. 35 is a sectional view showing another concrete example 4 of the air flow adhesion preventing member.

Another concrete example 4 is regarded as a modification example of the aforementioned "another concrete example 3" as shown in FIG. 35. The air flow adhesion preventing member X is constructed by providing both the outer annular body 133 for the outer peripheral edge 109*b* of the air blowing port 109 and the inner annular body 134 for the inner peripheral edge 109*c* of the air blowing port 109, similarly to the aforementioned "another concrete example 3". However, in contrast to the fact that both the outer annular bodies 133 and 134 have a wedge-like cross-section shape in the "another concrete example 3", both the outer annular bodies 133 and 134 have a stream line cross-section shape in another concrete example 4.

With the above-mentioned construction, an effect similar to that of the aforementioned "another concrete example 3" can be obtained, and in addition to this, the air flow contracting effect is made more smooth with respect to the air flow flowing through the air blowing passage 109*a* by virtue of the fact that the outer annular body 133 and the inner annular body 134 have the stream line cross-section shape. This further strengthens the directivity of the blowing air due to the flow contracting effect by that much, improves the stability of the vortex flow $A_1$ and consequently enables the strengthening of the sucking force of the tornado flow $A_2$.

Ninth Embodiment

Figure 36:
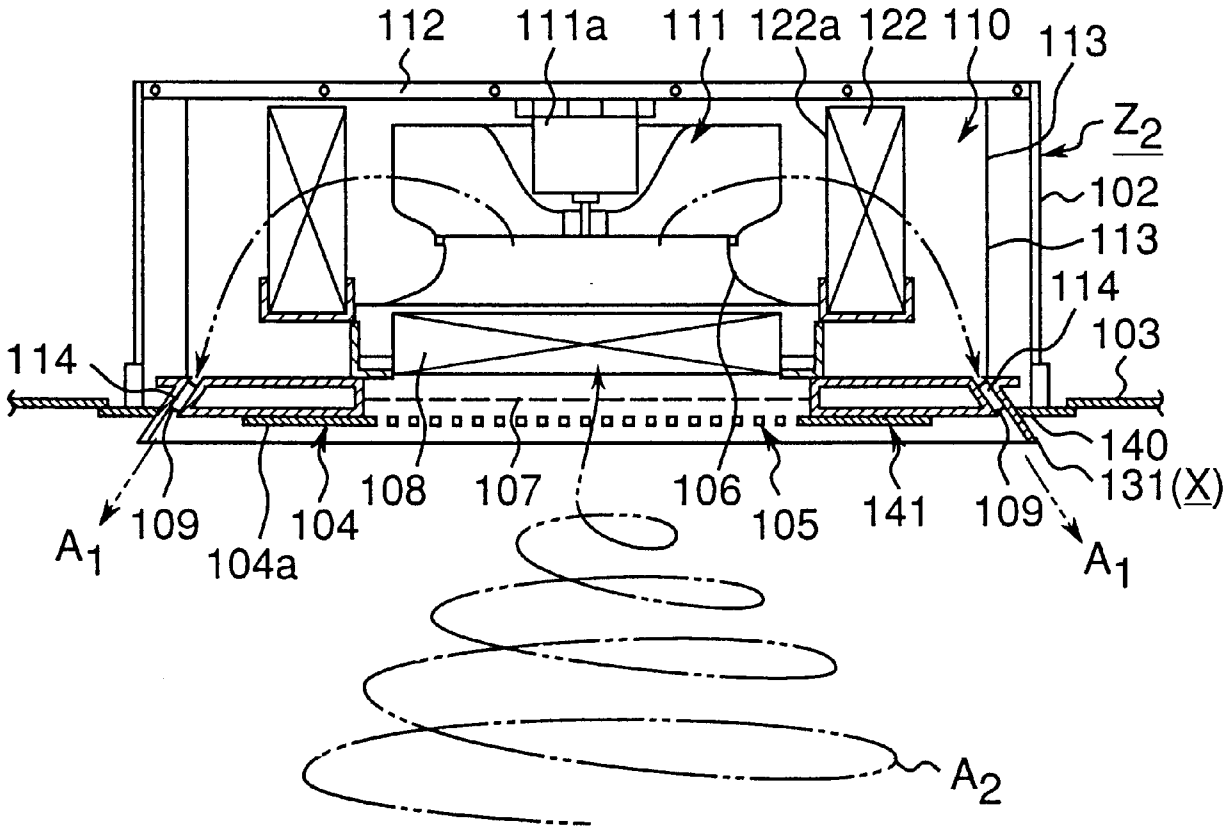
FIG. 36 is a sectional view of an air conditioner of a ninth embodiment of the air intake and blowing device of the present invention.

FIG. 36 shows a ceiling embedded type air conditioner $Z_2$ according to the ninth embodiment of the air intake and blowing device of the present invention. This air conditioner $Z_2$ has a basic construction that is based on the air purifier $Z_1$ of the eighth embodiment and further provided with an air heat exchanger 122. The constituent members other than the above-mentioned members are denoted by the same reference numerals as those of the constituent members of the air purifier $Z_1$ of the eighth embodiment, and no description is herein provided for them.

According to this air conditioner $Z_2$, the room air sucked from the air intake port 105 in accordance with the rotation of the turbo fan 111 is purified by undergoing the deodorizing or dust removing operation of the air purifying element 108 and thereafter blown as a warm current of air or a cool current of air from the air blowing port 109 into the room through heat exchange in the air heat exchanger 122, by which the purification of the room air and the room temperature adjustment are performed.

In this case, by virtue of the provision of the air flow adhesion preventing member X constructed of the annular body 131 for the air blowing port 109, the air flow blown from the air blowing port 109 stably creates the vortex flow $A_1$ without causing the adhesion to the ceiling 103. A tornado flow $A_2$ having a strong sucking force is stably generated inside this stable vortex flow $A_1$, and the circulation operation of the room air is efficiently performed by the strong sucking force of the tornado flow $A_2$, ensuring satisfactory air conditioning characteristics by that much.

Tenth Embodiment

Figure 37:
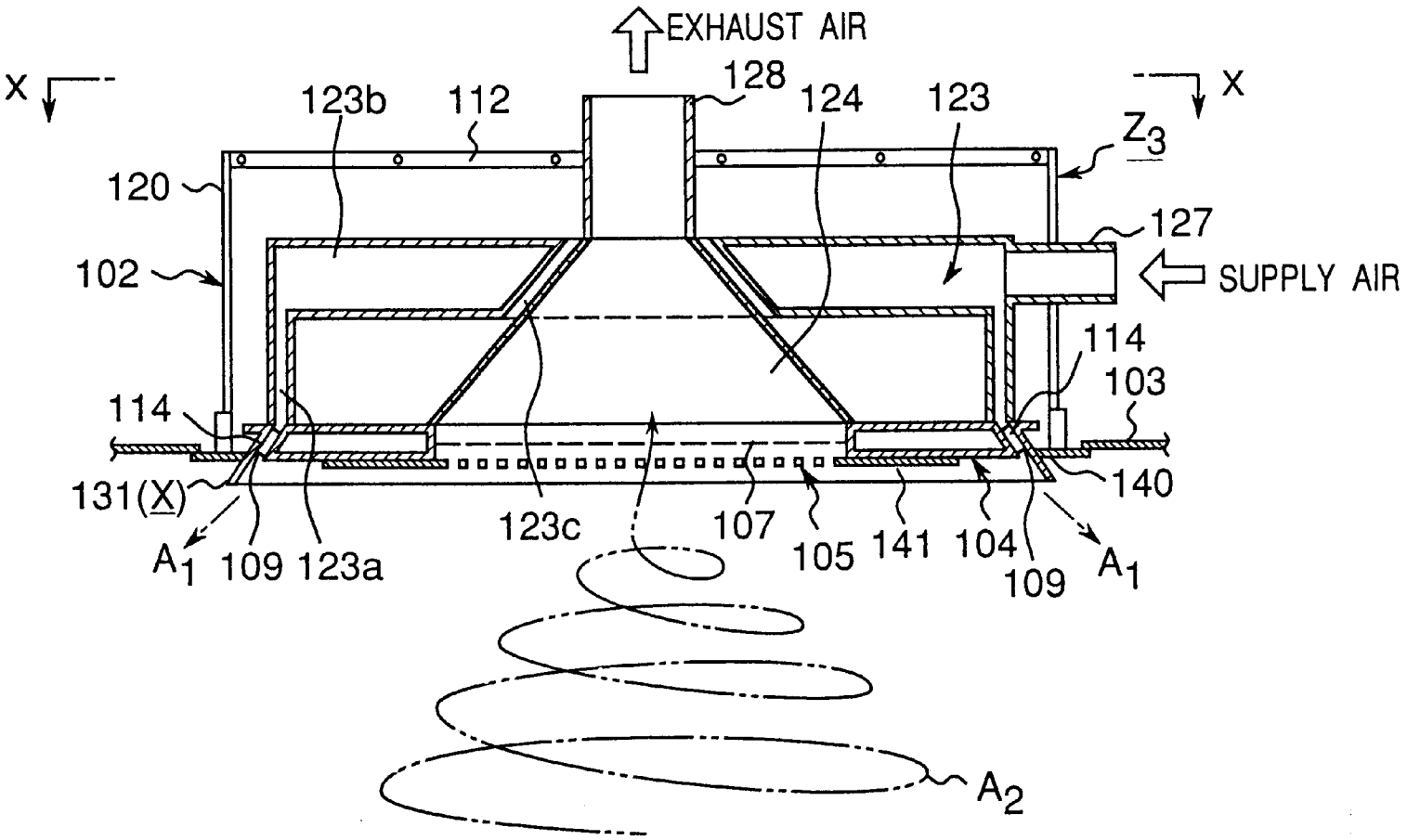
FIG. 37 is a sectional view of a ventilation unit of a tenth embodiment of the air intake and blowing device of the present invention.
Figure 38:
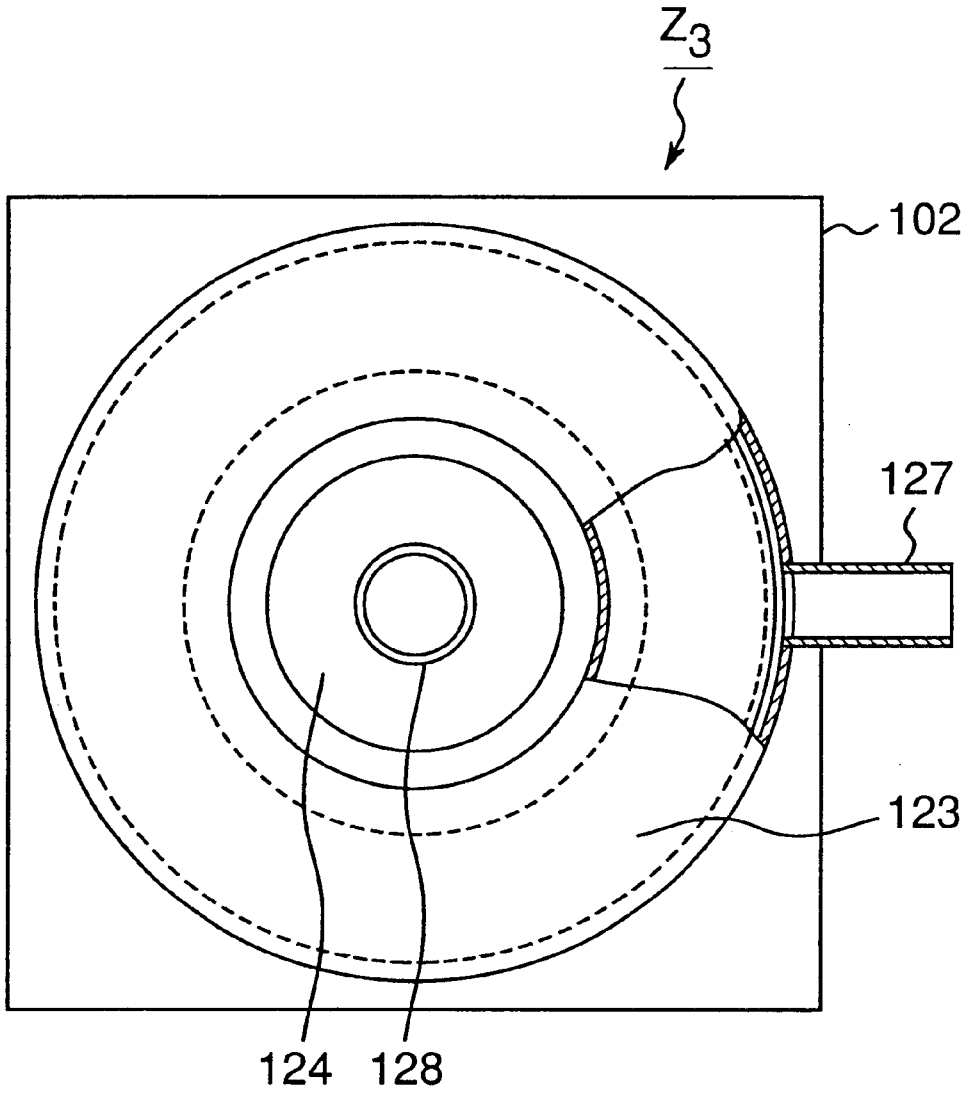
FIG. 38 is a view taken along the arrow line X—X of FIG. 37.

FIG. 37 and FIG. 38 show a ceiling embedded type ventilation unit $Z_3$ according to the tenth embodiment of the air intake and blowing device of the present invention. This ventilation unit $Z_3$ is to construct a ventilation system as shown in FIG. 39 and is provided with a main casing 102 embedded in the ceiling 103.

This main casing 102 is constructed by integrally mounting a ceiling panel 112 on the upper surface of a box-shaped frame 120 whose upper and lower ends are both opened and detachably mounting a panel member 104 having the same construction as that of the air purifier $Z_1$ of the eighth embodiment on the lower surface side. The panel member 104 is embedded in the ceiling 103 so as to be roughly flush with the ceiling 103 in an approximate identical plane. It is to be noted that the concrete construction of the panel member 104 is not described herein by quoting the portions of the corresponding explanation of the eighth embodiment and denoting the corresponding constituent members in FIG. 37 by the same reference numerals as shown in FIG. 29.

On the other hand, an exhaust chamber 124 provided with an exhaust duct 128 is connected to the back side (inside the machine) of the air intake port 105 of the panel member 104. Furthermore, an air supply chamber 123 is connected to the back side (inside the machine) of the air blowing port 109 of the panel member 104. This air supply chamber 123 is provided with a cylindrical supply air guiding section 123*a* connected to the air blowing port 109 and a hollow disk-shaped main body section 123*b* that communicates with the upper end of the supply air guiding section 123*a* and has a specified volume, while the main body section 123*b* is provided with an opening 123*c* capable of permitting the insertion of the exhaust chamber 124 in its center position and one side connected to an air supply duct 27.

Figure 39:
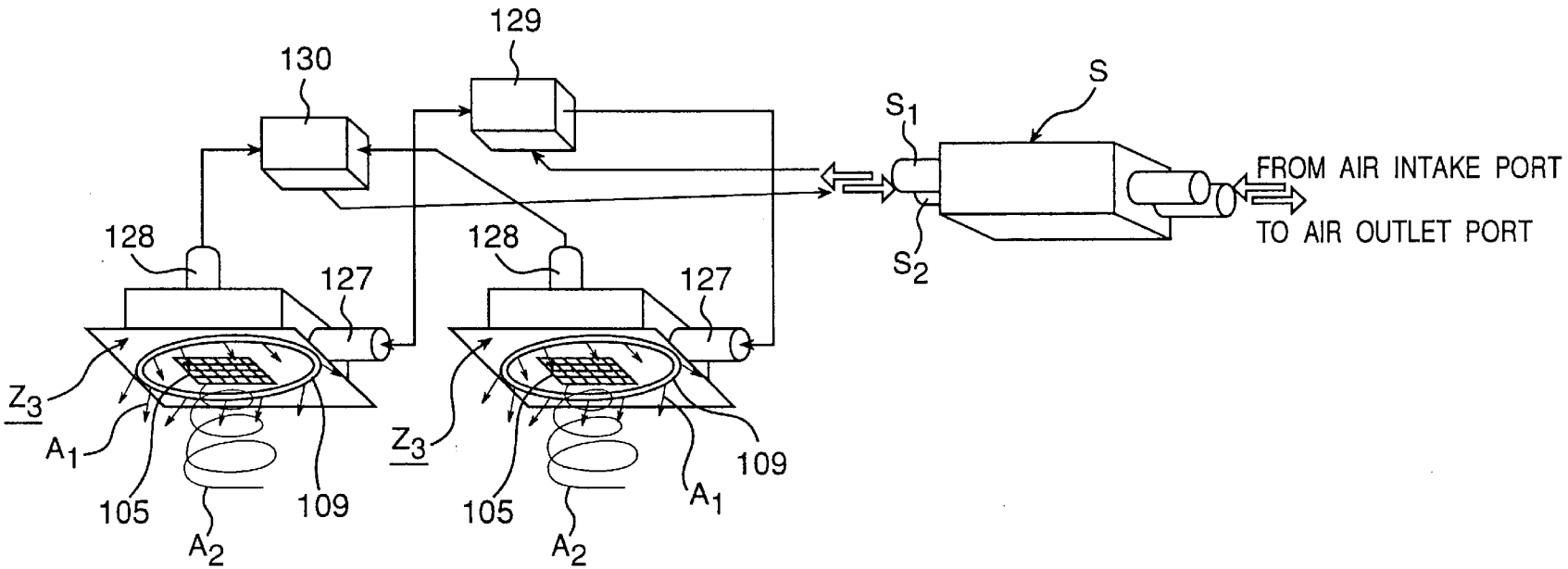
FIG. 39 is a general view of a ventilation system employing the ventilation unit shown in FIG. 37.

As shown in FIG. 39, a specified number (two in this embodiment) of ventilation units $Z_3$ having the above construction are arranged according to the required ventilation capacity. Then, these ventilation units $Z_3$, $Z_3$, . . . have air supply ducts 127 and 127 connected to a supply air guiding duct $S_1$ of an all purpose heat exchanger mechanism S via an air supply side branch chamber 129 and exhaust ducts 128 and 128 connected to an exhaust introduction duct $S_2$ of the all purpose heat exchanger mechanism S via an exhaust side branch chamber 130, constituting one ventilation system. Although not shown in FIG. 39, the air supply passage and the exhaust air passage are provided with a supply air fan and an exhaust fan, respectively, located in appropriate portions, and the feeding of supply air and discharging of the exhaust air are performed by the supply air fan and the exhaust fan, respectively.

In the thus-constructed ventilation system, the supply air fed by the operation of the supply air fan is blown as a vortex flow $A_1$ into the room from the air blowing port 109 of each ventilation unit $Z_3$. On the other hand, the air inside the room is sucked from the air intake port 105 of the ventilation unit $Z_3$ and discharged to the outside by the operation of the exhaust fan. By concurrently performing the air supply operation and the air discharge operation, the ventilation of the inside of the room is performed. In this case, the air flow blown from the air blowing port 109 is prevented from adhering to the ceiling 103 by the provision of the air flow adhesion preventing member X constructed of the annular body 131 for the air blowing port 109 of the ventilation unit $Z_3$, by which the creation of the vortex flow $A_1$ by the air flow is stably performed. Therefore, the tornado flow $A_2$ is also stably generated by the intake air flow generated inside the vortex flow $A_1$, achieving high-efficiency ventilation effectively utilizing the strong sucking force owned by the tornado flow $A_2$. In this case, the collection of heat is performed by heat exchange between the supply air and the exhaust air with the provision of the all purpose heat exchanger mechanism S, and therefore, energy saving operation of a small drive power can be achieved.

Eleventh Embodiment

Figure 40:
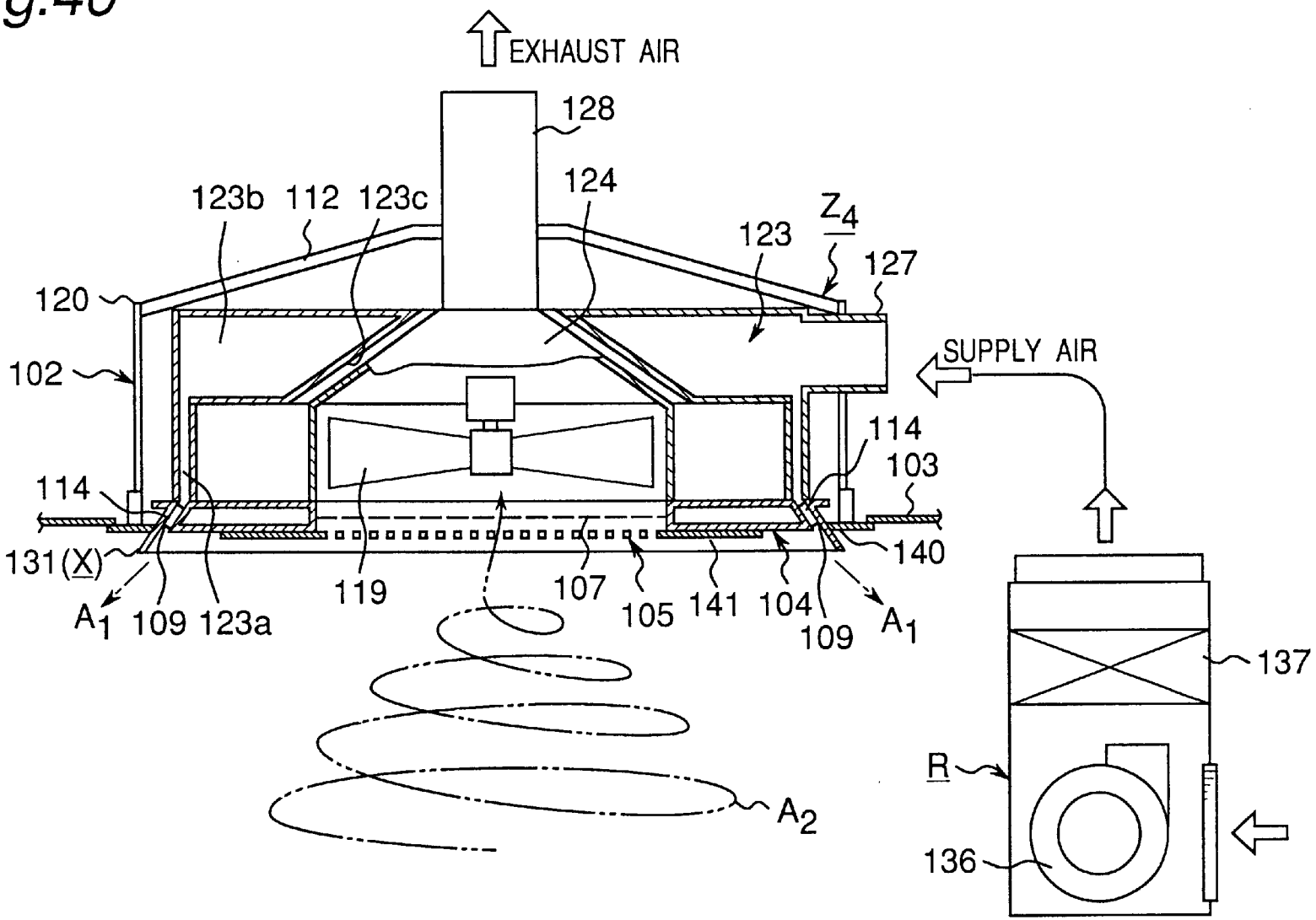
FIG. 40 is a sectional view of an air conditioner unit of an eleventh embodiment of the air intake and blowing device of the present invention.
Figure 41:
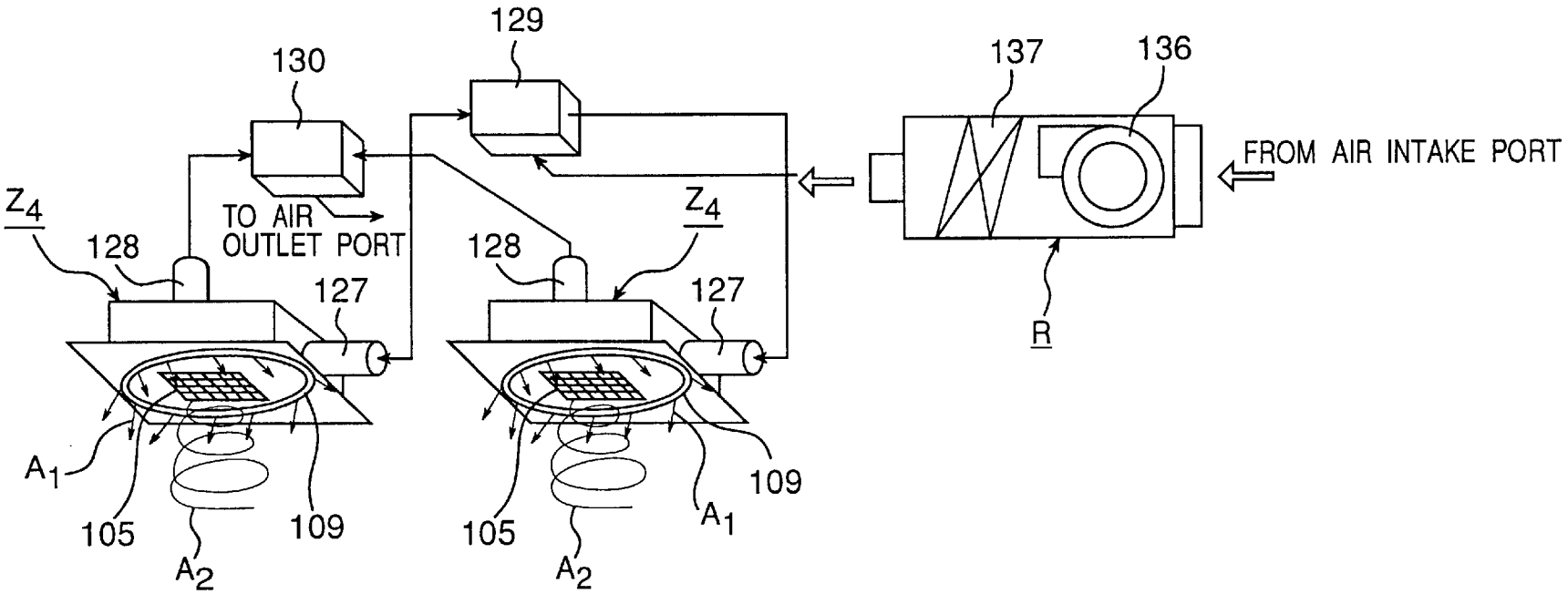
FIG. 41 is a general view of an air conditioner system employing the air conditioner unit shown in FIG. 40.
Figure 42:
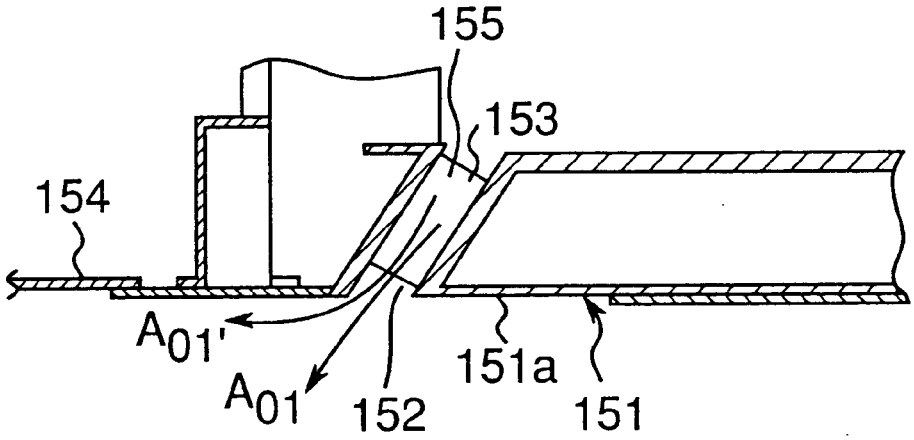
Fig.42 PRIOR ART
FIG. 42 is a sectional view showing the structure of the air blowing port of a conventional air purifier.

FIG. 40 shows a ceiling embedded type air conditioner unit $Z_4$ according to the eleventh embodiment of the air intake and blowing device of the present invention. This air conditioner unit $Z_4$ can be utilized as a spot air conditioner or the like specially for each worker in a factory by combining the single body of the unit with an air conditioner mechanism R. An air conditioner system as shown in FIG. 41 can be constructed and utilized for multi-room air conditioning, the system being provided with a main casing 102 to be embedded in the ceiling 103.

This main casing 102 is constructed by integrally mounting a ceiling panel 112 on the upper surface of the box-shaped frame 120 whose upper and lower ends are both opened and detachably mounting a panel member 104 having the same construction as that of the air purifier $Z_1$ of the eighth embodiment on the lower surface side. The panel member 104 is embedded in the ceiling 103 so as to be roughly flush with the ceiling 103 in an approximate identical plane. It is to be noted that the concrete construction of the panel member 104 is not described herein by quoting the portions of the corresponding explanation of the eighth embodiment and denoting the corresponding constituent members in FIG. 40 by the same reference numerals as shown in FIG. 29.

On the other hand, an exhaust chamber 124 provided with an exhaust duct 128 is connected to the back side (inside the machine) of the air intake port 105 of the panel member 104, and an exhaust fan 119 is arranged inside the air supply duct 27. An air supply chamber 123 is connected to the back side (inside the machine) of the air blowing port 109 of the panel member 104. This air supply chamber 123 is provided with a cylindrical supply air guiding section 123*a* connected to the air blowing port 109 and a hollow disk-shaped main body section 123*b* that communicates with the upper end of the supply air guiding section 123*a* and has a specified volume, while the main body section 123*b* is provided with an opening 123*c* capable of permitting the insertion of the exhaust chamber 124 in its center position and one side connected to an air supply duct 27.

As shown in FIG. 39, a specified number (two in this embodiment) of ventilation units $Z_4$ having the above construction are arranged according to the required ventilation load. Then, these air conditioner units $Z_4$ $Z_4$, . . . have air supply ducts 127 and 127 connected to the air conditioner mechanism R via an air supply side branch chamber 129 and exhaust ducts 128 and 128 connected to an exhaust port (not shown) via an exhaust side branch chamber 130, constituting one air conditioning system. It is to be noted that the air conditioner mechanism R is constructed of a supply air fan 136 and an air heat exchanger 137.

In the thus-constructed air conditioning system, the supply air (warm current of air or a cool current of air) fed by the operation of the supply air fan 136 of the is air conditioner mechanism R is blown as a vortex flow $A_1$ into the room from the air blowing port 109 of the air conditioner unit $Z_4$. On the other hand, the air inside the room is sucked from the air intake port 105 of the air conditioner unit $Z_4$ and discharged to the outside by the operation of the exhaust fan 119. By concurrently performing the air supply operation and the air discharge operation, the temperature of the air inside the room is adjusted. In this case, a vortex flow $A_1$ is stably created by the air flow by providing an air flow adhesion preventing member X constructed of the annular body 131 for the air blowing port 109 of the air conditioner unit $Z_4$ and preventing the air flow blown from the air blowing port 109 from adhering to the ceiling 103. Therefore, the tornado flow $A_2$ is also stably generated by the intake air flow generated inside the vortex flow $A_1$, achieving high-efficiency cooling and heating operation utilizing the strong sucking force owned by the tornado flow $A_2$.

Although the annular body 131 is provided as the air flow adhesion preventing member X in the ninth embodiment through the eleventh embodiment, any one of the aforementioned "another concrete example 1 through another concrete example 4" can, of course, be adopted as the air flow adhesion preventing member X.

Twelfth Embodiment

Figure 43:
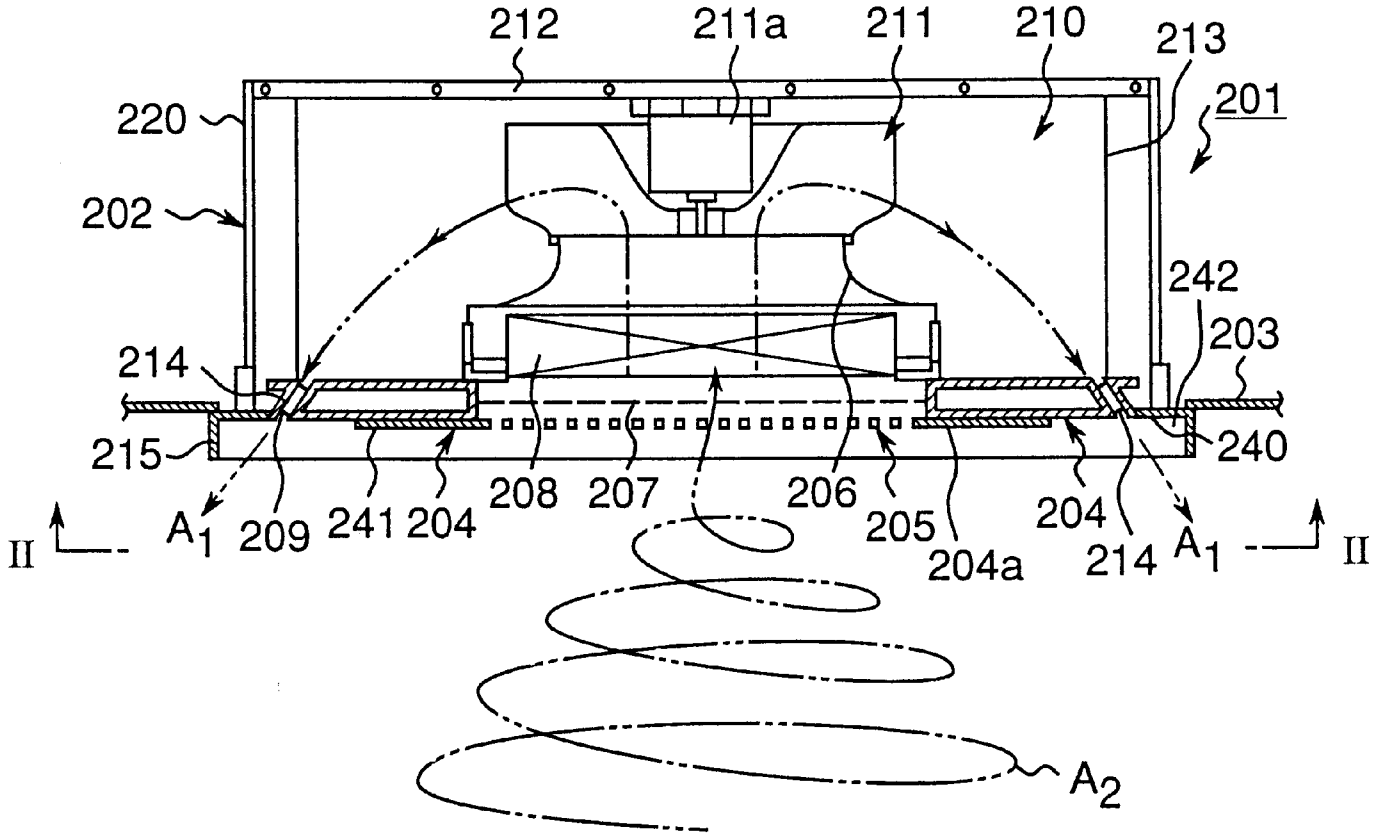
FIG. 43 is a sectional view showing the construction of an air intake and blowing device according to a twelfth embodiment of the present invention.

FIG. 43 shows a ceiling embedded type air purifier 201 according to the twelfth embodiment of the air intake and blowing device of the present invention, and the reference numeral 2 denotes a main casing in the figure. This main casing 202 is constructed by integrally mounting a ceiling panel 212 on the upper surface of a box-shaped frame 20 whose upper and lower ends are both opened and detachably mounting a panel member 204 described below on the lower surface side. The main casing is embedded in a ceiling 203 in a manner that the panel member 204 located at the lower end is roughly flush with the ceiling 203 in an approximate identical plane.

Figure 44:
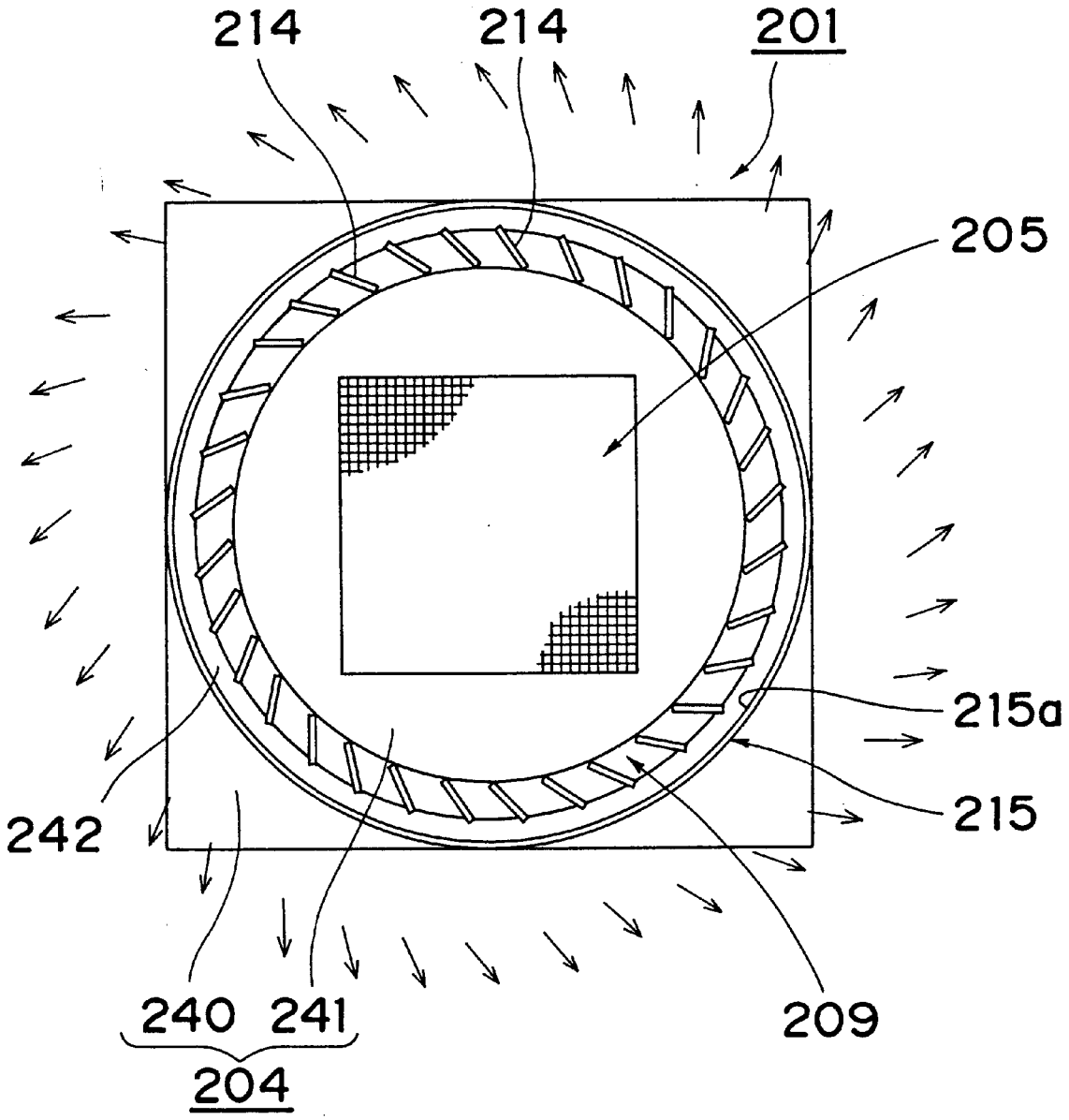
FIG. 44 is a view taken along the arrow line II—II of FIG. 43.

As shown in FIG. 43 and FIG. 44, the panel member 204 is provided with a square air intake port 205 located in the center portion. Then, a bellmouth 206 for a turbo fan 211 is adjacently provided in an upper position of this air intake port 205. A pre-filter 207 and an air purifying element 208 are arranged in this order from the air flow upstream side to the downstream side between the bellmouth 206 and the air intake port 205. Further, an air blowing port 209 constructed of an annular groove of a specified width is provided around the air intake port 205 of the panel member 204 of the main casing 202.

As shown in the enlarged view of FIG. 45, the panel member 204 has a structure of a combination of an outer frame panel 240 and an inner frame panel 241 described below.

The outer frame panel 240 is a panel having a circular opening in its center portion, and an inner peripheral surface 240*a* of the opening has a tapered surface constituting the outer peripheral surface of the annular air blowing port 209.

The inner frame panel 241 is a circular panel having a size capable of being engaged with the inside of the opening of the outer frame panel 240 with interposition of a specified interval and forms an air blowing passage of the air blowing port 209 between its outer peripheral surface 241*a* and the inner peripheral surface 240*a* of the outer frame panel 240 by being integrally engaged with the outer frame panel 240.

As described above, the air blowing port 209 is formed of the inner peripheral surface 240*a* of the outer frame panel 240 and the outer peripheral surface 241*a* of the inner frame panel 241. In this case, the air blowing port 209 has an inclined passage inclined at a specified angle toward the outer periphery, and the angle of inclination of the air blowing port 209 directly becomes an air blow angle in the perpendicular plane direction of the air flow blown from the air blowing port 209.

With the aforementioned construction, an air passage 210 is formed throughout the entire circumference extending from the air intake port 205 via the pre-filter 207, the air purifying element 208 and the bellmouth 206 to the air blowing port 209 inside the main casing 202. The turbo fan 211 is hung on the ceiling panel 212 of the main casing 202 via a fan motor 211*a* in a position located above the air purifying element 208 of this air passage 210. Further, a scroll 213 directed to the air blowing port 209 is provided in a state in which it encloses the turbo fan 211 inside the main casing 202.

The air blowing port 209 is provided with a plurality of vortex flow creating stators 214, 214, . . . provided at regular intervals in the circumferential direction with a specified angle of inclination in the direction of turn in order to create a vortex flow in the spiral direction in correspondence with the scroll 213. These stators 214, 214, . . . are fixed to the tapered outer peripheral surface 241*a* of the inner frame panel 241.

As described above, according to the air purifier 201 of this twelfth embodiment, by providing the square air intake port 205 in the center portion of the panel member 204 located in the lower surface portion of the main casing 202, providing the annular air blowing port 209 inclined at the specified angle outwardly of the periphery around the air intake port 105, forming the air passage 210 that extends from the air intake port 205 to the air blowing port 209 and providing the turbo fan 211 at the center of the air passage 210, air sucked from the air intake port 205 is blown from the air blowing port 209 via the pre-filter 207 and the air purifying element 208 toward the downside floor surface of the room at the specified air blow angle.

Then, in the air blowing port 209 of the main casing 202 forming the air passage 210, the vortex flow creating stators 214, 214, . . . for giving a vector in the direction of turn to the air flow blown from the air blowing port 209 are provided at specified intervals in the circumferential direction with the specified angle of inclination.

Therefore, if the turbo fan 211 is driven, then the room air in the specified spot region below the air intake port 205 is sucked from the air intake port 205, purified through the pre-filter 207 and the air purifying element 208 and thereafter blown outwardly of the periphery by the turbo fan 211. Then, the air (clean air) blown from this turbo fan 211 outwardly of the periphery is blown as a spiral vortex flow $A_1$ obliquely from the air blowing port 209 toward the downside floor surface by gaining a velocity vector in the direction of turn by the vortex flow creating stators 214, 214, . . . in the air blowing passage of the air blowing port 209.

As a result, in accordance with the creation of the vortex flow $A_1$, a tornado flow $A_2$ having a great sucking force rising up due to the sucking force of the turbo fan 211 is formed in the direction opposite to the direction of the vortex flow $A_1$ inwardly in the center axis direction of the vortex flow $A_1$. As described above, by virtue of the generation of the tornado flow $A_2$ inside the vortex flow $A_1$ blown from the air blowing port 209, the purifying operation of air in the specified spot region surrounded by the vortex flow $A_1$ is reliably performed with high efficiency in the air purifying element 208.

In order to obtain the air purifying performance of the air purifying element 208 and so on of the aforementioned air purifier 201, i.e., to obtain an efficient air intake performance of air located in the specified spot region, it is, of course, required to consider the following facts of knowledge according to the experiments conducted by the present inventor et al., as described hereinabove.

The performance is largely dominated by the strength and stability of the sucking force of the tornado flow $A_2$.

The state of generation of the sucking force of this tornado flow $A_2$ requires the stable formation of a high static pressure region so as to surround the vortex flow $A_1$ in the region near the air blowing port 209 by the vortex flow $A_1$ created outside the tornado flow $A_2$.

Furthermore, in order to stably form a high static pressure region, it is important to promote the operation of converting the dynamic pressure into a static pressure through the stably reduction in velocity of the vortex flow $A_1$ from the air blowing port 209 in the free space below the air blowing port 209 by preventing the vortex flow $A_1$ blown from the air blowing port 209 from adhering to the air blowing side surface 204*a* of the air blowing port 209 in the panel member 204 due to the Coanda effect and the like and from irregularly spreading around the air blowing port 209 due to the reduction in velocity as a consequence of the development of the flow rate boundary layer.

In this case, by immediately removing the influence (for example, the effect of deflecting the air flow by the adjacent room wall surface) on the vortex flow $A_1$ exerted from the space portion located outside the air blowing port 209, satisfactory performance can be obtained regardless of the installation position of the air purifier 201 in the room.

Figure 45:
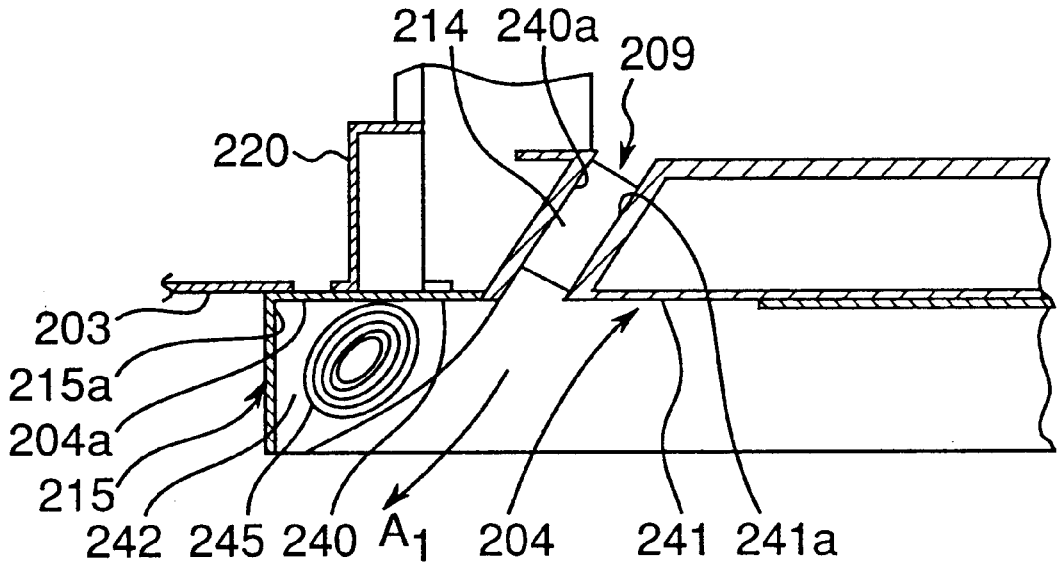
FIG. 45 is an enlarged view of the air blowing port portion of the air intake and blowing device shown in FIG. 43.

Accordingly, in the air purifier 201 of the present embodiment, as shown in FIG. 43 through FIG. 45, a wall member 215 constructed of a protruding body obtained by annularly bending a band plate member of a specified width is arranged so as to enclose the entire circumference of the air blowing port 209 in a position radially outwardly separated apart by a specified interval from the air blowing port 209 on the air blowing side surface 204*a* of the panel member 204. By arranging this wall member 215, an annular corner portion 242 enclosing the air blowing port 209 is formed of the air blowing side surface 204*a* of the panel member 204 and the inner peripheral surface 215*a* of the wall member 215 in a position separated radially outwardly by an appropriate interval from the air blowing port 209.

If the wall member 215 is thus provided to form the annular corner portion 242 radially outwardly of the air blowing port 209, then, as shown in FIG. 45, a vortex flow 245 is formed to stay in the region of the corner portion 242 by the vortex flow $A_1$ blown radially outwardly from the air blowing port 209 obliquely downward. The vortex flow $A_1$ subsequently blown is guided by this vortex flow 245 so as to reach the lower end of the wall member 215 while going around the outside, i.e., close to the air blowing port 209 and is spirally blown from the lower end portion toward the downside room space, i.e., the free space.

As a result, the vortex flow $A_1$ reaches the lower end portion of the wall member 215 from the air blowing port 209 without diffusing toward the periphery as a consequence of irregular velocity attenuation ascribed to the generation of the boundary layer immediately after blowing from the air blowing port 209 as in the conventional case. The air flow velocity is generally attenuated by being blown from the lower end portion further into the room space, by which the dynamic pressure owned by the vortex flow $A_1$ is gradually converted into a static pressure, and a high static pressure region is formed in the vicinity of the lower portion of the wall member 215 so as to surround the air blowing port 209. Furthermore, this high static pressure region is immediately prevented from being influenced by the state of the outside space since the wall member 215 has the function of interrupting the space between the air blowing port 209 and the outside space. Therefore, the high static pressure region is stably formed so as to surround the outside of the air blowing port 209 in the region near the air blowing port 209.

By the stable formation of the high static pressure region in the region near the air blowing port 209, the tornado flow $A_2$ that moves upward inside the vortex flow $A_1$ is more stably generated by the tornado flow $A_2$, and the strong sucking force owned by the tornado flow $A_2$ is maximally utilized for the suction of the room air in the region surrounded by the vortex flow $A_1$ toward the air intake port 205. The air purifying performance of the air purifier 201 is immediately increased, and the air purifying performance is achieved regardless of the installation position of the air purifier 201 in the room.

Several modification examples of the wall member 215 according to the twelfth embodiment will be described here.

Figure 46:
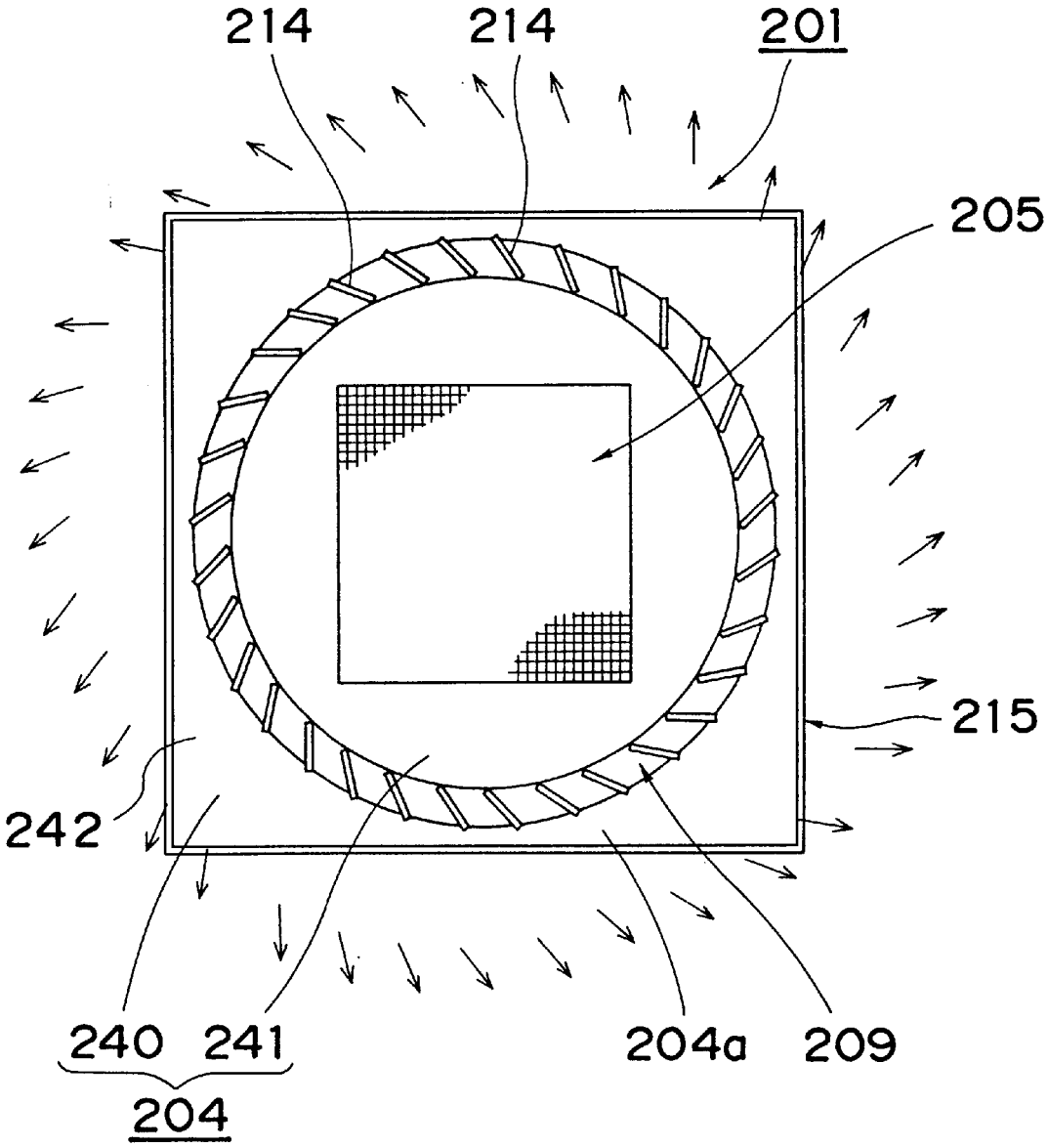
FIG. 46 is a look-up view (corresponding to FIG. 44) showing a first modification example of the construction of the air blowing port portion of the above device.

FIG. 46 shows a first modification example of the wall member 215. In contrast to the fact that the wall member 215 is formed so as to enclose the outside of the air blowing port 209 in the aforementioned embodiments, the wall member 215 of this first modification example is formed in a rectangular frame-like shape along the outer peripheral shape of the panel member 204, and the corner portion 242 is formed between the inner peripheral surface 215*a* and the air blowing side surface 204*a* of the panel member 204 according to the device of this first modification example.

With the above-mentioned construction, in addition to the advantage that the same operation and effect as those of the wall member 215 of the aforementioned embodiments can be obtained, the cost reduction can be promoted since the formation is easies than when this is formed into an annular shape.

Figure 47:
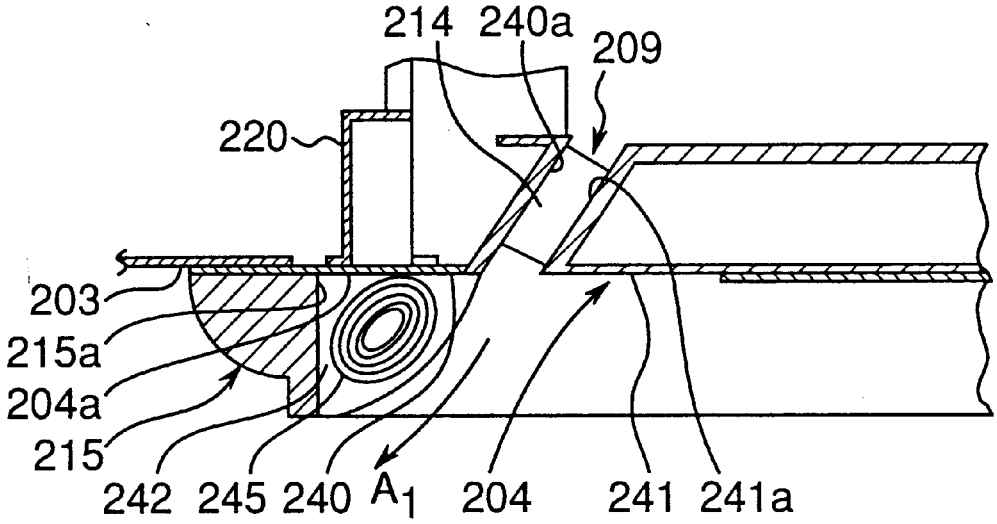
FIG. 47 is a sectional view showing a second modification example of the construction of the air blowing port portion of the above device.

FIG. 47 shows a second modification example of the wall member 215. The wall member 215 of this second modification example is obtained by forming a die material having a roughly triangular cross-section shape and a bent outer peripheral surface 215*b* into an annular or rectangular frame-like shape and forming the corner portion 242 between the inner peripheral surface 215*a* and the air blowing side surface 204*a* of the panel member 204.

With the above-mentioned construction, in addition to the fact that effect and operation similar to those of the wall member 215 of the aforementioned embodiment can be obtained, the aesthetic properties of the wall member 215 become satisfactory by virtue of the bent surface of the outer peripheral surface 215*b* of the wall member 215, and this consequently allows the improvement in design of the air purifier 201 to be expected.

Figure 48:
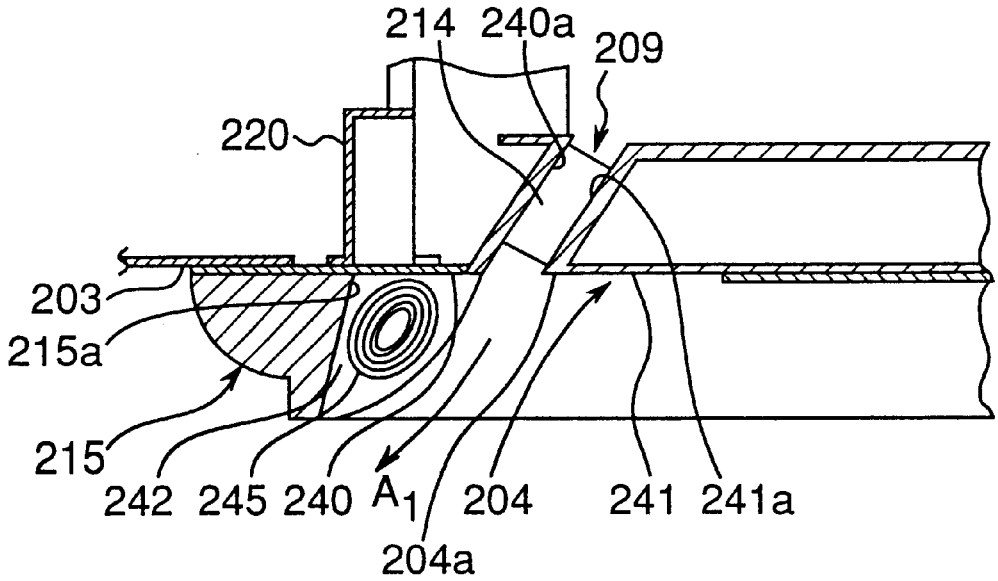
FIG. 48 is a sectional view showing a third modification example of the construction of the air blowing port portion of the above device.

FIG. 48 shows a third modification example of the wall member 215. The wall member 215 of this third modification example is similar to the wall member 215 of the second modification example and differs from the wall member 215 of the second modification example in that the inner peripheral surface 215*a* of the wall member 215 is tapered to gradually expand downward.

With the above-mentioned construction, the aesthetic properties of the wall member 215 become better than in the case of the wall member 215 of the second modification example.

Thirteenth Embodiment

Figure 49:
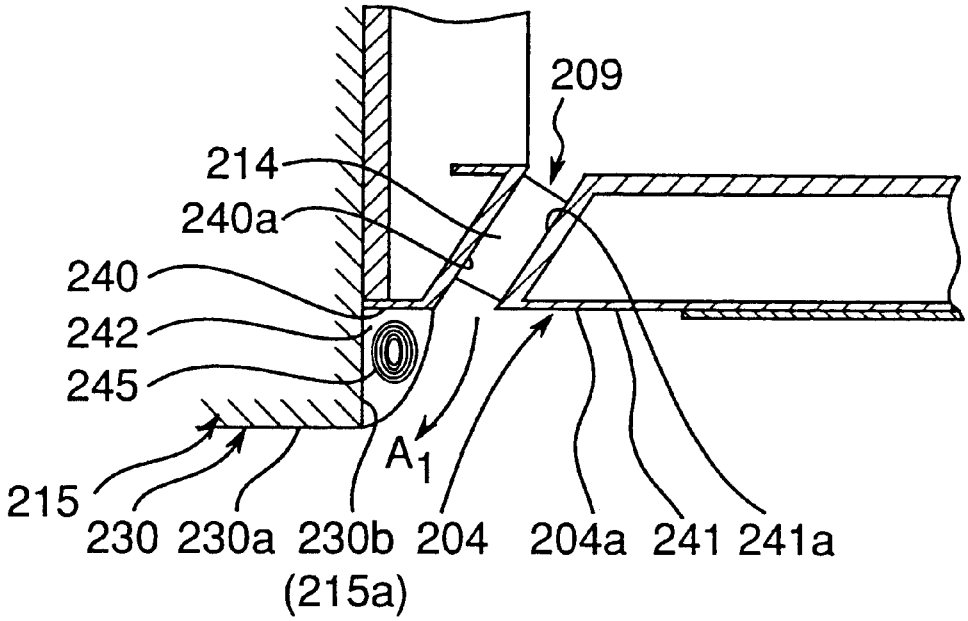
FIG. 49 is a sectional view showing the construction of an air intake and blowing device according to a thirteenth embodiment of the present invention.

FIG. 49 shows the essential part of the air purifier 201 according to the thirteenth embodiment of the present invention. This air purifier 201 has the same basic construction as that of the air purifier 201 of the twelfth embodiment and differs from the air purifier 201 of the twelfth embodiment in the following points.

That is, in the air purifier 201 of the twelfth embodiment, the air purifier 201 is arranged so that the panel member 204 is flush with the ceiling 203, and the wall member 215 is provided in a protruding state on the air blowing side surface 204*a* of the panel member 204. In contrast to this, the air purifier 201 of this thirteenth embodiment is arranged in a state in which the air blowing side surface 204*a* of the panel member 204 is sunk by a specified dimension from the surface 203*a* of the wall 230 in a recess provided in the ceiling wall or room wall, and the corner portion 242 is formed outside the air blowing port 209 between the inner peripheral surface 230*b* of the wall 230 and the air blowing side surface 204*a* of the panel member 204.

Therefore, according to this thirteenth embodiment, the wall 230 serves as the wall member 215, and the inner peripheral surface 230*b* of the wall 230 functions as the inner peripheral surface 215*a* of the wall member 215, also producing the same operation and effect as those of the air purifier 201 of the twelfth embodiment. In addition to this, cost reduction can be expected by the reduction in number of components since the wall member 215 is not required to be constructed of a special member.

Fourteenth Embodiment

Figure 50:
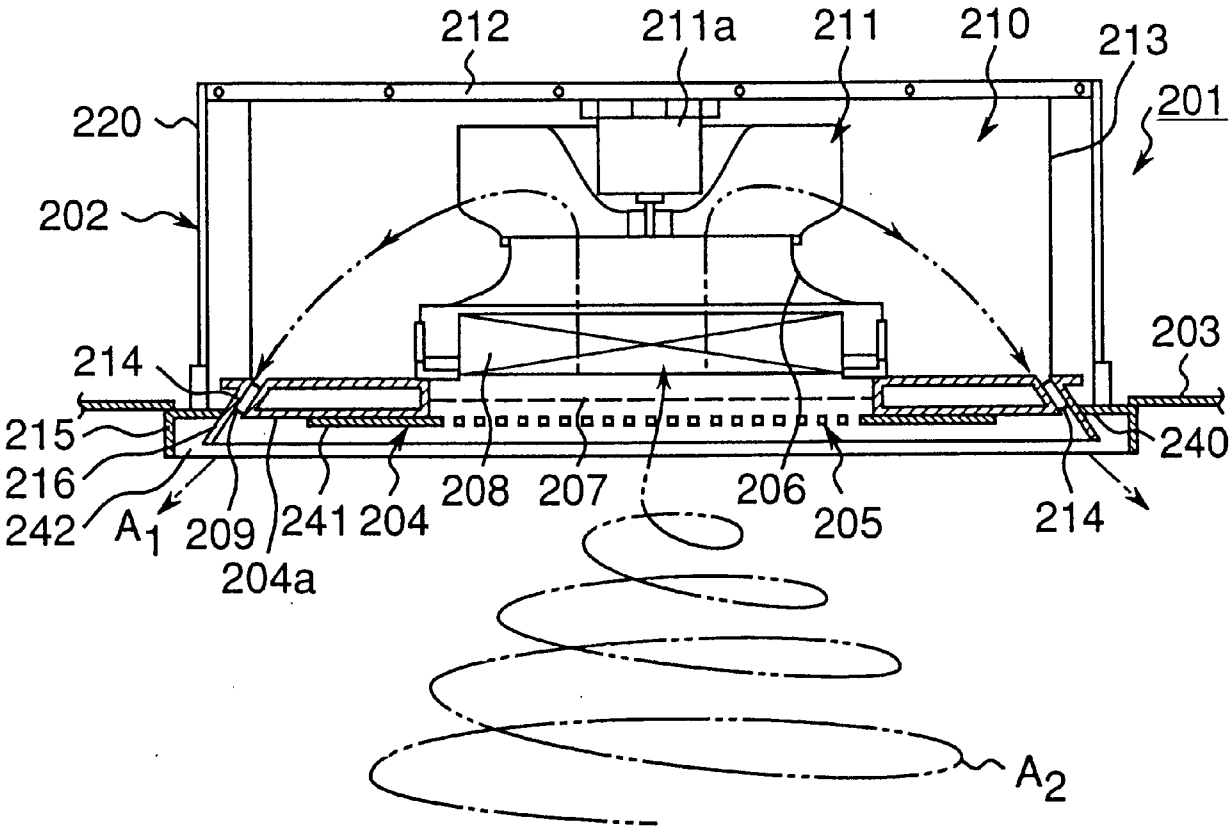
FIG. 50 is a sectional view showing the construction of an air intake and blowing device according to a fourteenth embodiment of the present invention.
Figure 51:
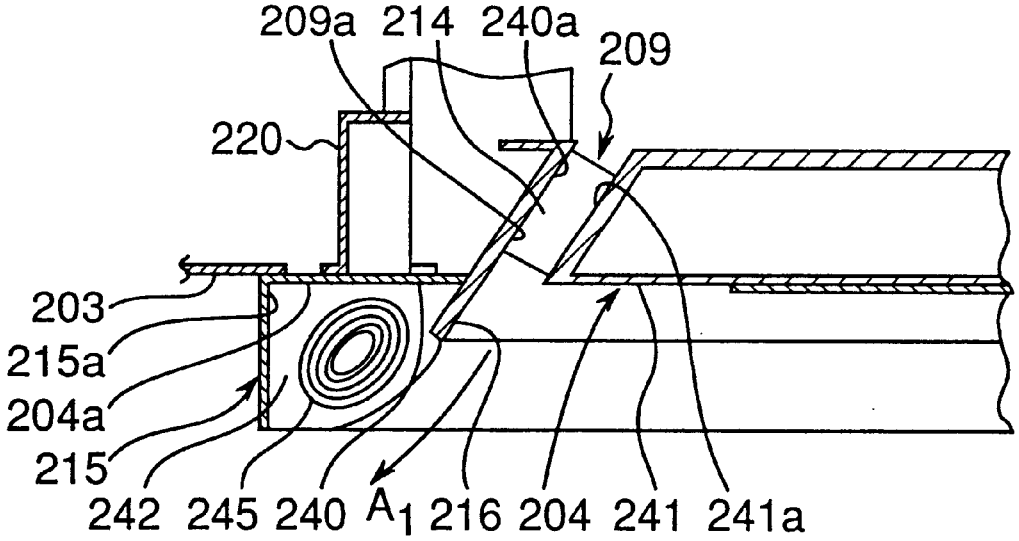
FIG. 51 is an enlarged view of the air blowing port portion of the air intake and blowing device shown in FIG. 50.

FIG. 50 and FIG. 51 show the essential part of the air purifier 201 according to the fourteenth embodiment of the present invention. This air purifier 201 has the same basic construction as that of the air purifier 201 of the twelfth embodiment, the construction being obtained by adding a guide member 216 described as follows to the air purifier 201 of the twelfth embodiment.

That is, in the air purifier 201 of this fourteenth embodiment, as shown in FIG. 51, the guide member 216 constructed of the tapered surface extending as an extension of the outer peripheral wall 209*a* is additionally provided at the air blowing side end portion of the outer peripheral wall 209*a* constructed of the tapered surface of the air blowing port 209.

With the above-mentioned construction, the vortex flow $A_1$ blown from the air blowing port 209 is guided by the guide member 216 and more reliably prevented from adhering to the air blowing side surface 204*a* since the guide member 216 extends downward from the air blowing side surface 204*a* of the panel member 204. As a result, the operation of forming the swirl flow 245 in the corner portion 242 and the operation of restricting the formation of the velocity boundary layer by the swirl flow 245 are further promoted, by which the same operation and effect as those of the air purifier 201 of the twelfth embodiment are further promoted.

Fifteenth Embodiment

Figure 52:
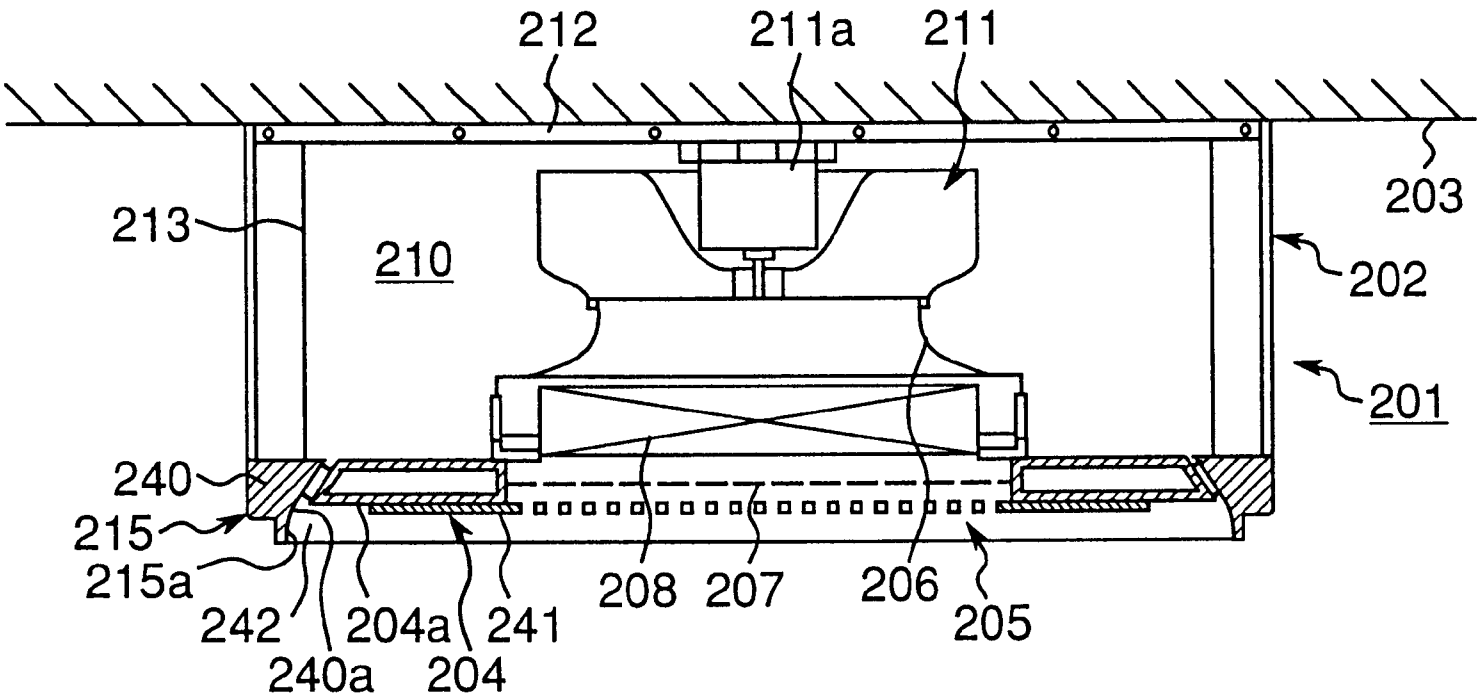
FIG. 52 is a sectional view showing the construction of an air intake and blowing device according to a fifteenth embodiment of the present invention.

FIG. 52 shows an air purifier 201 according to the fifteenth embodiment of the present invention. In contrast to the fact that the air purifier 201 of each of the aforementioned embodiments is the ceiling embedded type, the air purifier 201 of this embodiment is the ceiling hung type. However, the basic construction of the air purifier 201 is similar to that of the air purifier 201 of each of the aforementioned embodiments. Therefore, in this case, the same constituent members as those of the air purifier 201 of each of the aforementioned embodiments are denoted by the same reference numerals shown in FIG. 43 through FIG. 51 with no description provided for them, and the construction peculiar to the present embodiment will only be described.

In the air purifier 201 of this embodiment, having the construction peculiar to the ceiling hung type, the wall member 215 is formed integrally with the outer frame panel 240 that extends only inwardly of the outer peripheral surface of the main casing 202 and forms the annular air blowing port 209 between it and the inner frame panel 241, and the inner peripheral surface 240*a* of the outer frame panel 240 has an arc-shaped tapered surface serving as the inner peripheral surface 215*a* of the wall member 215.

With the above-mentioned construction, even the ceiling hung type air purifier 201 can obtain the same operation and effect as those of the ceiling embedded type air purifier 201 of each of the aforementioned embodiments.

Sixteenth Embodiment

Figure 53:
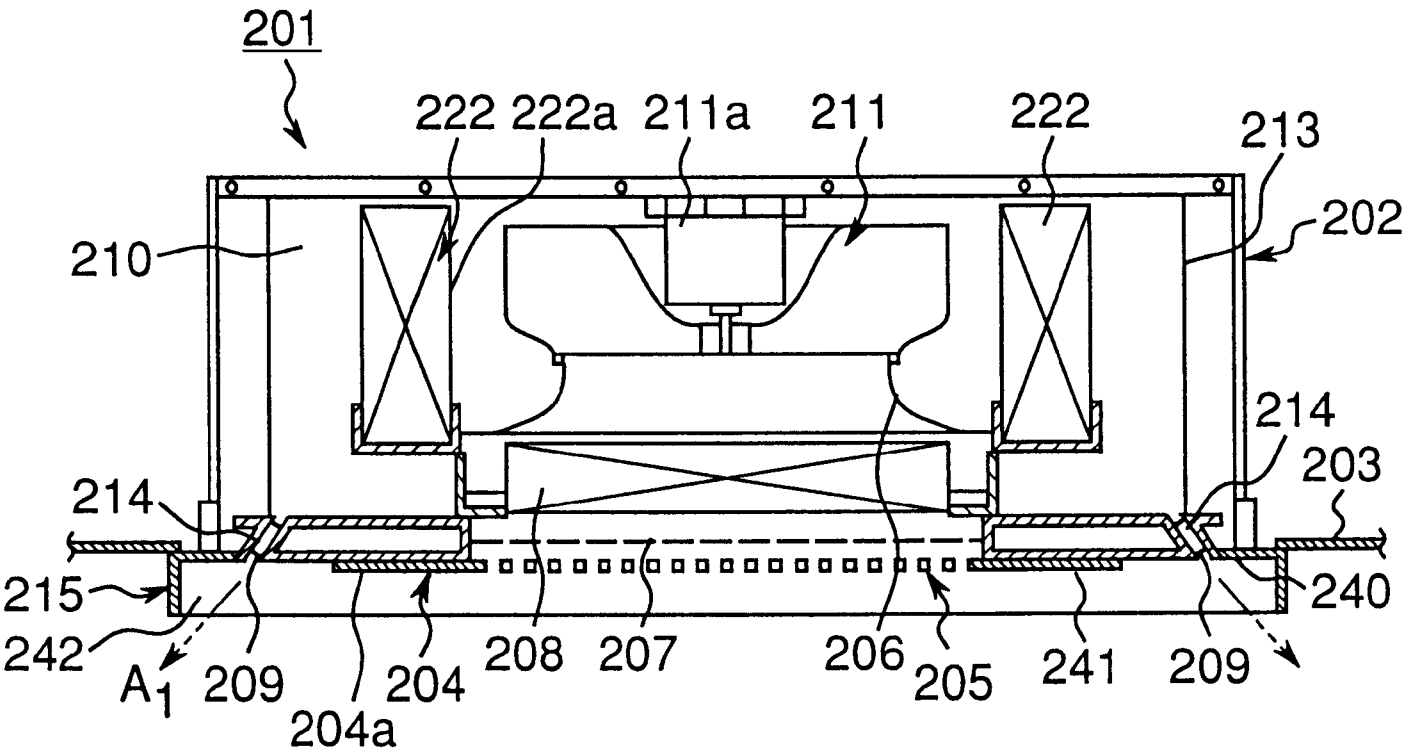
FIG. 53 is a sectional view showing the construction of an air intake and blowing device according to a sixteenth embodiment of the present invention.
Figure 54A:
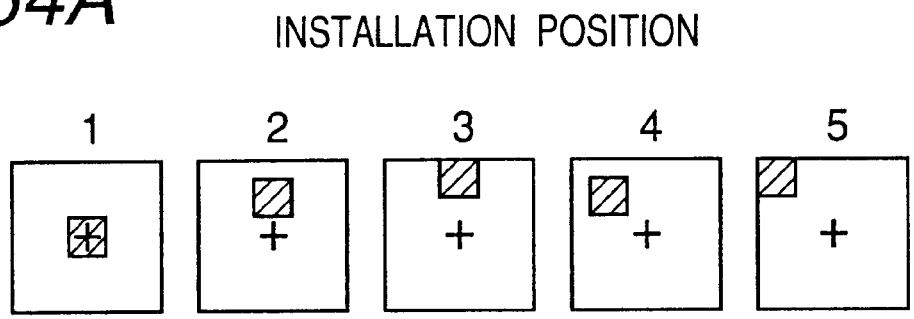
FIGS. 54A and 54B are views of evaluation of performance in each installation position of the air intake and blowing device.
Figure 54B:
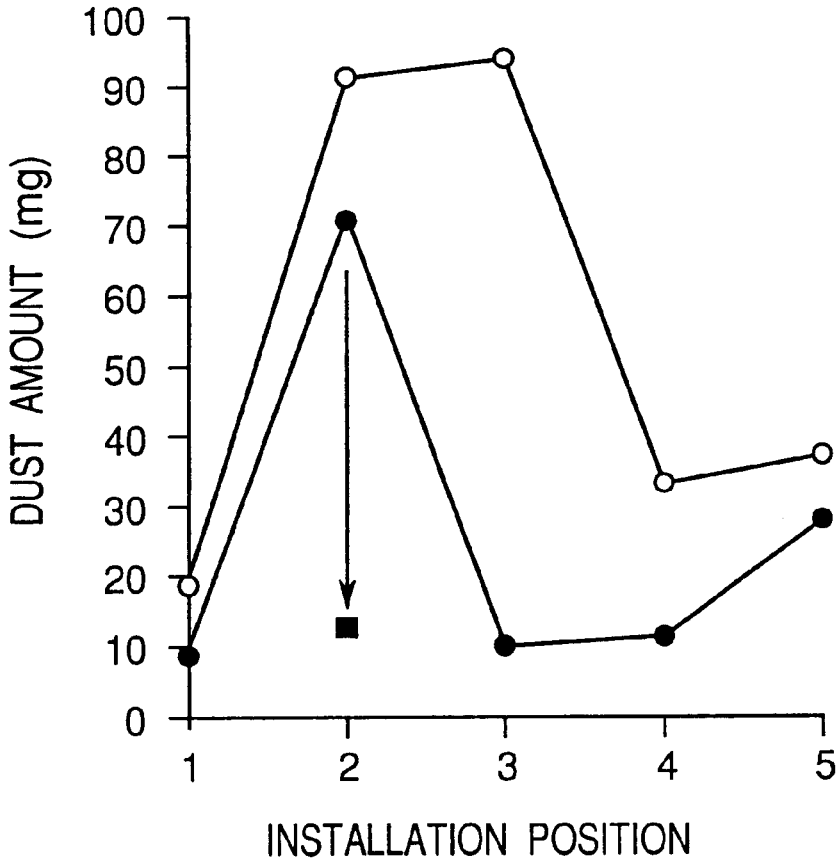

FIG. 53 shows an air purifier 201 according to the sixteenth embodiment of the present invention. The air purifier 201 of this embodiment is based on the ceiling embedded type air purifier 201 of the twelfth embodiment, in which an air heat exchanger 222 formed in a cylindrical form inside the air passage 210 of the air purifier 201 is arranged so that its inner peripheral surface 222*a* faces the air blowing port of the turbo fan 211 and an air temperature adjusting function is added to the air purifier 201 in addition to the air purifying function.

By thus increasing the number of functions by adding the air temperature adjusting function to the air purifier 201 in addition to its original function of the air purifying function, the air purifier 201 can also be used as an air conditioner to enable the indoor living environment to be more comfortable, and this improves the versatility of the air purifier 201.

In connection with this embodiment, an example in which the number of functions is increased by additionally providing the air heat exchanger 222 for the air purifier 201 of the twelfth embodiment. However, the present invention is not limited to this combinational construction, and it is, of course, possible to increase the number of functions by additionally providing the air heat exchanger 222 for the air purifier 201 of, for example, the second and fourteenth embodiments.

In connection with the aforementioned twelfth embodiment to the sixteenth embodiment, based on the air intake and blowing devices of the ceiling embedded type or the ceiling hung type, the air purifier 201 is described as an application example of the air intake and blowing device. However, the air intake and blowing device of the present invention is limited neither to the above installation forms nor to the air purifier 201. As an installation form, the present invention can be applied to a variety of forms of, for example, a wall hung type and a floor type. As an application example, the present invention can broadly be applied to the devices that utilize the air intake and blowing operation of air, or a variety of devices such as a ventilation device and a dust collecting device besides the air purifier and the air conditioner.

Seventeenth Embodiment

Figure 55:
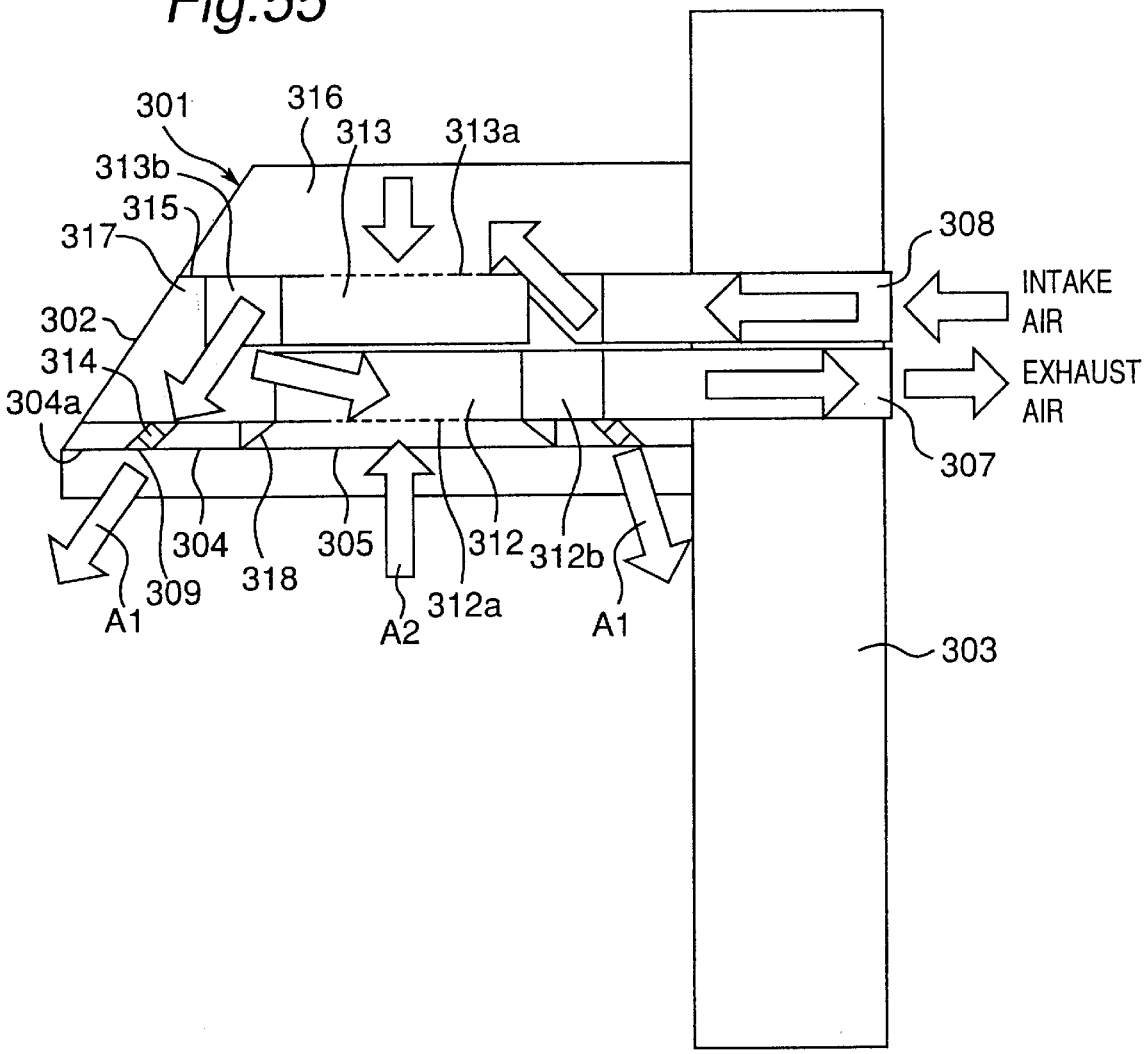
FIG. 55 is a sectional view of an air intake and blowing device according to a seventeenth embodiment of the present invention.

FIG. 55 is a sectional view of an air intake and blowing device 301 of the seventeenth embodiment. This air intake and blowing device 301 is used for the ventilation of, for example, a home kitchen, a kitchen for business use or the like by fixing its casing 302 to a wall 303.

The air intake and blowing device 301 has an exhaust duct 307 that serves as an exhaust air passage and an air intake duct 308 that serves as a fresh air passage. One end of the exhaust duct 307 and the air intake duct 308 is connected to the casing 302, and the other end of the exhaust duct 307 and the air intake duct 308 is opened outdoor penetrating the wall 303. A horizontal panel 304 is provided in a bottom portion of the casing 302. This panel 304 is provided with a circular air intake port 305 in a center portion, and an annular air blowing port 309 is provided radially outwardly around this air intake port 305. This annular air blowing port 309 is enclosing the air intake port 305. The air blowing port 309 is provided with a plurality of vortex flow creating fixed vanes 314 at regular intervals in the circumferential direction. The plurality of vortex flow creating fixed vanes 314 are mounted on the air blowing port 309 while being inclined at a specified angle so that air blown from the air blowing port 309 turns.

An exhaust fan 312 and a supply air fan 313 are provided in the center portion of the casing 302. The exhaust fan 312 and the supply air fan 313 are the centrifugal multi-wing type fan and commonly own a built-in electric motor (not shown). The exhaust fan 312 has a circular opening 312*a* for sucking in air on its lower surface and an exhaust pipe 312*b* in the tangential direction of the circumference. This exhaust pipe 312*b* is connected to the exhaust duct 307. The supply air fan 313 has a circular opening 313*a* for sucking in air on its upper surface and an exhaust pipe 313*b* in the tangential direction of the circumference. This exhaust pipe 313*b* has an end portion opened inside the casing 302.

On the other hand, a partition wall 315 is provided on a plane identical to the upper surface of the supply air fan 313. Then, the partition wall 315 divides the inside of the casing 302 into an upper separate chamber 316 and a lower separate chamber 317.

The air intake port 305 and the opening 312*a* of the exhaust fan 312 are connected to each other by a conical trapezoidal hood 318, and the conical trapezoidal hood 318 that extends from this air intake port 305 to the opening 312*a* of the exhaust fan 312 forms an air passage of air to be discharged. A space that extends from an end portion of the exhaust pipe 313*b* to the air blowing port 309 forms an air passage of fresh air.

Figure 56:
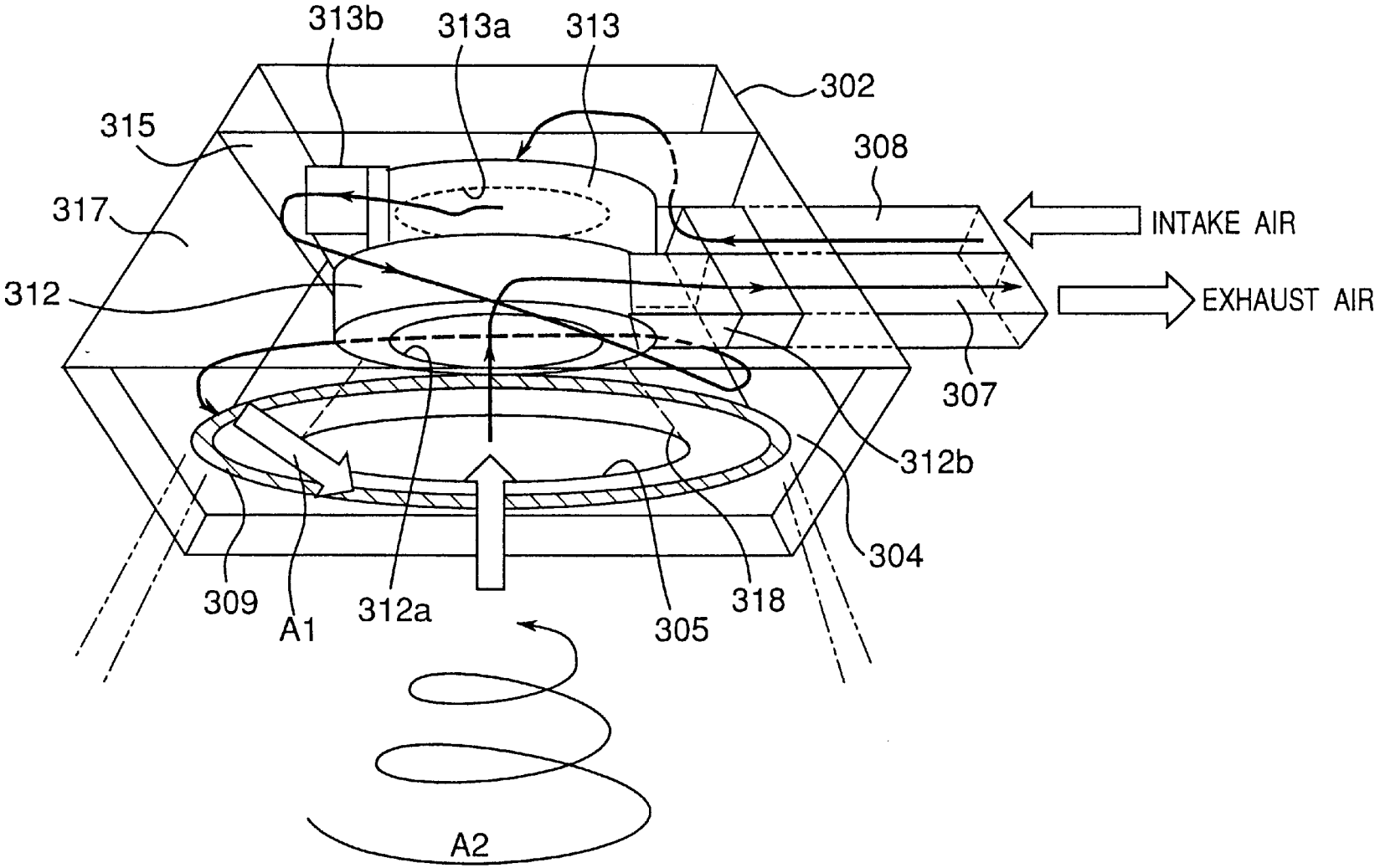
FIG. 56 is a perspective view of an air intake and blowing device of the seventeenth embodiment of the present invention.

The air intake and blowing device 301 operates as follows. The device will be described with reference to FIG. 56.

If the electric motor (not shown) is operated, then the exhaust fan 312 and the supply air fan 313 mounted on the electric motor start rotating. By the rotation of the supply air fan 313, a sucking force is generated in the opening 313*a* of the supply air fan 313, and a discharge force is generated in the exhaust pipe 313*b* of the supply air fan 313. Accordingly, fresh air is sucked from the other end portion of the air intake duct 308 into the casing 302 and guided from the opening 313*a* into the supply air fan 313. The fresh air sucked into the supply air fan 313 is compressed by the fan and discharged from the exhaust pipe 313*b* to the lower separate chamber 317 inside the casing 302. Then, the fresh air discharged to the lower separate chamber 317 goes around the exhaust fan 312 and is blown from the annular air blowing port 309 of the panel 304. In this case, the fresh air is blown obliquely downward as a vortex flow by the vortex flow creating fixed vanes 314 inside the air blowing port 309, forming a conical air curtain $A_1$.

On the other hand, the exhaust fan 312 starts rotating concurrently with the start of rotation of the supply air fan 313. The rotation of the exhaust fan 312 generates a sucking force in the opening 312*a* of the exhaust fan 312. This opening 312*a* is communicating with the air intake port 305 via the conical trapezoidal hood 318, and therefore, air located below the air intake port 305 is sucked into the air intake port 305. The air sucked into the air intake port 305 passes through the conical trapezoidal hood 318 located between the air intake port 305 and the opening 312*a* of the exhaust fan 312 and enters the exhaust fan 312. Then, air is compressed by the fan inside the exhaust fan 312 and discharged from the exhaust pipe 312*b*. The air discharged from the exhaust pipe 312*b* is discharged out of the room via the exhaust duct 307.

As described above, fresh air is blown from the air blowing port 309 by the rotation of the supply air fan 313 to form the conical air curtain A1, and air located below the air intake port 305 is sucked into the air intake port 305 by the rotation of the exhaust fan 312. In this stage, the air sucked into the air intake port 305 becomes a tornado flow A2.

As described above, the air sucked into the air intake port 305, which becomes the spiral tornado flow A2, is effectively sucked in without diffusing even when located apart from the air intake port 305.

The function as an exhaust hood cover is provided by the air curtain A1, and therefore, the exhaust hood is required to have no visor portion.

It is to be noted that the air blowing port 309 of the panel may be provided with an air flow adhesion preventing member for preventing the Coanda effect described in connection with the eighth embodiment.

The peripheral portion of the air blowing port of the panel may be provided with a wall member on the panel described in connection with the twelfth embodiment in order to stably form a tornado flow.

Furthermore, the present embodiment is a system in which the air intake and blowing device is mounted on the side wall. However, the device may be embedded in the ceiling or hung on the ceiling. Otherwise, the air intake and blowing device may be mounted on the side wall.

Although the exhaust fan 312 and the supply air fan 313 are driven by one electric motor in the present embodiment, the exhaust fan 312 and the supply air fan 313 may be driven by individual electric motors.

Eighteenth Embodiment

According to the seventeenth embodiment, the exhaust fan 312 and the supply air fan 313 are provided inside the casing 302. However, as measures against noise and dimensional increase, the exhaust fan and the supply air fan can be provided outside the casing 302.

Figure 57:
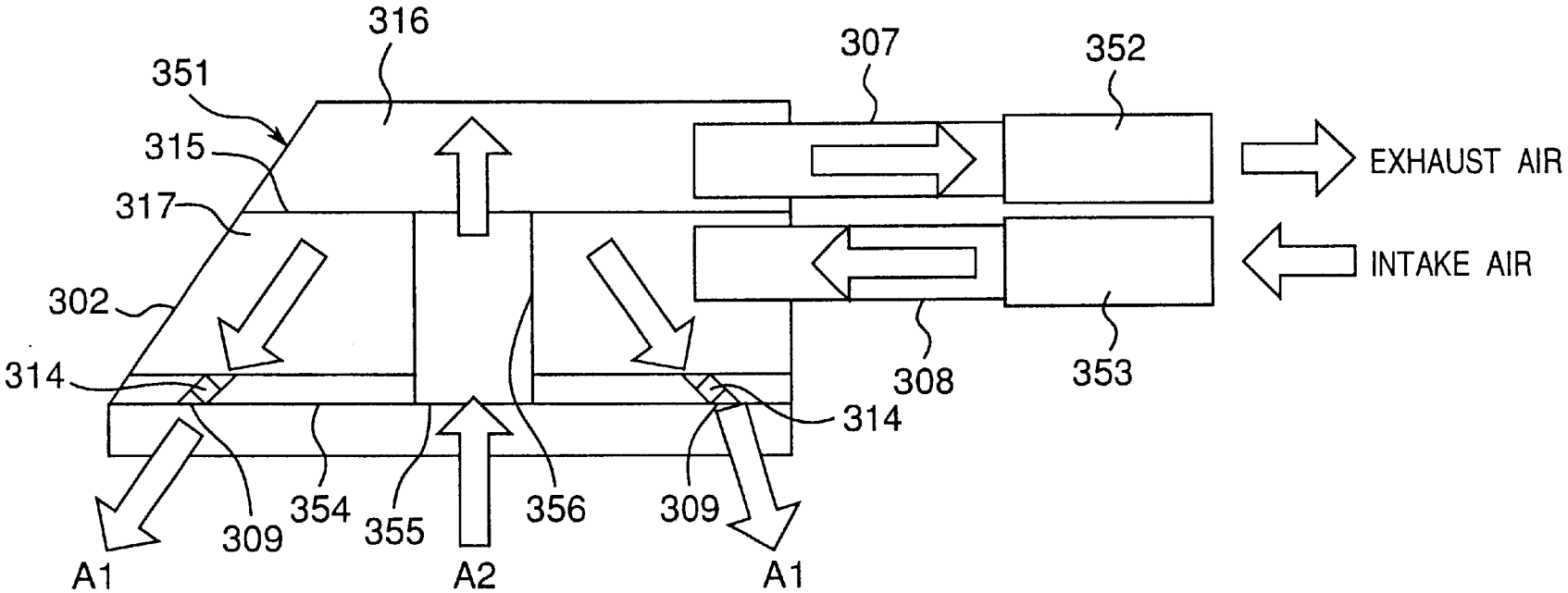
FIG. 57 is a sectional view of an air intake and blowing device according to an eighteenth embodiment of the present invention.

FIG. 57 is a sectional view of an air intake and blowing device 351 whose exhaust fan 352 and supply air fan 353 are provided outside the casing 302. This air intake and blowing device 351 has an exhaust duct 307 and an air intake duct 308 on a side surface of the casing 302. The exhaust duct 307 has one end connected to the casing 302 and the other end connected to an outdoor exhaust fan 352. The air intake duct 308 has one end connected to the casing 302 and the other end connected to an outdoor supply air fan 353. In the casing 302, a horizontal partition wall 315 is provided between the exhaust duct 307 and the air intake duct 308, internally dividing the casing 302 into an upper separate chamber 316 and a lower separate chamber 317. A panel 354 is provided in the bottom portion of the casing 302, while the panel 354 has a circular air intake port 355 in a center portion and an annular air blowing port 309 mounted with vortex flow creating fixed vanes 314 outside the outer periphery of this air intake port 355. A center duct 356 for making the air intake port 355 communicate with the upper separate chamber 316 of the casing 302 is provided in the center portion inside the casing 302.

If the supply air fan 353 is operated, then the supply air fan 353 sucks in outdoor fresh air and guides the air to the air intake duct 308. The fresh air inside the air intake duct 308 further enters the lower separate chamber 317 and is blown from the air blowing port 309. In this stage, air is blown while being turned by the vortex flow creating fixed vanes of the air blowing port 309, forming a conical air curtain A1.

On the other hand, the exhaust fan 352 rotates concurrently with the rotation of the supply air fan 353. This exhaust fan 352 sucks in the air inside the exhaust duct 307 and further sucks in the air inside the upper separate chamber 316 and the center duct 356. Then, by the suction of air in the center duct 356, air located below the air intake port 355 partitioned by the conical air curtain A1 is sucked into the air intake port 355 in the form of the tornado flow A2.

As described above, by providing outdoors the exhaust fan 352 and the supply air fan 353 and operating the air intake and blowing device 351, the noise of the exhaust fan 352 and the supply air fan 353 can be prevented. The exhaust fan 352 and the supply air fan 353 can be placed on the ground, and therefore, the air intake and blowing device is allowed to be a large-scale device of great performance.

It is to be noted that the panel may be a detachable panel separated from the casing or integrated with the casing in the first through eighteenth embodiments.

INDUSTRIAL APPLICABILITY

As described above, the air intake and blowing device of the present invention, which purifies or ventilates air in a place where smoke, poisonous gas or the like is generated, is suitable for use as an air purifier, a ventilating device, an air conditioner or a dust collecting device.

What is claimed is:

1. An air intake and blowing device wherein a main casing is provided with an air intake port and an air blowing port substantially enclosing the air intake port, and wherein an air passage is formed within the main casing so as to extend from the air intake port to the air blowing port, and wherein an air blowing fan capable of blowing air circumferentially in all periphery thereof is provided in the air passage, and wherein a vortex flow creating member including a plurality of stators for creating a vortex air flow is provided in the air blowing port so that a spiral swirl-blowing air flow is formed so as to generate an intake swirl flow having a sucking force toward a center axis of the spiral swirl-blowing air flow and the air intake port.

2. An air intake and blowing device as claimed in claim 1, wherein the air blowing port is comprised of an annular opening continuous in the circumferential direction.

3. An air intake and blowing device as claimed in claim 1, wherein the air blowing port is comprised of a plurality of slit-shaped openings arranged at a specified interval in the circumferential direction.

4. An air intake and blowing device as claimed in claim 1, wherein the vortex flow creating member is comprised of a plurality of stators that have a specified inclination angle in an air turn direction and are provided in the air blowing port.

5. An air intake and blowing device as claimed in claim 1, wherein the vortex flow creating member is comprised of a plurality of first stators that a re provided in the air blowing port to adjust an angle of an air turn direction and a plurality of second stators that are provided in the air blowing port to adjust an angle of an air blow direction.

6. An air intake and blowing device as claimed in claim 1, wherein the air blowing port is formed in such a manner as to be inclined obliquely outwardly from an upstream side to a downstream side of air flow.

7. An air intake and blowing device as claimed in claim 1, wherein the air blowing port is formed in a vertical direction from an upstream side to a downstream side of air flow.

8. An air intake and blowing device as claimed in claim 1, wherein an air blow condition of the air blowing port is set so that a ratio between a circumferential velocity component and a vertical velocity component becomes 0.25 to 1.

9. An air intake and blowing device wherein an air intake port and an air blowing port substantially enclosing the air intake port are opened on a casing, and wherein a tornado flow directed toward the air intake port is generated inside a vortex flow by blowing air sucked through the air intake port from the air blowing port as the vortex flow, and wherein the air blowing port is provided with an air flow adhesion preventing member for preventing the vortex flow blown from the air blowing port from adhering to a casing surface.

10. An air intake and blowing device as claimed in claim 9, wherein the air flow adhesion preventing member is comprised of an annular body that extends from an outer peripheral edge of the air blowing port to an extension of the outer peripheral edge substantially along the air blow direction of the air blowing port throughout an entire circumference of the outer peripheral edge in a state in which the annular body is protruded from the casing surface.

11. An air intake and blowing device as claimed in claim 9, wherein the air flow adhesion preventing member is comprised of an annular body protruded from an outer peripheral edge of the air blowing port into an air blowing passage of the air blowing port throughout an entire circumference of the outer peripheral edge.

12. An air intake and blowing device as claimed in claim 9, wherein the air flow adhesion preventing member is comprised of an outer annular body protruded from an outer peripheral edge of the air blowing port into an air blowing passage of the air blowing port throughout an entire circumference of the outer peripheral edge and an inner annular body protruded from an inner peripheral edge of the air blowing port into the air blowing passage throughout an entire circumference of the inner peripheral edge.

13. An air intake and blowing device as claimed in claim 9, wherein an air heat exchanger or an air purifying element or both the air heat exchanger and the air purifying element are arranged in an air passage that extends from the air intake port to the air blowing port.

14. An air intake and blowing device as claimed in claim 9, wherein the air intake port and the air blowing port are connected to an air discharge means and an air supply means, respectively.

15. An air intake and blowing device as claimed in claim 14, wherein the air supply means is an air conditioning mechanism for supplying temperature controlled air.

16. An air intake and blowing device as claimed in claim 14, wherein a total heat exchange mechanism for performing heat exchange between exhaust air discharged by the air discharge means and supply air supplied by the air supply means is interposed between the air discharge means and the air supply means.

17. An air intake and blowing device wherein an air intake port and an air blowing port substantially enclosing the air intake port are provided to form a tornado flow directed toward the air intake port inside an vortex flow by blowing air sucked through the air intake port from the air blowing port as the vortex flow, and wherein a wall member that forms a specified corner portion between the wall member and an air blowing side surface of a panel member is provided with the air blowing port in a position outwardly separated by a specified distance from the air blowing port in terms of a plan view.

18. An air intake and blowing device as claimed in claim 17, wherein the wall member is comprised of a protruding body that is protruded ahead in the air blow direction from the air blowing side surface of the panel member and extended so as to enclose the air blowing port.

19. An air intake and blowing device as claimed in claim 17, wherein the wall member is formed integrally with the panel member provided with the air blowing port.

20. An air intake and blowing device as claimed in claim 17, wherein the wall member is comprised of a room interior wall that is arranged so as to be extended in a direction approximately perpendicular to a surface of the panel member in a state in which the wall surface encloses the panel member provided with the air blowing port.

21. An air intake and blowing device as claimed in claim 17, wherein a guide member extended in a direction of extension of an outer peripheral wall of the air blowing port is provided throughout the entire region of the air blowing port.

22. An air intake and blowing device as claimed in claim 17, wherein an air heat exchanger is arranged inside an air passage that extends from the air intake port to the air blowing port.

23. An air intake and blowing device as claimed in claim 17, wherein an air purifying element is arranged inside an air passage that extends from the air intake port to the air blowing port.

24. An air intake and blowing device comprising:

a panel having an air intake port and an air blowing port that substantially encloses the air intake port;

a main casing which internally has an air passage that extends from the air intake port and an air passage that extends to the air blowing port and to which the panel is attached; and a vortex flow creating member including a plurality of stators for creating a vortex air flow from the air blowing port, so that a spiral swirl-blowing air flow is formed so as to generate an intake swirl flow having a sucking force toward a center axis of the spiral swirl-blowing air flow and the air intake port.

25. An air intake and blowing device as claimed in claim 24, wherein the air intake port is provided with an exhaust air passage that communicates with the air intake port via the air passage.

26. An air intake and blowing device as claimed in claim 24, wherein the air blowing port is provided with a fresh air intake passage that communicates with the air blowing port via the air passage.

27. An air intake and blowing device as claimed in claim 24, comprising:

an air flow adhesion preventing member for preventing the vortex air flow blown from the air blowing port from adhering to a surface of the panel.

28. An air intake and blowing device as claimed in claim 24, wherein a wall member is provided on a surface of the panel separated apart by a specified distance from the air blowing port toward the outer periphery of the panel, forming a specified corner portion between the panel and the wall member.

29. An air intake and blowing device as claimed in claim 24, wherein a fan for sucking in air from the air intake port via the air passage and blowing air to the air blowing port via the air passage is provided inside the casing.

30. An air intake and blowing device as claimed in claim 25, comprising:

an exhaust fan for blowing to the exhaust air passage the air sucked from the air intake port via the air passage.

31. An air intake and blowing device as claimed in claim 26, comprising:

a supply air fan for blowing the fresh air sucked from the fresh air intake passage to the air blowing port via the air passage.

32. An air intake and blowing device as claimed in claim 30, comprising:

a supply air fan for blowing fresh air sucked from a fresh air intake passage to the air blowing port via the air passage.

* * * * *